US006311403B1

(12) United States Patent
Macrini

(10) Patent No.: US 6,311,403 B1
(45) Date of Patent: Nov. 6, 2001

(54) APPAREL SIZE CALCULATOR

(76) Inventor: Gennaro J. Macrini, 131 Promenade Ct., Louisville, KY (US) 40223

( * ) Notice: Subject to any disclaimer, the term of this patent is extended or adjusted under 35 U.S.C. 154(b) by 0 days.

(21) Appl. No.: 09/134,675

(22) Filed: Aug. 14, 1998

(51) Int. Cl.[7] ..... A41H 1/00; A41H 31/00
(52) U.S. Cl. ..... 33/15 D; 33/17 R; 33/512
(58) Field of Search ..... 33/15 D, 1 B, 33/15 B, 1 R, 17 R, 511, 512

(56) References Cited

U.S. PATENT DOCUMENTS

| | | | | |
|---|---|---|---|---|
| 1,681,740 | * | 8/1928 | Meyers | 40/495 |
| 3,808,694 | * | 5/1974 | Hutchinson et al. | 33/512 |
| 3,955,285 | * | 5/1976 | Moeckl | 33/515 |
| 3,979,831 | * | 9/1976 | Lutz | 33/17 R |
| 3,995,379 | * | 12/1976 | Werber | 40/495 |
| 4,407,070 | * | 10/1983 | Lowe | 33/511 |

OTHER PUBLICATIONS

Anatomical Divisions of the Human Form, Stone, 1908.
Anthropometric Nomograph of Army Men, Randall Jan. 1949.
US Dept of Commerce, TS–5657A May 16, 1966.
Ascot Formal Wear—Chart—unknown date.
Custom Family Fitting Guide p. 16315 (unknown date).
JC Penny Catalog Jul. 26, 1994 p.58.
"Human Scale" 1/2/3 Niels Diffrient 1985.
Treatise on Sizing, Macrini 1995.
ASTM Submission to Committee for standards 1995.
Comprehensive Anatomical Male Sizing Male Sizing Study, Macrini Sep. 1989.
1993 Mens Selling Guide p. 49.
"Made to Measure" p. 162 1998.

* cited by examiner

*Primary Examiner*—Diego Gutierrez
*Assistant Examiner*—R A Smith
(74) *Attorney, Agent, or Firm*—Sam Silverberg

(57) ABSTRACT

A calculating device for determining an apparel size of an adult male based on a given weight and height comprising: means for entering into the device a height and a weight, means for determining an apparel size based on the data in Tables 1–17 wherein the data is generated on a proportional basis from the data in Tables 1–17 with the following constrains on the data; the weight increments are no greater than about 10 pounds per about one inch of height for a chest size less than 53; the weight increments are not greater than 14 pounds per one inch of height for a chest size 53 or greater; means for displaying the apparel size.

20 Claims, 1 Drawing Sheet

APPAREL SIZE CALCULATOR

FIELD OF INVENTION

The invention relates to calculating the size of men's apparel based on the height and weight of a man.

BACKGROUND OF THE INVENTION

The selection of apparel to ensure a proper fit has always required knowing the relevant size(s) of a man's physical dimensions. When purchasing clothes off the rack, specific physical dimensions are needed to make the a proper size selection. For selecting a shirt:, the size of the sleeve length, neck and chest are needed. For selecting pants, the size the inseam and waist are needed. If the person is present, these sizes can be tape measured or the apparel can be tried on for fit. The problem in making a proper selection arises when the person is not available or is not measured accurately. This invention solves this problem if the height and weight is known or can be measured.

The apparel industry has recognized that a person of expertise is needed to make an accurate measurement. Usually in clothing stores an expert is not available for measuring at the time of purchasing or certain measurements cannot be easily taken. The measurements made by a lay person are often incorrect. Ten different people can measure a person and arrive at ten different measures. The solution to the problem has been to develop a relationship between the size of a garment and a set number of physical measurements.

U.S. Pat. No. 1,681,740 to Meyers shows a sizing wheel that determines undergarment size based on a three measurements. The three measurements are chest, waist and trunk. British Patent No. 684,903 computes a suit designation of Regular or Long or Extra long or Standard or Portly or Stout based on the measurements of chest size, waist size and height.

The use of height and weight for determining clothes size for men is not a novel concept. The magazine, Made To Measure, on page 152, features a table that allows men to select their clothes size based on a range of weight and height. Likewise JC Penny catalog, for 1993, on page 49 and for 1995, on page 58 show a similar table for selecting men's clothing. These tables suffer from an inability to accurately allow one to select the proper clothes size for a broad spectrum of the population. In 1989, the inventor published a more complete table of male sizes, however this table lacked the comprehensive data to produce an accurate table that would cover a broad spectrum of adult males.

BRIEF DESCRIPTION OF THE DRAWINGS

The FIGURE shows a wheel made of two discs to calculate sizes.

SUMMARY OF THE INVENTION

Figure 1:
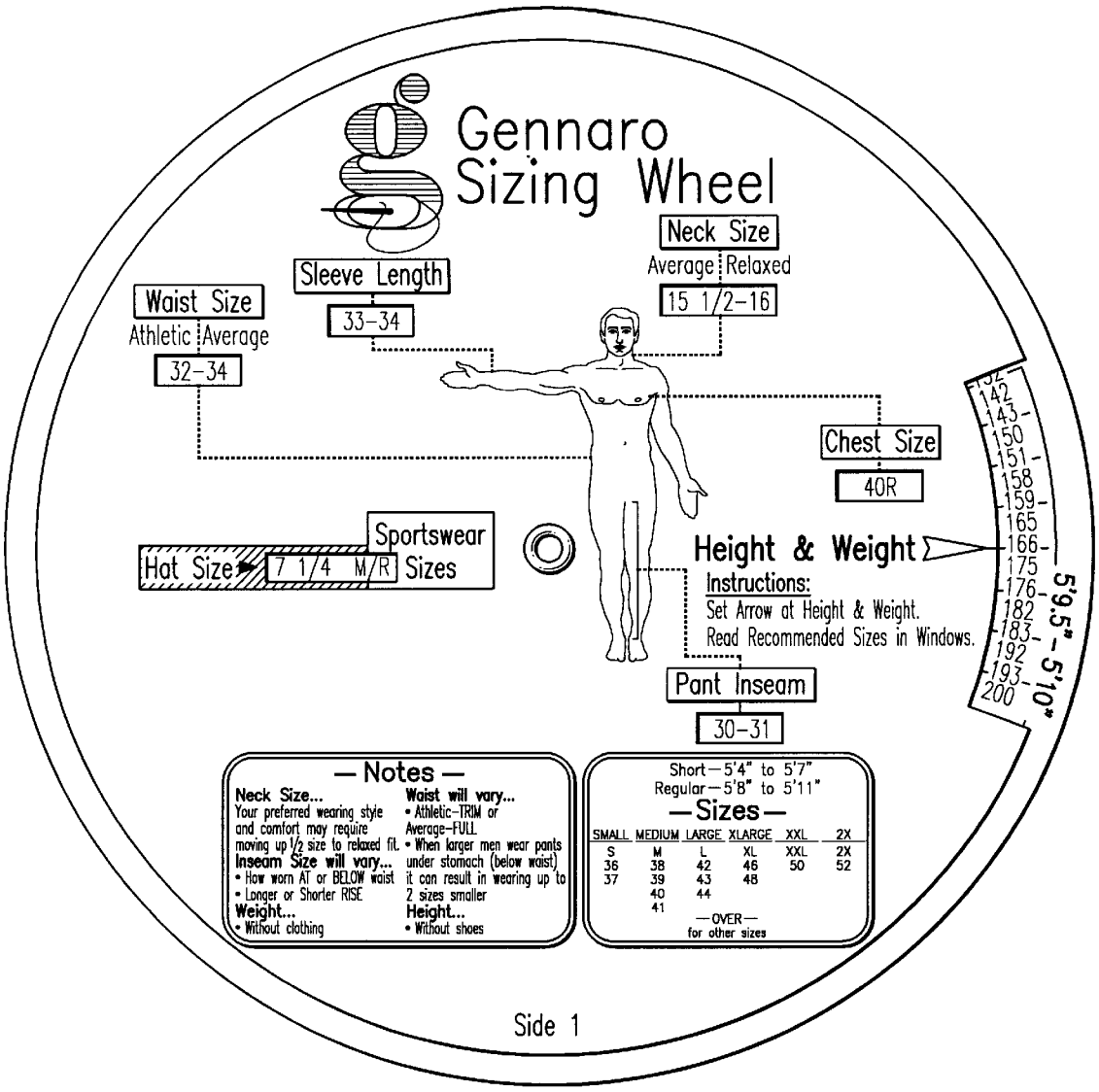

The objective of this invention is to solve the problem of selecting apparel when the right size of the apparel is not known over a broad spectrumn of possible male anatomical sizes. By doing a comprehensive analysis of possible male anatomical sizes, based on height and weight an accurate relationship was developed that can be used to cover a broader range of possible male anatomical sizes.

The parts of a male's physical anatomy that can be determined include the waist size, the chest size, the sleeve length, hat size, and pants inseam can be calculated. The means to calculate these sizes from the height and weight can include a sizing wheel, a computer, a slide rules, or a chart that functionally shows the relationships between the data. For a sizing wheel the data was compromised in selected size ranges in order to fit the data on the wheel.

DETAILS OF THE INVENTION

The invention can be best described by the data in the tables and the sizing wheel shown in FIG. 1. Tables 1–17 show the sizes of waist for athletic, trim, and average build, chest, sleeve length, hat size, and pants inseam and outseam length, foot length, foot, head length, head and neck length, head circumference, hat size, hand width, foot width, neck, ring finger circumference, ring size for a given weight and height of a male. To generate the data a range of heights and weights were selected. Preferably the heights ranged from 5 feet 4 inches to 6 feet eight inches and the weight ranged from 107 pounds to 405 pounds. For chest sizes less than 53, the height range and the weight range was divided into increments of about ten pounds or less per about one inch of height. For chest sizes 53 or greater the weight increments are not greater than about 14 pounds per about one inches of height. Smaller increments can be used to arrive at an accurate size by proportioning the data. The use of increments of weight greater than 10 pound per one inch of height for chest sizes less than 53 skews the data and creates inaccuracies in calculating an apparel size. For chest sizes of less than 53, the preferred range of height increments to weight increments is 6–10 pounds or less for each one inch of height. As the increments of height approach about 1.5 inch inaccuracies in the calculation of apparel sizes are created. Tables 1–17 shows the relationships between the height and weight for a particular size within the stated tolerance range. The increment reading of the height in these Tables is meant to cover a one inch increment range. For example, in Table 1 the height increment 5'3.5" to 5'4" covers a range from 5'3.5" to less than 5'4.5". Likewise the height increment 5'4.5" to 5'5" covers a range of from 5'4.5" to less than 5'5.5".

Tables 18–24 shows data based for a sizing wheel based on the data in Tables 1–17. For heights greater than 5'6" the weight increments are not greater than 10 pounds per 1.5 inch for a chest size less than 46. For chest sizes 46 or greater than, the weight increments are not greater than about 18 pounds per 1.5 inch.

The operation of the sizing wheel can be shown in FIG. 1. The sizing wheel is made up of at least two discs that rotate about a common center. Disc 1 has all the data presented in a scalar relationship to be displayed through cutouts in disc 2 for any given height and weight. The height and weight is presented on the periphery of disk 1. Disc 2 has cutouts that display the apparel size and a cutout portion on the periphery of the disc displaying the height and weight. Disc 2 has an indicator shown as an arrow that functionally relates apparel sizes to weight and height. When disc 2 is moved to align the arrow to a given weight and height on disc 1 the apparel sizes are displayed through the cut outs in disc 2. In the figure the arrow is pointed to a of weight of 166–175 and height of 5 feet 9.5 inches to 5 feet 10 inches. The cutouts display the neck sizes sleeve length, the hat size, chest size, and waist size. Disc 1 also allows one to take the data and select a suit based on a table printed on disc 2. The disc can be turned upside down and more apparel sizes can be displayed as a function of height and weight by utilizing the back of the discs.

A sizing wheel can be constructed using more than two discs. The only requirement is that the apparel sizes presented are accurately displayed in relationship to the height and weight as set forth in the tables.

The data can be entered into a conventional computer that can be programmed to generate an apparel size based on a given height and weight. The programming to achieve the apparel sizes based on a given height and weight would be a matter of routine skill for those in computer programming art. The program could prompt the user to enter the height and weight. The height and weight could be entered into the computer by typing from a keyboard. The apparel size can be displayed on a video monitor.

TABLE 1 of 17

| A | B | C | D | E | F | G | H | I |
|---|---|---|---|---|---|---|---|---|
| HEIGHT IN INCHES 63.5" to 64" | | | | | | | | |
| HEIGHT IN FEET AND INCHES 5' 3.5" to 5' 4" | | | | | | | | |
| CHEST SIZES | 34 | 35 | 36 | 37 | 38 | 39 | 40 | 41 |
| WEIGHT-MINIMUM | 107 | 115 | 123 | 131 | 139 | 147 | 155 | 163 |
| WEIGHT-MAXIMUM | 114 | 122 | 130 | 138 | 146 | 154 | 162 | 170 |
| SHIRT SLEEVE LENGTH | 30.593750 | 30.750000 | 30.906250 | 31.062500 | 31.218750 | 31.375000 | 31.531250 | 31.687500 |
| PANT OUTSEAM LENGTH | 37.500 | 37.500 | 37.500 | 37.500 | 37.500 | 37.500 | 37.500 | 37.500 |
| PANT INSEAM LENGTH | 30.1250 | 29.9375 | 29.7500 | 29.5625 | 29.3750 | 29.1875 | 29.0000 | 28.8750 |
| FOOT LENGTH | 9.75 | 9.75 | 9.75 | 9.75 | 9.75 | 9.75 | 9.75 | 9.75 |
| RELATED FOOT SIZE-MINIMUM | 6½ | 6½ | 6½ | 6½ | 6½ | 6½ | 6½ | 6½ |
| RELATED FOOT SIZE-MIDDLE | 7 | 7 | 7 | 7 | 7 | 7 | 7 | 7 |
| RELATED FOOT SIZE-MAXIMUM | 7½ | 7½ | 7½ | 7½ | 7½ | 7½ | 7½ | 7½ |
| HAND LENGTH | 6.46875 | 6.46875 | 6.46875 | 6.46875 | 6.46875 | 6.46875 | 6.46875 | 6.46875 |
| HEAD AND NECK LENGTH | 8.250 | 8.250 | 8.250 | 8.250 | 8.250 | 8.250 | 8.250 | 8.250 |
| HEAD CIRCUMFERENCE | 21.50000 | 21.68750 | 21.87500 | 22.06250 | 22.25000 | 22.43750 | 22.62500 | 22.81250 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 63.5" to 64" | | | | | | | | |
| HEIGHT IN FEET AND INCHES 5' 3.5" to 5' 4" | | | | | | | | |
| CHEST SIZES | 42 | 43 | 44 | 45 | 46 | 47 | 48 | 49 |
| WEIGHT-MINIMUM | 171 | 179 | 187 | 195 | 203 | 211 | 219 | 227 |
| WEIGHT-MAXIMUM | 178 | 186 | 194 | 202 | 210 | 218 | 226 | 236 |
| SHIRT SLEEVE LENGTH | 31.843750 | 32.000000 | 32.156250 | 32.312500 | 32.468750 | 32.625000 | 32.781250 | 32.937500 |
| PANT OUTSEAM LENGTH | 37.500 | 37.500 | 37.500 | 37.500 | 37.500 | 37.500 | 37.500 | 37.500 |
| PANT INSEAM LENGTH | 28.7500 | 28.6250 | 28.5000 | 28.3750 | 28.2500 | 28.1250 | 28.0000 | 27.8125 |
| FOOT LENGTH | 9.75 | 9.75 | 9.75 | 9.75 | 9.75 | 9.75 | 9.75 | 9.75 |
| RELATED FOOT SIZE-MINIMUM | 6½ | 6½ | 6½ | 6½ | 6½ | 6½ | 6½ | 6½ |
| RELATED FOOT SIZE-MIDDLE | 7 | 7 | 7 | 7 | 7 | 7 | 7 | 7 |
| RELATED FOOT SIZE-MAXIMUM | 7½ | 7½ | 7½ | 7½ | 7½ | 7½ | 7½ | 7½ |
| HAND LENGTH | 6.46875 | 6.46875 | 6.46875 | 6.46875 | 6.46875 | 6.46875 | 6.46875 | 6.46875 |
| HEAD AND NECK LENGTH | 8.250 | 8.250 | 8.250 | 8.250 | 8.250 | 8.250 | 8.250 | 8.250 |
| HEAD CIRCUMFERENCE | 23.00000 | 23.18750 | 23.37500 | 23.56250 | 23.75000 | 23.93750 | 24.12500 | 24.31250 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 63.5" to 64" | | | | | | | | |
| HEIGHT IN FEET AND INCHES 5' 3.5" to 5' 4" | | | | | | | | |
| CHEST SIZES | 50 | 51 | 52 | 53 | 54 | 55 | 56 | 57 |
| WEIGHT-MINIMUM | 237 | 247 | 257 | 267 | 279 | 292 | 304 | 314 |
| WEIGHT-MAXIMUM | 246 | 256 | 266 | 278 | 291 | 303 | 313 | 328 |

TABLE 1 of 17-continued

| | | | | | | | | |
|---|---|---|---|---|---|---|---|---|
| SHIRT SLEEVE LENGTH | 33.093750 | 33.250000 | 33.406250 | 33.562500 | 33.718750 | 33.875000 | 34.031250 | 34.187500 |
| PANT OUTSEAM LENGTH | 37.500 | 37.500 | 37.500 | 37.500 | 37.500 | 37.500 | 37.500 | 37.500 |
| PANT INSEAM LENGTH | 27.6250 | 27.4375 | 27.2500 | 27.0625 | 28.8750 | 26.6875 | 26.5000 | 26.3125 |
| FOOT LENGTH | 9.75 | 9.75 | 9.75 | 9.75 | 9.75 | 9.75 | 9.75 | 9.75 |
| RELATED FOOT SIZE-MINIMUM | 6½ | 6½ | 6½ | 6½ | 6½ | 6½ | 6½ | 6½ |
| RELATED FOOT SIZE-MIDDLE | 7 | 7 | 7 | 7 | 7 | 7 | 7 | 7 |
| RELATED FOOT SIZE-MAXIMUM | 7½ | 7½ | 7½ | 7½ | 7½ | 7½ | 7½ | 7½ |
| HAND LENGTH | 6.46875 | 6.46875 | 6.46875 | 6.46875 | 6.46875 | 6.46875 | 6.46875 | 6.46875 |
| HEAD AND NECK LENGTH | 8.250 | 8.250 | 8.250 | 8.250 | 8.250 | 8.250 | 8.250 | 8.250 |
| HEAD CIRCUMFERENCE | 24.50000 | 24.75000 | 25.00000 | 25.50000 | 26.50000 | 26.00000 | 26.00000 | 26.50000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 63.5" to 64" | | | | |
| HEIGHT IN FEET AND INCHES 5' 3.5" to 5' 4" | | | | |
| CHEST SIZES | 58 | 59 | 60 | TOLERENCE + OR − |
| WEIGHT-MINIMUM | 329 | 344 | 359 | |
| WEIGHT-MAXIMUM | 343 | 358 | 373 | +3 LBS −3 LBS |
| SHIRT SLEEVE LENGTH | 34.343750 | 34.500000 | 34.656250 | +½" −½" |
| PANT OUTSEAM LENGTH | 37.500 | 37.500 | 37.500 | +½" −½" |
| PANT INSEAM LENGTH | 26.1250 | 25.9375 | 25.7500 | +½" −½" |
| FOOT LENGTH | 9.75 | 9.75 | 9.75 | +5/16" −5/16" |
| RELATED FOOT SIZE-MINIMUM | 6½ | 6½ | 6½ | MINIMUM |
| RELATED FOOT SIZE-MIDDLE | 7 | 7 | 7 | MIDDLE |
| RELATED FOOT SIZE-MAXIMUM | 7½ | 7½ | 7½ | MAXIMUM |
| HAND LENGTH | 6.46875 | 6.46875 | 6.46875 | +¼" −¼" |
| HEAD AND NECK LENGTH | 8.250 | 8.250 | 8.250 | +⅜" −⅜" |
| HEAD CIRCUMFERENCE | 26.50000 | 27.00000 | 27.00000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 2 of 17

| A | B | C | D | E | F | G | H | I |
|---|---|---|---|---|---|---|---|---|
| HEIGHT IN INCHES 64.5" to 65" | | | | | | | | |
| HEIGHT IN FEET AND INCHES 5' 4.5" to 5' 5" | | | | | | | | |
| CHEST SIZES | 34 | 35 | 36 | 37 | 38 | 39 | 40 | 41 |
| WEIGHT-MINIMUM | 109 | 117 | 125 | 133 | 141 | 149 | 157 | 165 |
| WEIGHT-MAXIMUM | 116 | 124 | 132 | 140 | 148 | 156 | 164 | 172 |
| SHIRT SLEEVE LENGTH | 30.921875 | 31.078125 | 31.234375 | 31.390625 | 31.546875 | 31.703125 | 31.859375 | 32.015625 |
| PANT OUTSEAM LENGTH | 38.125 | 38.125 | 38.125 | 38.125 | 38.125 | 38.125 | 38.125 | 38.125 |
| PANT INSEAM LENGTH | 30.3750 | 30.1875 | 30.0000 | 29.8125 | 29.6250 | 29.4375 | 29.2500 | 29.1250 |
| FOOT LENGTH | 10 | 10 | 10 | 10 | 10 | 10 | 10 | 10 |
| RELATED FOOT SIZE-MINIMUM | 7 | 7 | 7 | 7 | 7 | 7 | 7 | 7 |
| RELATED FOOT SIZE-MIDDLE | 7½ | 7½ | 7½ | 7½ | 7½ | 7½ | 7½ | 7½ |
| RELATED FOOT SIZE-MAXIMUM | 8 | 8 | 8 | 8 | 8 | 8 | 8 | 8 |
| HAND LENGTH | 6.640625 | 6.640625 | 6.640625 | 6.640625 | 6.640625 | 6.640625 | 6.640625 | 6.640625 |
| HEAD AND NECK LENGTH | 8.500 | 8.500 | 8.500 | 8.500 | 8.500 | 8.500 | 8.500 | 8.500 |
| HEAD CIRCUMFERENCE | 21.5000 | 21.6875 | 21.8750 | 22.0625 | 22.2500 | 22.4375 | 22.6250 | 22.8125 |

TABLE 2 of 17-continued

| | | | | | | | | |
|---|---|---|---|---|---|---|---|---|
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 64.5" to 65" | | | | | | | | |
| HEIGHT IN FEET AND INCHES 5' 4.5" to 5' 5" | | | | | | | | |
| CHEST SIZES | 42 | 43 | 44 | 45 | 46 | 47 | 48 | 49 |
| WEIGHT-MINIMUM | 173 | 181 | 189 | 197 | 205 | 213 | 221 | 229 |
| WEIGHT-MAXIMUM | 180 | 188 | 196 | 204 | 212 | 220 | 228 | 238 |
| SHIRT SLEEVE LENGTH | 32.171875 | 32.328125 | 32.484375 | 32.640625 | 32.796875 | 32.953125 | 33.109375 | 33.265625 |
| PANT OUTSEAM LENGTH | 38.125 | 38.125 | 38.125 | 38.125 | 38.125 | 38.125 | 38.125 | 38.125 |
| PANT INSEAM LENGTH | 29.0000 | 28.8750 | 28.7500 | 28.6250 | 28.5000 | 28.3750 | 28.2500 | 28.0625 |
| FOOT LENGTH | 10 | 10 | 10 | 10 | 10 | 10 | 10 | 10 |
| RELATED FOOT SIZE-MINIMUM | 7 | 7 | 7 | 7 | 7 | 7 | 7 | 7 |
| RELATED FOOT SIZE-MIDDLE | 7½ | 7½ | 7½ | 7½ | 7½ | 7½ | 7½ | 7½ |
| RELATED FOOT SIZE-MAXIMUM | 8 | 8 | 8 | 8 | 8 | 8 | 8 | 8 |
| HAND LENGTH | 6.640625 | 6.640625 | 6.640625 | 6.640625 | 6.640625 | 6.640625 | 6.640625 | 6.640625 |
| HEAD AND NECK LENGTH | 8.500 | 8.500 | 8.500 | 8.500 | 8.500 | 8.500 | 8.500 | 8.500 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 64.5" to 65" | | | | | | | | |
| HEIGHT IN FEET AND INCHES 5' 4.5" to 5' 5" | | | | | | | | |
| CHEST SIZES | 50 | 51 | 52 | 53 | 54 | 55 | 56 | 57 |
| WEIGHT-MINIMUM | 239 | 249 | 259 | 269 | 281 | 294 | 306 | 316 |
| WEIGHT-MAXIMUM | 248 | 258 | 268 | 280 | 293 | 305 | 315 | 330 |
| SHIRT SLEEVE LENGTH | 33.421875 | 33.578125 | 33.734375 | 33.890625 | 34.046875 | 34.203125 | 34.359375 | 34.515625 |
| PANT OUTSEAM LENGTH | 38.125 | 38.125 | 38.125 | 38.125 | 38.125 | 38.125 | 38.125 | 38.125 |
| PANT INSEAM LENGTH | 27.8750 | 27.6875 | 27.5000 | 27.3125 | 27.1250 | 26.9375 | 26.7500 | 26.5625 |
| FOOT LENGTH | 10 | 10 | 10 | 10 | 10 | 10 | 10 | 10 |
| RELATED FOOT SIZE-MINIMUM | 7 | 7 | 7 | 7 | 7 | 7 | 7 | 7 |
| RELATED FOOT SIZE-MIDDLE | 7½ | 7½ | 7½ | 7½ | 7½ | 7½ | 7½ | 7½ |
| RELATED FOOT SIZE-MAXIMUM | 8 | 8 | 8 | 8 | 8 | 8 | 8 | 8 |
| HAND LENGTH | 6.640625 | 6.640625 | 6.640625 | 6.640625 | 6.640625 | 6.640625 | 6.640625 | 6.640625 |
| HEAD AND NECK LENGTH | 8.500 | 8.500 | 8.500 | 8.500 | 8.500 | 8.500 | 8.500 | 8.500 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |

TABLE 2 of 17-continued

| | | | | | | | | |
|---|---|---|---|---|---|---|---|---|
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 64.5" to 65" | | | | |
| HEIGHT IN FEET AND INCHES 5' 4.5" to 5' 5" | | | | |
| CHEST SIZES | 58 | 59 | 60 | TOLERENCE + OR − |
| WEIGHT-MINIMUM | 331 | 346 | 361 | |
| WEIGHT-MAXIMUM | 345 | 360 | 375 | +3 LBS −3 LBS |
| SHIRT SLEEVE LENGTH | 34.671875 | 34.828125 | 34.984375 | +½" −½" |
| PANT OUTSEAM LENGTH | 38.125 | 38.125 | 38.125 | +½" −½" |
| PANT INSEAM LENGTH | 26.3750 | 26.1875 | 260000 | +½" −½" |
| FOOT LENGTH | 10 | 10 | 10 | +5/16" −5/16" |
| RELATED FOOT SIZE-MINIMUM | 7 | 7 | 7 | MINIMUM |
| RELATED FOOT SIZE-MIDDLE | 7½ | 7½ | 7½ | MIDDLE |
| RELATED FOOT SIZE-MAXIMUM | 8 | 8 | 8 | MAXIMUM |
| HAND LENGTH | 6.640625 | 6.640625 | 6.640625 | +¼" −¼" |
| HEAD AND NECK LENGTH | 8.500 | 8.500 | 8.500 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 3 of 17

| A | B | C | D | E | F | G | H | I |
|---|---|---|---|---|---|---|---|---|
| HEIGHT IN INCHES 65.5" to 66" | | | | | | | | |
| HEIGHT IN FEET AND INCHES 5' 5.5" to 5' 6" | | | | | | | | |
| CHEST SIZES | 34 | 35 | 36 | 37 | 38 | 39 | 40 | 41 |
| WEIGHT-MINIMUM | 111 | 119 | 127 | 135 | 143 | 151 | 159 | 167 |
| WEIGHT-MAXIMUM | 118 | 126 | 134 | 142 | 150 | 158 | 166 | 174 |
| SHIRT SLEEVE LENGTH | 31.25000 | 31.40625 | 31.56250 | 31.71875 | 31.87500 | 32.03125 | 32.18750 | 32.34375 |
| PANT OUTSEAM LENGTH | 38.750 | 38.750 | 38.750 | 38.750 | 38.750 | 38.750 | 38.750 | 38.750 |
| PANT INSEAM LENGTH | 30.6250 | 30.4375 | 30.2500 | 30.0625 | 29.8750 | 29.6875 | 29.5000 | 29.3750 |
| FOOT LENGTH | 10.125 | 10.125 | 10.125 | 10.125 | 10.125 | 10.125 | 10.125 | 10.125 |
| RELATED FOOT SIZE-MINIMUM | 7½ | 7½ | 7½ | 7½ | 7½ | 7½ | 7½ | 7½ |
| RELATED FOOT SIZE-MIDDLE | 8 | 8 | 8 | 8 | 8 | 8 | 8 | 8 |
| RELATED FOOT SIZE-MAXIMUM | 8½ | 8½ | 8½ | 8½ | 8½ | 8½ | 8½ | 8½ |
| HAND LENGTH | 6.8125 | 6.8125 | 6.8125 | 6.8125 | 6.8125 | 6.8125 | 6.8125 | 6.8125 |
| HEAD AND NECK LENGTH | 8.750 | 8.750 | 8.750 | 8.750 | 8.750 | 8.750 | 8.750 | 8.750 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

TABLE 3 of 17-continued

| | J | K | L | M | N | O | P | Q |
|---|---|---|---|---|---|---|---|---|
| HEIGHT IN INCHES 65.5" to 66" | | | | | | | | |
| HEIGHT IN FEET AND INCHES 5' 5.5" to 5' 6" | | | | | | | | |
| CHEST SIZES | 42 | 43 | 44 | 45 | 46 | 47 | 48 | 49 |
| WEIGHT-MINIMUM | 175 | 183 | 191 | 199 | 207 | 215 | 223 | 231 |
| WEIGHT-MAXIMUM | 182 | 190 | 198 | 206 | 214 | 222 | 230 | 240 |
| SHIRT SLEEVE LENGTH | 32.50000 | 32.65625 | 32.81250 | 32.96875 | 33.12500 | 33.28125 | 33.43750 | 33.59375 |
| PANT OUTSEAM LENGTH | 38.750 | 38.750 | 38.750 | 38.750 | 38.750 | 38.750 | 38.750 | 38.750 |
| PANT INSEAM LENGTH | 29.2500 | 29.1250 | 29.0000 | 28.8750 | 28.7500 | 28.6250 | 28.5000 | 28.3125 |
| FOOT LENGTH | 10.125 | 10.125 | 10.125 | 10.125 | 10.125 | 10.125 | 10.125 | 10.125 |
| RELATED FOOT SIZE-MINIMUM | 7½ | 7½ | 7½ | 7½ | 7½ | 7½ | 7½ | 7½ |
| RELATED FOOT SIZE-MIDDLE | 8 | 8 | 8 | 8 | 8 | 8 | 8 | 8 |
| RELATED FOOT SIZE-MAXIMUM | 8½ | 8½ | 8½ | 8½ | 8½ | 8½ | 8½ | 8½ |
| HAND LENGTH | 6.8125 | 6.8125 | 6.8125 | 6.8125 | 6.8125 | 6.8125 | 6.8125 | 6.8125 |
| HEAD AND NECK LENGTH | 8.750 | 8.750 | 8.750 | 8.750 | 8.750 | 8.750 | 8.750 | 8.750 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 65.5" to 66" | | | | | | | | |
| HEIGHT IN FEET AND INCHES 5' 5.5" to 5' 6" | | | | | | | | |
| CHEST SIZES | 50 | 51 | 52 | 53 | 54 | 55 | 56 | 57 |
| WEIGHT-MINIMUM | 241 | 251 | 261 | 271 | 283 | 296 | 308 | 318 |
| WEIGHT-MAXIMUM | 250 | 260 | 270 | 282 | 295 | 307 | 317 | 332 |
| SHIRT SLEEVE LENGTH | 33.75000 | 33.90625 | 34.06250 | 34.21875 | 34.37500 | 34.53125 | 34.68750 | 34.84375 |
| PANT OUTSEAM LENGTH | 38.750 | 38.750 | 38.750 | 38.750 | 38.750 | 38.750 | 38.750 | 38.750 |
| PANT INSEAM LENGTH | 28.1250 | 27.9375 | 27.7500 | 27.5625 | 27.3750 | 27.1875 | 27.0000 | 26.8125 |
| FOOT LENGTH | 10.125 | 10.125 | 10.125 | 10.125 | 10.125 | 10.125 | 10.125 | 10.125 |
| RELATED FOOT SIZE-MINIMUM | 7½ | 7½ | 7½ | 7½ | 7½ | 7½ | 7½ | 7½ |
| RELATED FOOT SIZE-MIDDLE | 8 | 8 | 8 | 8 | 8 | 8 | 8 | 8 |
| RELATED FOOT SIZE-MAXIMUM | 8½ | 8½ | 8½ | 8½ | 8½ | 8½ | 8½ | 8½ |
| HAND LENGTH | 6.8125 | 6.8125 | 6.8125 | 6.8125 | 6.8125 | 6.8125 | 6.8125 | 6.8125 |
| HEAD AND NECK LENGTH | 8.750 | 8.750 | 8.750 | 8.750 | 8.750 | 8.750 | 8.750 | 8.750 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 65.5" to 66" | | | | |
| HEIGHT IN FEET AND INCHES 5' 5.5" to 5' 6" | | | | |
| CHEST SIZES | 58 | 59 | 60 | TOLERENCE + OR − |
| WEIGHT-MINIMUM | 333 | 348 | 363 | |
| WEIGHT-MAXIMUM | 347 | 362 | 377 | +3 LBS −3 LBS |
| SHIRT SLEEVE LENGTH | 35.00000 | 35.15625 | 35.31250 | +½" −½" |
| PANT OUTSEAM LENGTH | 38.750 | 38.750 | 38.750 | +½" −½" |
| PANT INSEAM LENGTH | 26.6250 | 26.4375 | 26.2500 | +½" −½" |
| FOOT LENGTH | 10.125 | 10.125 | 10.125 | +5/16" −5/16" |
| RELATED FOOT SIZE-MINIMUM | 7½ | 7½ | 7½ | MINIMUM |
| RELATED FOOT SIZE-MIDDLE | 8 | 8 | 8 | MIDDLE |

TABLE 3 of 17-continued

| | | | | |
|---|---|---|---|---|
| RELATED FOOT SIZE-MAXIMUM | 8½ | 8½ | 8½ | MAXIMUM |
| HAND LENGTH | 6.8125 | 6.8125 | 6.8125 | +¼" −¼" |
| HEAD AND NECK LENGTH | 8.750 | 8.750 | 8.750 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 4 of 17

| A | B | C | D | E | F | G | H | I |
|---|---|---|---|---|---|---|---|---|
| HEIGHT IN INCHES 66.5" to 67" | | | | | | | | |
| HEIGHT IN FEET AND INCHES 5' 6.5" to 5' 7" | | | | | | | | |
| CHEST SIZES | 34 | 35 | 36 | 37 | 38 | 39 | 40 | 41 |
| WEIGHT-MINIMUM | 113 | 121 | 129 | 137 | 145 | 153 | 161 | 169 |
| WEIGHT-MAXIMUM | 120 | 128 | 136 | 144 | 152 | 160 | 168 | 176 |
| SHIRT SLEEVE LENGTH | 31.578125 | 31.734375 | 31.890625 | 32.046875 | 32.203125 | 32.359375 | 32.515625 | 32.671875 |
| PANT OUTSEAM LENGTH | 39.375 | 39.375 | 39.375 | 39.375 | 39.375 | 39.375 | 39.375 | 39.375 |
| PANT INSEAM LENGTH | 30.8750 | 30.6875 | 30.5000 | 30.3125 | 30.1250 | 29.9375 | 29.7500 | 29.6250 |
| FOOT LENGTH | 10.25 | 10.25 | 10.25 | 10.25 | 10.25 | 10.25 | 10.25 | 10.25 |
| RELATED FOOT SIZE-MINIMUM | 8 | 8 | 8 | 8 | 8 | 8 | 8 | 8 |
| RELATED FOOT SIZE-MIDDLE | 8½ | 8½ | 8½ | 8½ | 8½ | 8½ | 8½ | 8½ |
| RELATED FOOT SIZE-MAXIMUM | 9 | 9 | 9 | 9 | 9 | 9 | 9 | 9 |
| HAND LENGTH | 6.984375 | 6.984375 | 6.984375 | 6.984375 | 6.984375 | 6.984375 | 6.984375 | 6.984375 |
| HEAD AND NECK LENGTH | 9.000 | 9.000 | 9.000 | 9.000 | 9.000 | 9.000 | 9.000 | 9.000 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 66.5" to 67" | | | | | | | | |
| HEIGHT IN FEET AND INCHES 5' 6.5" to 5' 7" | | | | | | | | |
| CHEST SIZES | 42 | 43 | 44 | 45 | 46 | 47 | 48 | 49 |
| WEIGHT-MINIMUM | 177 | 185 | 193 | 201 | 209 | 217 | 225 | 233 |
| WEIGHT-MAXIMUM | 184 | 192 | 200 | 208 | 216 | 224 | 232 | 242 |
| SHIRT SLEEVE LENGTH | 32.828125 | 32.984375 | 33.140625 | 33.296875 | 33.453125 | 33.609375 | 33.765625 | 33.921875 |
| PANT OUTSEAM LENGTH | 39.375 | 39.375 | 39.375 | 39.375 | 39.375 | 39.375 | 39.375 | 39.375 |
| PANT INSEAM LENGTH | 29.5000 | 29.3750 | 29.2500 | 29.1250 | 29.0000 | 28.8750 | 28.7500 | 28.5625 |
| FOOT LENGTH | 10.25 | 10.25 | 10.25 | 10.25 | 10.25 | 10.25 | 10.25 | 10.25 |
| RELATED FOOT SIZE-MINIMUM | 8 | 8 | 8 | 8 | 8 | 8 | 8 | 8 |
| RELATED FOOT SIZE-MIDDLE | 8½ | 8½ | 8½ | 8½ | 8½ | 8½ | 8½ | 8½ |
| RELATED FOOT SIZE-MAXIMUM | 9 | 9 | 9 | 9 | 9 | 9 | 9 | 9 |
| HAND LENGTH | 6.984375 | 6.984375 | 6.984375 | 6.984375 | 6.984375 | 6.984375 | 6.984375 | 6.984375 |
| HEAD AND NECK LENGTH | 9.000 | 9.000 | 9.000 | 9.000 | 9.000 | 9.000 | 9.000 | 9.000 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |

TABLE 4 of 17-continued

| | | | | | | | | |
|---|---|---|---|---|---|---|---|---|
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 66.5" to 67" | | | | | | | | |
| HEIGHT IN FEET AND INCHES 5' 6.5" to 5' 7" | | | | | | | | |
| CHEST SIZES | 50 | 51 | 52 | 53 | 54 | 55 | 56 | 57 |
| WEIGHT-MINIMUM | 243 | 253 | 263 | 273 | 285 | 298 | 310 | 320 |
| WEIGHT-MAXIMUM | 252 | 262 | 272 | 284 | 297 | 309 | 319 | 334 |
| SHIRT SLEEVE LENGTH | 34.078125 | 34.234375 | 34.390625 | 34.546875 | 34.703125 | 34.859375 | 35.015625 | 35.171875 |
| PANT OUTSEAM LENGTH | 39.375 | 39.375 | 39.375 | 39.375 | 39.375 | 39.375 | 39.375 | 39.375 |
| PANT INSEAM LENGTH | 28.3750 | 28.1875 | 28.0000 | 27.8125 | 27.6250 | 27.4375 | 27.2500 | 27.0625 |
| FOOT LENGTH | 10.25 | 10.25 | 10.25 | 10.25 | 10.25 | 10.25 | 10.25 | 10.25 |
| RELATED FOOT SIZE-MINIMUM | 8 | 8 | 8 | 8 | 8 | 8 | 8 | 8 |
| RELATED FOOT SIZE-MIDDLE | 8½ | 8½ | 8½ | 8½ | 8½ | 8½ | 8½ | 8½ |
| RELATED FOOT SIZE-MAXIMUM | 9 | 9 | 9 | 9 | 9 | 9 | 9 | 9 |
| HAND LENGTH | 6.984375 | 6.984375 | 6.984375 | 6.984375 | 6.984375 | 6.984375 | 6.984375 | 6.984375 |
| HEAD AND NECK LENGTH | 9.000 | 9.000 | 9.000 | 9.000 | 9.000 | 9.000 | 9.000 | 9.000 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 66.5" to 67" | | | | |
| HEIGHT IN FEET AND INCHES 5' 6.5" to 5' 7" | | | | |
| CHEST SIZES | 58 | 59 | 60 | TOLERENCE + OR − |
| WEIGHT-MINIMUM | 335 | 350 | 365 | |
| WEIGHT-MAXIMUM | 349 | 364 | 379 | +3 LBS −3 LBS |
| SHIRT SLEEVE LENGTH | 35.328125 | 35.484375 | 35.640625 | +½" −½" |
| PANT OUTSEAM LENGTH | 39.375 | 39.375 | 39.375 | +½" −½" |
| PANT INSEAM LENGTH | 26.8750 | 26.6875 | 26.5000 | +½" −½" |
| FOOT LENGTH | 10.25 | 10.25 | 10.25 | +5/16" −5/16" |
| RELATED FOOT SIZE-MINIMUM | 8 | 8 | 8 | MINIMUM |
| RELATED FOOT SIZE-MIDDLE | 8½ | 8½ | 8½ | MIDDLE |
| RELATED FOOT SIZE-MAXIMUM | 9 | 9 | 9 | MAXIMUM |
| HAND LENGTH | 6.984375 | 6.984375 | 6.984375 | +¼" −¼" |
| HEAD AND NECK LENGTH | 9.000 | 9.000 | 9.000 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 5 of 17

| A | B | C | D | E | F | G | H | I |
|---|---|---|---|---|---|---|---|---|
| HEIGHT IN INCHES 67.5" to 68" | | | | | | | | |
| HEIGHT IN FEET AND INCHES 5' 7.5" to 5' 8" | | | | | | | | |
| CHEST SIZES | 34 | 35 | 36 | 37 | 38 | 39 | 40 | 41 |
| WEIGHT-MINIMUM | 115 | 123 | 131 | 139 | 147 | 155 | 163 | 171 |
| WEIGHT-MAXIMUM | 122 | 130 | 138 | 146 | 154 | 162 | 170 | 178 |
| SHIRT SLEEVE LENGTH | 31.90625 | 32.06250 | 32.21875 | 32.37500 | 32.53125 | 32.68750 | 32.84375 | 33.00000 |
| PANT OUTSEAM LENGTH | 40.000 | 40.000 | 40.000 | 40.000 | 40.000 | 40.000 | 40.000 | 40.000 |
| PANT INSEAM LENGTH | 31.1250 | 30.9375 | 30.7500 | 30.5625 | 30.3750 | 30.1875 | 30.000 | 29.8750 |
| FOOT LENGTH | 10.5 | 10.5 | 10.5 | 10.5 | 10.5 | 10.5 | 10.5 | 10.5 |
| RELATED FOOT SIZE-MINIMUM | 8½ | 8½ | 8½ | 8½ | 8½ | 8½ | 8½ | 8½ |
| RELATED FOOT SIZE-MIDDLE | 9 | 9 | 9 | 9 | 9 | 9 | 9 | 9 |
| RELATED FOOT SIZE-MAXIMUM | 9½ | 9½ | 9½ | 9½ | 9½ | 9½ | 9½ | 9½ |
| HAND LENGTH | 7.15625 | 7.15625 | 7.15625 | 7.15625 | 7.15625 | 7.15625 | 7.15625 | 7.15625 |
| HEAD AND NECK LENGTH | 9.250 | 9.250 | 9.250 | 9.250 | 9.250 | 9.250 | 9.250 | 9.250 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 67.5" to 68" | | | | | | | | |
| HEIGHT IN FEET AND INCHES 5' 7.5" to 5' 8" | | | | | | | | |
| CHEST SIZES | 42 | 43 | 44 | 45 | 46 | 47 | 48 | 49 |
| WEIGHT-MINIMUM | 179 | 187 | 195 | 203 | 211 | 219 | 227 | 235 |
| WEIGHT-MAXIMUM | 186 | 194 | 202 | 210 | 218 | 226 | 234 | 244 |
| SHIRT SLEEVE LENGTH | 33.15625 | 33.31250 | 33.46875 | 33.62500 | 33.78125 | 33.93750 | 34.09375 | 34.25000 |
| PANT OUTSEAM LENGTH | 40.000 | 40.000 | 40.000 | 40.000 | 40.000 | 40.000 | 40.000 | 40.000 |
| PANT INSEAM LENGTH | 29.7500 | 29.6250 | 29.5000 | 29.3750 | 29.2500 | 29.1250 | 29.0000 | 28.8125 |
| FOOT LENGTH | 10.5 | 10.5 | 10.5 | 10.5 | 10.5 | 10.5 | 10.5 | 10.5 |
| RELATED FOOT SIZE-MINIMUM | 8½ | 8½ | 8½ | 8½ | 8½ | 8½ | 8½ | 8½ |
| RELATED FOOT SIZE-MIDDLE | 9 | 9 | 9 | 9 | 9 | 9 | 9 | 9 |
| RELATED FOOT SIZE-MAXIMUM | 9½ | 9½ | 9½ | 9½ | 9½ | 9½ | 9½ | 9½ |
| HAND LENGTH | 7.15625 | 7.15625 | 7.15625 | 7.15625 | 7.15625 | 7.15625 | 7.15625 | 7.15625 |
| HEAD AND NECK LENGTH | 9.250 | 9.250 | 9.250 | 9.250 | 9.250 | 9.250 | 9.250 | 9.250 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 67.5" to 68" | | | | | | | | |
| HEIGHT IN FEET AND INCHES 5' 7.5" to 5' 8" | | | | | | | | |
| CHEST SIZES | 50 | 51 | 52 | 53 | 54 | 55 | 56 | 57 |
| WEIGHT-MINIMUM | 245 | 255 | 265 | 275 | 287 | 300 | 312 | 322 |
| WEIGHT-MAXIMUM | 254 | 264 | 274 | 286 | 299 | 311 | 321 | 336 |
| SHIRT SLEEVE LENGTH | 34.40625 | 34.56250 | 34.71875 | 34.87500 | 35.03125 | 35.18750 | 35.34375 | 35.50000 |
| PANT OUTSEAM LENGTH | 40.000 | 40.000 | 40.000 | 40.000 | 40.000 | 40.000 | 40.000 | 40.000 |
| PANT INSEAM LENGTH | 28.6250 | 28.4375 | 28.2500 | 28.0625 | 27.8750 | 27.6875 | 27.5000 | 27.3125 |
| FOOT LENGTH | 10.5 | 10.5 | 10.5 | 10.5 | 10.5 | 10.5 | 10.5 | 10.5 |
| RELATED FOOT SIZE-MINIMUM | 8½ | 8½ | 8½ | 8½ | 8½ | 8½ | 8½ | 8½ |

TABLE 5 of 17-continued

| | | | | | | | | |
|---|---|---|---|---|---|---|---|---|
| RELATED FOOT SIZE-MIDDLE | 9 | 9 | 9 | 9 | 9 | 9 | 9 | 9 |
| RELATED FOOT SIZE-MAXIMUM | 9½ | 9½ | 9½ | 9½ | 9½ | 9½ | 9½ | 9½ |
| HAND LENGTH | 7.15625 | 7.15625 | 7.15625 | 7.15625 | 7.15625 | 7.15625 | 7.15625 | 7.15625 |
| HEAD AND NECK LENGTH | 9.250 | 9.250 | 9.250 | 9.250 | 9.250 | 9.250 | 9.250 | 9.250 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 67.5" to 68" | | | | |
| HEIGHT IN FEET AND INCHES 5' 7.5" to 5' 8" | | | | |
| CHEST SIZES | 58 | 59 | 60 | TOLERENCE + OR − |
| WEIGHT-MINIMUM | 337 | 352 | 367 | |
| WEIGHT-MAXIMUM | 351 | 366 | 381 | +3 LBS −3 LBS |
| SHIRT SLEEVE LENGTH | 35.65625 | 35.81250 | 35.96875 | +½" −½" |
| PANT OUTSEAM LENGTH | 40.000 | 40.000 | 40.000 | +½" −½" |
| PANT INSEAM LENGTH | 27.1250 | 26.9375 | 26.7500 | +½" −½" |
| FOOT LENGTH | 10.5 | 10.5 | 10.5 | +5/16" −5/16" |
| RELATED FOOT SIZE-MINIMUM | 8½ | 8½ | 8½ | MINIMUM |
| RELATED FOOT SIZE-MIDDLE | 9 | 9 | 9 | MIDDLE |
| RELATED FOOT SIZE-MAXIMUM | 9½ | 9½ | 9½ | MAXIMUM |
| HAND LENGTH | 7.15625 | 7.15625 | 7.15625 | +¼" −¼" |
| HEAD AND NECK LENGTH | 9.250 | 9.250 | 9.250 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 6 of 17

| A | B | C | D | E | F | G | H | I |
|---|---|---|---|---|---|---|---|---|
| HEIGHT IN INCHES 68.5" to 69" | | | | | | | | |
| HEIGHT IN FEET AND INCHES 5' 8.5" to 5' 9" | | | | | | | | |
| CHEST SIZES | 34 | 35 | 36 | 37 | 38 | 39 | 40 | 41 |
| WEIGHT-MINIMUM | 117 | 125 | 133 | 141 | 149 | 157 | 165 | 173 |
| WEIGHT-MAXIMUM | 124 | 132 | 140 | 148 | 156 | 164 | 172 | 180 |
| SHIRT SLEEVE LENGTH | 32.234375 | 32.390625 | 32.546875 | 32.703125 | 32.859375 | 33.015625 | 33.171875 | 33.328125 |
| PANT OUTSEAM LENGTH | 40.625 | 40.625 | 40.625 | 40.625 | 40.625 | 40.625 | 40.625 | 40.625 |
| PANT INSEAM LENGTH | 31.3750 | 31.1875 | 31.0000 | 30.8125 | 30.6250 | 30.4375 | 30.2500 | 30.1250 |
| FOOT LENGTH | 10.625 | 10.625 | 10.625 | 10.625 | 10.625 | 10.625 | 10.625 | 10.625 |
| RELATED FOOT SIZE-MINIMUM | 9 | 9 | 9 | 9 | 9 | 9 | 9 | 9 |
| RELATED FOOT SIZE-MIDDLE | 9½ | 9½ | 9½ | 9½ | 9½ | 9½ | 9½ | 9½ |
| RELATED FOOT SIZE-MAXIMUM | 10 | 10 | 10 | 10 | 10 | 10 | 10 | 10 |
| HAND LENGTH | 7.328125 | 7.328125 | 7.328125 | 7.328125 | 7.328125 | 7.328125 | 7.328125 | 7.328125 |
| HEAD AND NECK LENGTH | 9.500 | 9.500 | 9.500 | 9.500 | 9.500 | 9.500 | 9.500 | 9.500 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |

TABLE 6 of 17-continued

| | | | | | | | | |
|---|---|---|---|---|---|---|---|---|
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 68.5" to 69" | | | | | | | | |
| HEIGHT IN FEET AND INCHES 5' 8.5" to 5' 9" | | | | | | | | |
| CHEST SIZES | 42 | 43 | 44 | 45 | 46 | 47 | 48 | 49 |
| WEIGHT-MINIMUM | 181 | 189 | 197 | 205 | 213 | 221 | 229 | 237 |
| WEIGHT-MAXIMUM | 188 | 196 | 204 | 212 | 220 | 228 | 236 | 246 |
| SHIRT SLEEVE LENGTH | 33.484375 | 33.640625 | 33.796875 | 33.953125 | 34.109375 | 34.265625 | 34.421875 | 34.578125 |
| PANT OUTSEAM LENGTH | 40.625 | 40.625 | 40.625 | 40.625 | 40.625 | 40.625 | 40.625 | 40.625 |
| PANT INSEAM LENGTH | 30.0000 | 29.8750 | 29.7500 | 29.6250 | 29.5000 | 29.3750 | 29.2500 | 29.0625 |
| FOOT LENGTH | 10.625 | 10.625 | 10.625 | 10.625 | 10.625 | 10.625 | 10.625 | 10.625 |
| RELATED FOOT SIZE-MINIMUM | 9 | 9 | 9 | 9 | 9 | 9 | 9 | 9 |
| RELATED FOOT SIZE-MIDDLE | 9½ | 9½ | 9½ | 9½ | 9½ | 9½ | 9½ | 9½ |
| RELATED FOOT SIZE-MAXIMUM | 10 | 10 | 10 | 10 | 10 | 10 | 10 | 10 |
| HAND LENGTH | 7.328125 | 7.328125 | 7.328125 | 7.328125 | 7.328125 | 7.328125 | 7.328125 | 7.328125 |
| HEAD AND NECK LENGTH | 9.500 | 9.500 | 9.500 | 9.500 | 9.500 | 9.500 | 9.500 | 9.500 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 68.5" to 69" | | | | | | | | |
| HEIGHT IN FEET AND INCHES 5' 8.5" to 5' 9" | | | | | | | | |
| CHEST SIZES | 50 | 51 | 52 | 53 | 54 | 55 | 56 | 57 |
| WEIGHT-MINIMUM | 247 | 257 | 267 | 277 | 289 | 302 | 314 | 324 |
| WEIGHT-MAXIMUM | 256 | 266 | 276 | 288 | 301 | 313 | 323 | 338 |
| SHIRT SLEEVE LENGTH | 34.734375 | 34.890625 | 35.046875 | 35.203125 | 35.359375 | 35.515625 | 35.671875 | 35.828125 |
| PANT OUTSEAM LENGTH | 40.625 | 40.625 | 40.625 | 40.625 | 40.625 | 40.625 | 40.625 | 40.625 |
| PANT INSEAM LENGTH | 28.8750 | 28.6875 | 28.5000 | 28.3125 | 28.1250 | 27.9375 | 27.7500 | 27.5625 |
| FOOT LENGTH | 10.625 | 10.625 | 10.625 | 10.625 | 10.625 | 10.625 | 10.625 | 10.625 |
| RELATED FOOT SIZE-MINIMUM | 9 | 9 | 9 | 9 | 9 | 9 | 9 | 9 |
| RELATED FOOT SIZE-MIDDLE | 9½ | 9½ | 9½ | 9½ | 9½ | 9½ | 9½ | 9½ |
| RELATED FOOT SIZE-MAXIMUM | 10 | 10 | 10 | 10 | 10 | 10 | 10 | 10 |
| HAND LENGTH | 7.328125 | 7.328125 | 7.328125 | 7.328125 | 7.328125 | 7.328125 | 7.328125 | 7.328125 |
| HEAD AND NECK LENGTH | 9.500 | 9.500 | 9.500 | 9.500 | 9.500 | 9.500 | 9.500 | 9.500 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

TABLE 6 of 17-continued

| | Z | AA | AB | AC |
|---|---|---|---|---|
| HEIGHT IN INCHES 68.5" to 69" | | | | |
| HEIGHT IN FEET AND INCHES 5' 8.5" to 5' 9" | | | | |
| CHEST SIZES | 58 | 59 | 60 | TOLERENCE + OR − |
| WEIGHT-MINIMUM | 339 | 354 | 369 | |
| WEIGHT-MAXIMUM | 353 | 368 | 383 | +3 LBS −3 LBS |
| SHIRT SLEEVE LENGTH | 35.984375 | 36.140625 | 36.296875 | +½" −½" |
| PANT OUTSEAM LENGTH | 40.625 | 40.625 | 40.625 | +½" −½" |
| PANT INSEAM LENGTH | 27.3750 | 27.1875 | 27.0000 | +½" −½" |
| FOOT LENGTH | 10.625 | 10.625 | 10.625 | +5/16" −5/16" |
| RELATED FOOT SIZE-MINIMUM | 9 | 9 | 9 | MINIMUM |
| RELATED FOOT SIZE-MIDDLE | 9½ | 9½ | 9½ | MIDDLE |
| RELATED FOOT SIZE-MAXIMUM | 10 | 10 | 10 | MAXIMUM |
| HAND LENGTH | 7.328125 | 7.328125 | 7.328125 | +¼" −¼" |
| HEAD AND NECK LENGTH | 9.500 | 9.500 | 9.500 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 7 of 17

| A | B | C | D | E | F | G | H | I |
|---|---|---|---|---|---|---|---|---|
| HEIGHT IN INCHES 69.5" to 70" | | | | | | | | |
| HEIGHT IN FEET AND INCHES 5' 9.5" to 5' 10" | | | | | | | | |
| CHEST SIZES | 34 | 35 | 36 | 37 | 38 | 39 | 40 | 41 |
| WEIGHT-MINIMUM | 119 | 127 | 135 | 143 | 151 | 159 | 167 | 175 |
| WEIGHT-MAXIMUM | 126 | 134 | 142 | 150 | 158 | 166 | 174 | 182 |
| SHIRT SLEEVE LENGTH | 32.56250 | 32.71875 | 32.87500 | 33.03125 | 33.18750 | 33.34375 | 33.50000 | 33.65625 |
| PANT OUTSEAM LENGTH | 41.250 | 41.250 | 41.250 | 41.250 | 41.250 | 41.250 | 41.250 | 41.250 |
| PANT INSEAM LENGTH | 31.6250 | 31.4375 | 31.2500 | 31.0625 | 30.8750 | 30.6875 | 30.5000 | 30.3750 |
| FOOT LENGTH | 10.875 | 10.875 | 10.875 | 10.875 | 10.875 | 10.875 | 10.875 | 10.875 |
| RELATED FOOT SIZE-MINIMUM | 9½ | 9½ | 9½ | 9½ | 9½ | 9½ | 9½ | 9½ |
| RELATED FOOT SIZE-MIDDLE | 10 | 10 | 10 | 10 | 10 | 10 | 10 | 10 |
| RELATED FOOT SIZE-MAXIMUM | 10½ | 10½ | 10½ | 10½ | 10½ | 10½ | 10½ | 10½ |
| HAND LENGTH | 7.5 | 7.5 | 7.5 | 7.5 | 7.5 | 7.5 | 7.5 | 7.5 |
| HEAD AND NECK LENGTH | 9.750 | 9.750 | 9.750 | 9.750 | 9.750 | 9.750 | 9.750 | 9.750 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 69.5" to 70" | | | | | | | | |
| HEIGHT IN FEET AND INCHES 5' 9.5" to 5' 10" | | | | | | | | |
| CHEST SIZES | 42 | 43 | 44 | 45 | 46 | 47 | 48 | 49 |
| WEIGHT-MINIMUM | 183 | 191 | 199 | 207 | 215 | 223 | 231 | 239 |
| WEIGHT-MAXIMUM | 190 | 198 | 206 | 214 | 222 | 230 | 238 | 248 |
| SHIRT SLEEVE LENGTH | 33.81250 | 33.96875 | 34.12500 | 34.28125 | 34.43750 | 34.59375 | 34.75000 | 34.90625 |

TABLE 7 of 17-continued

| | | | | | | | | |
|---|---|---|---|---|---|---|---|---|
| PANT OUTSEAM LENGTH | 41.250 | 41.250 | 41.250 | 41.250 | 41.250 | 41.250 | 41.250 | 41.250 |
| PANT INSEAM LENGTH | 30.2500 | 30.1250 | 30.0000 | 29.8750 | 29.7500 | 29.6250 | 29.5000 | 29.3125 |
| FOOT LENGTH | 10.875 | 10.875 | 10.875 | 10.875 | 10.875 | 10.875 | 10.875 | 10.875 |
| RELATED FOOT SIZE-MINIMUM | 9½ | 9½ | 9½ | 9½ | 9½ | 9½ | 9½ | 9½ |
| RELATED FOOT SIZE-MIDDLE | 10 | 10 | 10 | 10 | 10 | 10 | 10 | 10 |
| RELATED FOOT SIZE-MAXIMUM | 10½ | 10½ | 10½ | 10½ | 10½ | 10½ | 10½ | 10½ |
| HAND LENGTH | 7.5 | 7.5 | 7.5 | 7.5 | 7.5 | 7.5 | 7.5 | 7.5 |
| HEAD AND NECK LENGTH | 9.750 | 9.750 | 9.750 | 9.750 | 9.750 | 9.750 | 9.750 | 9.750 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 69.5" to 70" | | | | | | | | |
| HEIGHT IN FEET AND INCHES 5' 9.5" to 5' 10" | | | | | | | | |
| CHEST SIZES | 50 | 51 | 52 | 53 | 54 | 55 | 56 | 57 |
| WEIGHT-MINIMUM | 249 | 259 | 269 | 279 | 291 | 304 | 316 | 326 |
| WEIGHT-MAXIMUM | 258 | 268 | 278 | 290 | 303 | 315 | 325 | 340 |
| SHIRT SLEEVE LENGTH | 35.06250 | 35.21875 | 35.37500 | 35.53125 | 35.68750 | 35.84375 | 36.00000 | 36.15625 |
| PANT OUTSEAM LENGTH | 41.250 | 41.250 | 41.250 | 41.250 | 41.250 | 41.250 | 41.250 | 41.250 |
| PANT INSEAM LENGTH | 29.1250 | 28.9375 | 28.7500 | 28.5625 | 28.3750 | 28.1875 | 28.0000 | 27.8125 |
| FOOT LENGTH | 10.875 | 10.875 | 10.875 | 10.875 | 10.875 | 10.875 | 10.875 | 10.875 |
| RELATED FOOT SIZE-MINIMUM | 9½ | 9½ | 9½ | 9½ | 9½ | 9½ | 9½ | 9½ |
| RELATED FOOT SIZE-MIDDLE | 10 | 10 | 10 | 10 | 10 | 10 | 10 | 10 |
| RELATED FOOT SIZE-MAXIMUM | 10½ | 10½ | 10½ | 10½ | 10½ | 10½ | 10½ | 10½ |
| HAND LENGTH | 7.5 | 7.5 | 7.5 | 7.5 | 7.5 | 7.5 | 7.5 | 7.5 |
| HEAD AND NECK LENGTH | 9.750 | 9.750 | 9.750 | 9.750 | 9.750 | 9.750 | 9.750 | 9.750 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 69.5" to 70" | | | | |
| HEIGHT IN FEET AND INCHES 5' 9.5" to 5' 10" | | | | |
| CHEST SIZES | 58 | 59 | 60 | TOLERENCE + OR − |
| WEIGHT-MINIMUM | 341 | 356 | 371 | +3 LBS |
| WEIGHT-MAXIMUM | 355 | 370 | 385 | +3 LBS −3 LBS |
| SHIRT SLEEVE LENGTH | 36.31250 | 36.46875 | 36.62500 | +½" −½" |
| PANT OUTSEAM LENGTH | 41.250 | 41.250 | 41.250 | +½" −½" |
| PANT INSEAM LENGTH | 27.6250 | 27.4375 | 27.2500 | +½" −½" |
| FOOT LENGTH | 10.875 | 10.875 | 10.875 | +5⁄16" −5⁄16" |
| RELATED FOOT SIZE-MINIMUM | 9½ | 9½ | 9½ | |
| RELATED FOOT SIZE-MIDDLE | 10 | 10 | 10 | |
| RELATED FOOT SIZE-MAXIMUM | 10½ | 10½ | 10½ | |
| HAND LENGTH | 7.5 | 7.5 | 7.5 | +¼" −¼" |
| HEAD AND NECK LENGTH | 9.750 | 9.750 | 9.750 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |

TABLE 7 of 17-continued

| | | | | |
|---|---|---|---|---|
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 8 of 17

| A | B | C | D | E | F | G | H | I |
|---|---|---|---|---|---|---|---|---|
| HEIGHT IN INCHES 70.5" to 71" | | | | | | | | |
| HEIGHT IN FEET 5' 10.5" to 5' 11" | | | | | | | | |
| AND INCHES | | | | | | | | |
| CHEST SIZES | 34 | 35 | 36 | 37 | 38 | 39 | 40 | 41 |
| WEIGHT-MINIMUM | 121 | 129 | 137 | 145 | 153 | 161 | 169 | 177 |
| WEIGHT-MAXIMUM | 128 | 136 | 144 | 152 | 160 | 168 | 176 | 184 |
| SHIRT SLEEVE LENGTH | 32.890625 | 33.046875 | 33.203125 | 33.359375 | 33.515625 | 33.671875 | 33.828125 | 33.984375 |
| PANT OUTSEAM LENGTH | 41.875 | 41.875 | 41.875 | 41.875 | 41.875 | 41.875 | 41.875 | 41.875 |
| PANT INSEAM LENGTH | 31.8750 | 31.6875 | 31.5000 | 31.3125 | 31.1250 | 30.9375 | 30.7500 | 30.6250 |
| FOOT LENGTH | 11.125 | 11.125 | 11.125 | 11.125 | 11.125 | 11.125 | 11.125 | 11.125 |
| RELATED FOOT SIZE-MINIMUM | 10 | 10 | 10 | 10 | 10 | 10 | 10 | 10 |
| RELATED FOOT SIZE-MIDDLE | 10½ | 10½ | 10½ | 10½ | 10½ | 10½ | 10½ | 10½ |
| RELATED FOOT SIZE-MAXIMUM | 11 | 11 | 11 | 11 | 11 | 11 | 11 | 11 |
| HAND LENGTH | 7.671875 | 7.671875 | 7.671875 | 7.671875 | 7.671875 | 7.671875 | 7.671875 | 7.671875 |
| HEAD AND NECK LENGTH | 10.000 | 10.000 | 10.000 | 10.000 | 10.000 | 10.000 | 10.000 | 10.000 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 70.5" to 71" | | | | | | | | |
| HEIGHT IN FEET 5' 10.5" to 5' 11" | | | | | | | | |
| AND INCHES | | | | | | | | |
| CHEST SIZES | 42 | 43 | 44 | 45 | 46 | 47 | 48 | 49 |
| WEIGHT-MINIMUM | 185 | 193 | 201 | 209 | 217 | 225 | 233 | 241 |
| WEIGHT-MAXIMUM | 192 | 200 | 208 | 216 | 224 | 232 | 240 | 250 |
| SHIRT SLEEVE LENGTH | 34.140625 | 34.296875 | 34.453125 | 34.609375 | 34.765625 | 34.921875 | 35.078125 | 35.234375 |
| PANT OUTSEAM LENGTH | 41.875 | 41.875 | 41.875 | 41.875 | 41.875 | 41.875 | 41.875 | 41.875 |
| PANT INSEAM LENGTH | 30.5000 | 30.3750 | 30.2500 | 30.1250 | 30.0000 | 29.8750 | 29.7500 | 29.5625 |
| FOOT LENGTH | 11.125 | 11.125 | 11.125 | 11.125 | 11.125 | 11.125 | 11.125 | 11.125 |
| RELATED FOOT SIZE-MINIMUM | 10 | 10 | 10 | 10 | 10 | 10 | 10 | 10 |
| RELATED FOOT SIZE-MIDDLE | 10½ | 10½ | 10½ | 10½ | 10½ | 10½ | 10½ | 10½ |
| RELATED FOOT SIZE-MAXIMUM | 11 | 11 | 11 | 11 | 11 | 11 | 11 | 11 |
| HAND LENGTH | 7.671875 | 7.671875 | 7.671875 | 7.671875 | 7.671875 | 7.671875 | 7.671875 | 7.671875 |
| HEAD AND NECK LENGTH | 10.000 | 10.000 | 10.000 | 10.000 | 10.000 | 10.000 | 10.000 | 10.000 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |

TABLE 8 of 17-continued

| | | | | | | | | |
|---|---|---|---|---|---|---|---|---|
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 70.5" to 71" | | | | | | | | |
| HEIGHT IN FEET 5' 10.5" to 5' 11" | | | | | | | | |
| AND INCHES | | | | | | | | |
| CHEST SIZES | 50 | 51 | 52 | 53 | 54 | 55 | 56 | 57 |
| WEIGHT-MINIMUM | 251 | 261 | 271 | 281 | 293 | 306 | 318 | 328 |
| WEIGHT-MAXIMUM | 260 | 270 | 280 | 292 | 305 | 317 | 327 | 342 |
| SHIRT SLEEVE LENGTH | 35.390625 | 35.546875 | 35.703125 | 35.859375 | 36.015625 | 36.171875 | 36.328125 | 36.484375 |
| PANT OUTSEAM LENGTH | 41.875 | 41.875 | 41.875 | 41.875 | 41.875 | 41.875 | 41.875 | 41.875 |
| PANT INSEAM LENGTH | 29.3750 | 29.1875 | 29.0000 | 28.8125 | 28.6250 | 28.4375 | 28.2500 | 28.0625 |
| FOOT LENGTH | 11.125 | 11.125 | 11.125 | 11.125 | 11.125 | 11.125 | 11.125 | 11.125 |
| RELATED FOOT SIZE-MINIMUM | 10 | 10 | 10 | 10 | 10 | 10 | 10 | 10 |
| RELATED FOOT SIZE-MIDDLE | 10½ | 10½ | 10½ | 10½ | 10½ | 10½ | 10½ | 10½ |
| RELATED FOOT SIZE-MAXIMUM | 11 | 11 | 11 | 11 | 11 | 11 | 11 | 11 |
| HAND LENGTH | 7.671875 | 7.671875 | 7.671875 | 7.671875 | 7.671875 | 7.671875 | 7.671875 | 7.671875 |
| HEAD AND NECK LENGTH | 10.000 | 10.000 | 10.000 | 10.000 | 10.000 | 10.000 | 10.000 | 10.000 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 70.5" to 71" | | | | |
| HEIGHT IN FEET 5' 10.5" to 5' 11" | | | | |
| AND INCHES | | | | |
| CHEST SIZES | 58 | 59 | 60 | TOLERENCE + OR − |
| WEIGHT-MINIMUM | 343 | 358 | 373 | |
| WEIGHT-MAXIMUM | 357 | 372 | 387 | +3 LBS −3 LBS |
| SHIRT SLEEVE LENGTH | 36.640625 | 36.796875 | 36.953125 | +½" −½" |
| PANT OUTSEAM LENGTH | 41.875 | 41.875 | 41.875 | +½" −½" |
| PANT INSEAM LENGTH | 27.8750 | 27.6875 | 27.5000 | +½" −½" |
| FOOT LENGTH | 11.125 | 11.125 | 11.125 | +5/16" −5/16" |
| RELATED FOOT SIZE-MINIMUM | 10 | 10 | 10 | MINIMUM |
| RELATED FOOT SIZE-MIDDLE | 10½ | 10½ | 10½ | MIDDLE |
| RELATED FOOT SIZE-MAXIMUM | 11 | 11 | 11 | MAXIMUM |
| HAND LENGTH | 7.671875 | 7.671875 | 7.671875 | +¼" −¼" |
| HEAD AND NECK LENGTH | 10.000 | 10.000 | 10.000 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 9 of 17

| A | B | C | D | E | F | G | H | I |
|---|---|---|---|---|---|---|---|---|
| HEIGHT IN INCHES 71.5" to 72" | | | | | | | | |
| HEIGHT IN FEET AND INCHES 5' 11.5" to 6' | | | | | | | | |
| CHEST SIZES | 34 | 35 | 36 | 37 | 38 | 39 | 40 | 41 |
| WEIGHT-MINIMUM | 123 | 131 | 139 | 147 | 155 | 163 | 171 | 179 |
| WEIGHT-MAXIMUM | 130 | 138 | 146 | 154 | 162 | 170 | 178 | 186 |
| SHIRT SLEEVE LENGTH | 33.218750 | 33.375000 | 33.531250 | 33.687500 | 33.843750 | 34.000000 | 34.156250 | 34.312500 |
| PANT OUTSEAM LENGTH | 42.500 | 42.500 | 42.500 | 42.500 | 42.500 | 42.500 | 42.500 | 42.500 |
| PANT INSEAM LENGTH | 32.1250 | 31.9375 | 31.7500 | 31.5625 | 31.3750 | 31.1875 | 31.0000 | 30.8750 |
| FOOT LENGTH | 11.25 | 11.25 | 11.25 | 11.25 | 11.25 | 11.25 | 11.25 | 11.25 |
| RELATED FOOT SIZE-MINIMUM | 10½ | 10½ | 10½ | 10½ | 10½ | 10½ | 10½ | 10½ |
| RELATED FOOT SIZE-MIDDLE | 11 | 11 | 11 | 11 | 11 | 11 | 11 | 11 |
| RELATED FOOT SIZE-MAXIMUM | 11½ | 11½ | 11½ | 11½ | 11½ | 11½ | 11½ | 11½ |
| HAND LENGTH | 7.84375 | 7.84375 | 7.84375 | 7.84375 | 7.84375 | 7.84375 | 7.84375 | 7.84375 |
| HEAD AND NECK LENGTH | 10.250 | 10.250 | 10.250 | 10.250 | 10.250 | 10.250 | 10.250 | 10.250 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 71.5" to 72" | | | | | | | | |
| HEIGHT IN FEET AND INCHES 5' 11.5" to 6' | | | | | | | | |
| CHEST SIZES | 42 | 43 | 44 | 45 | 46 | 47 | 48 | 49 |
| WEIGHT-MINIMUM | 187 | 195 | 203 | 211 | 219 | 227 | 235 | 243 |
| WEIGHT-MAXIMUM | 194 | 202 | 210 | 218 | 226 | 234 | 242 | 252 |
| SHIRT SLEEVE LENGTH | 34.468750 | 34.625000 | 34.781250 | 34.937500 | 35.093750 | 35.250000 | 35.406250 | 35.562500 |
| PANT OUTSEAM LENGTH | 42.500 | 42.500 | 42.500 | 42.500 | 42.500 | 42.500 | 42.500 | 42.500 |
| PANT INSEAM LENGTH | 30.7500 | 30.6250 | 30.5000 | 30.3750 | 30.2500 | 30.1250 | 30.0000 | 29.8125 |
| FOOT LENGTH | 11.25 | 11.25 | 11.25 | 11.25 | 11.25 | 11.25 | 11.25 | 11.25 |
| RELATED FOOT SIZE-MINIMUM | 10½ | 10½ | 10½ | 10½ | 10½ | 10½ | 10½ | 10½ |
| RELATED FOOT SIZE-MIDDLE | 11 | 11 | 11 | 11 | 11 | 11 | 11 | 11 |
| RELATED FOOT SIZE-MAXIMUM | 11½ | 11½ | 11½ | 11½ | 11½ | 11½ | 11½ | 11½ |
| HAND LENGTH | 7.84375 | 7.84375 | 7.84375 | 7.84375 | 7.84375 | 7.84375 | 7.84375 | 7.84375 |
| HEAD AND NECK LENGTH | 10.250 | 10.250 | 10.250 | 10.250 | 10.250 | 10.250 | 10.250 | 10.250 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 71.5" to 72" | | | | | | | | |
| HEIGHT IN FEET AND INCHES 5' 11.5" to 6' | | | | | | | | |
| CHEST SIZES | 50 | 51 | 52 | 53 | 54 | 55 | 56 | 57 |
| WEIGHT-MINIMUM | 253 | 263 | 273 | 283 | 295 | 308 | 320 | 330 |
| WEIGHT-MAXIMUM | 262 | 272 | 282 | 294 | 307 | 319 | 329 | 344 |
| SHIRT SLEEVE LENGTH | 35.718750 | 35.875000 | 36.031250 | 36.187500 | 36.343750 | 38.500000 | 38.656250 | 36.812500 |
| PANT OUTSEAM LENGTH | 42.500 | 42.500 | 42.500 | 42.500 | 42.500 | 42.500 | 42.500 | 42.500 |
| PANT INSEAM LENGTH | 29.6250 | 29.4375 | 29.2500 | 29.0625 | 28.8750 | 28.6875 | 28.5000 | 28.3125 |
| FOOT LENGTH | 11.25 | 11.25 | 11.25 | 11.25 | 11.25 | 11.25 | 11.25 | 11.25 |
| RELATED FOOT SIZE-MINIMUM | 10½ | 10½ | 10½ | 10½ | 10½ | 10½ | 10½ | 10½ |

TABLE 9 of 17-continued

| | | | | | | | | |
|---|---|---|---|---|---|---|---|---|
| RELATED FOOT SIZE-MIDDLE | 11 | 11 | 11 | 11 | 11 | 11 | 11 | 11 |
| RELATED FOOT SIZE-MAXIMUM | 11½ | 11½ | 11½ | 11½ | 11½ | 11½ | 11½ | 11½ |
| HAND LENGTH | 7.84375 | 7.84375 | 7.84375 | 7.84375 | 7.84375 | 7.84375 | 7.84375 | 7.84375 |
| HEAD AND NECK LENGTH | 10.250 | 10.250 | 10.250 | 10.250 | 10.250 | 10.250 | 10.250 | 10.250 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | | Z | AA | AB | AC |
|---|---|---|---|---|---|
| HEIGHT IN INCHES | 71.5" to 72" | | | | |
| HEIGHT IN FEET AND AND INCHES | 5' 11.5" to 6' | | | | |
| CHEST SIZES | | 58 | 59 | 60 | TOLERENCE + OR − |
| WEIGHT-MINIMUM | | 345 | 360 | 375 | |
| WEIGHT-MAXIMUM | | 359 | 374 | 389 | +3 LBS −3 LBS |
| SHIRT SLEEVE LENGTH | | 36.968750 | 37.125000 | 37.281250 | +½" −½" |
| PANT OUTSEAM LENGTH | | 42.500 | 42.500 | 42.500 | +½" −½" |
| PANT INSEAM LENGTH | | 28.1250 | 27.9375 | 27.7500 | +½" −½" |
| FOOT LENGTH | | 11.25 | 11.25 | 11.25 | +5/16" −5/16" |
| RELATED FOOT SIZE-MINIMUM | | 10½ | 10½ | 10½ | MINIMUM |
| RELATED FOOT SIZE-MIDDLE | | 11 | 11 | 11 | MIDDLE |
| RELATED FOOT SIZE-MAXIMUM | | 11½ | 11½ | 11½ | MAXIMUM |
| HAND LENGTH | | 7.84375 | 7.84375 | 7.84375 | +¼" −¼" |
| HEAD AND NECK LENGTH | | 10.250 | 10.250 | 10.250 | +⅜" −⅜" |
| HEAD CIRCUMFERENCE | | 26.5000 | 27.0000 | 27.0000 | +⅜" −⅜" |
| RELATED HAT SIZE | | 8¾ | 9 | 9 | +⅛" −⅛" |
| HAND WIDTH□FOOT WIDTH-SAME | | 5.500 | 5.500 | 5.500 | +½" −½" |
| RELATED FOOT WIDTH | | EEE | EEE | EEE | |
| | | 20.000 | 20.250 | 20.5 | AVERAGE |
| NECK | | 20.500 | 20.500 | 21 | FULL |
| WAIST-ATHLETIC | | 56 | 57 | 58 | ATHLETIC |
| WAIST-TRIM | | 57 | 58 | 59 | TRIM |
| WAIST-AVERAGE | | 58 | 59 | 60 | AVERAGE |
| RING FINGER CIRCUMFERENCE | | 3.000 | 3.000 | 3.500 | +½" −½" |
| | | 3.250 | 3.250 | 4.000 | |
| RELATED RING SIZE | | 17 | 17 | 20 | MINIMUM |
| | | 18 | 18 | 21 | MIDDLE |
| | | 19 | 19 | 22 | MAXIMUM |

TABLE 10 of 17

| A | | B | C | D | E | F | G | H | I |
|---|---|---|---|---|---|---|---|---|---|
| HEIGHT IN INCHES | 72.5" to 73" | | | | | | | | |
| HEIGHT IN FEET AND INCHES | 6' .5" to 6' 1" | | | | | | | | |
| CHEST SIZES | | 34 | 35 | 36 | 37 | 38 | 39 | 40 | 41 |
| WEIGHT-MINIMUM | | 125 | 133 | 141 | 149 | 157 | 165 | 173 | 181 |
| WEIGHT-MAXIMUM | | 132 | 140 | 148 | 156 | 164 | 172 | 180 | 188 |
| SHIRT SLEEVE LENGTH | | 33.546875 | 33.703125 | 33.859375 | 34.015625 | 34.171875 | 34.328125 | 34.484375 | 34.640625 |
| PANT OUTSEAM LENGTH | | 43.125 | 43.125 | 43.125 | 43.125 | 43.125 | 43.125 | 43.125 | 43.125 |
| PANT INSEAM LENGTH | | 32.3750 | 32.1875 | 32.0000 | 31.8125 | 31.6250 | 31.4375 | 31.2500 | 31.1250 |
| FOOT LENGTH | | 11.5 | 11.5 | 11.5 | 11.5 | 11.5 | 11.5 | 11.5 | 11.5 |
| RELATED FOOT SIZE-MINIMUM | | 11½ | 11½ | 11½ | 11½ | 11½ | 11½ | 11½ | 11½ |
| RELATED FOOT SIZE-MIDDLE | | 12 | 12 | 12 | 12 | 12 | 12 | 12 | 12 |
| RELATED FOOT SIZE-MAXIMUM | | 12½ | 12½ | 12½ | 12½ | 12½ | 12½ | 12½ | 12½ |
| HAND LENGTH | | 8.015625 | 8.015625 | 8.015625 | 8.015625 | 8.015625 | 8.015625 | 8.015625 | 8.015625 |
| HEAD AND NECK LENGTH | | 10.500 | 10.500 | 10.500 | 10.500 | 10.500 | 10.500 | 10.500 | 10.500 |
| HEAD CIRCUMFERENCE | | 21.5000 | 21.6875 | 21.8750 | 22.0625 | 22.2500 | 22.4375 | 22.6250 | 22.8125 |
| RELATED HAT SIZE | | 6¾ | 6⅞ | 7 | 7⅛ | 7⅛ | 7¼ | 7¼ | 7⅜ |
| HAND WIDTH□FOOT WIDTH-SAME | | 3.750 | 3.750 | 3.750 | 3.750 | 4.250 | 4.250 | 4.250 | 4.250 |
| RELATED FOOT WIDTH | | | | | A | A | C | C | C |
| | | A | A | A | B | B | D | D | D |
| | | 14.000 | 14.250 | 14.500 | 14.750 | 15.000 | 15.250 | 15.500 | 15.750 |

TABLE 10 of 17-continued

| | | | | | | | | |
|---|---|---|---|---|---|---|---|---|
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES 72.5" to 73" | | | | | | | | |
| HEIGHT IN FEET AND INCHES 6' .5" to 6' 1" | | | | | | | | |
| CHEST SIZES | 42 | 43 | 44 | 45 | 46 | 47 | 48 | 49 |
| WEIGHT-MINIMUM | 189 | 197 | 205 | 213 | 221 | 229 | 237 | 245 |
| WEIGHT-MAXIMUM | 196 | 204 | 212 | 220 | 228 | 236 | 244 | 254 |
| SHIRT SLEEVE LENGTH | 34.796875 | 34.953125 | 35.109375 | 35.265625 | 35.421875 | 35.578125 | 35.734375 | 35.890625 |
| PANT OUTSEAM LENGTH | 43.125 | 43.125 | 43.125 | 43.125 | 43.125 | 43.125 | 43.125 | 43.125 |
| PANT INSEAM LENGTH | 31.0000 | 30.8750 | 30.7500 | 30.6250 | 30.5000 | 30.3750 | 39.2500 | 30.0625 |
| FOOT LENGTH | 11.5 | 11.5 | 11.5 | 11.5 | 11.5 | 11.5 | 11.5 | 11.5 |
| RELATED FOOT SIZE-MINIMUM | 11½ | 11½ | 11½ | 11½ | 11½ | 11½ | 11½ | 11½ |
| RELATED FOOT SIZE-MIDDLE | 12 | 12 | 12 | 12 | 12 | 12 | 12 | 12 |
| RELATED FOOT SIZE-MAXIMUM | 12½ | 12½ | 12½ | 12½ | 12½ | 12½ | 12½ | 12½ |
| HAND LENGTH | 8.015625 | 8.015625 | 8.015625 | 8.015625 | 8.015625 | 8.015625 | 8.015625 | 8.015625 |
| HEAD AND NECK LENGTH | 10.500 | 10.500 | 10.500 | 10.500 | 10.500 | 10.500 | 10.500 | 10.500 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 72.5" to 73" | | | | | | | | |
| HEIGHT IN FEET AND INCHES 6' .5" to 6' 1" | | | | | | | | |
| CHEST SIZES | 50 | 51 | 52 | 53 | 54 | 55 | 56 | 57 |
| WEIGHT-MINIMUM | 255 | 265 | 275 | 285 | 297 | 310 | 322 | 332 |
| WEIGHT-MAXIMUM | 264 | 274 | 284 | 296 | 309 | 321 | 331 | 346 |
| SHIRT SLEEVE LENGTH | 36.046875 | 36.203125 | 36.359375 | 36.515625 | 36.671875 | 36.828125 | 36.984375 | 37.140625 |
| PANT OUTSEAM LENGTH | 43.125 | 43.125 | 43.125 | 43.125 | 43.125 | 43.125 | 43.125 | 43.125 |
| PANT INSEAM LENGTH | 29.8750 | 29.6876 | 29.5000 | 29.3125 | 29.1250 | 28.9375 | 28.7500 | 28.5625 |
| FOOT LENGTH | 11.5 | 11.5 | 11.5 | 11.5 | 11.5 | 11.5 | 11.5 | 11.5 |
| RELATED FOOT SIZE-MINIMUM | 11½ | 11½ | 11½ | 11½ | 11½ | 11½ | 11½ | 11½ |
| RELATED FOOT SIZE-MIDDLE | 12 | 12 | 12 | 12 | 12 | 12 | 12 | 12 |
| RELATED FOOT SIZE-MAXIMUM | 12½ | 12½ | 12½ | 12½ | 12½ | 12½ | 12½ | 12½ |
| HAND LENGTH | 8.015625 | 8.015625 | 8.015625 | 8.015625 | 8.015625 | 8.015625 | 8.015625 | 8.015625 |
| HEAD AND NECK LENGTH | 10.500 | 10.500 | 10.500 | 10.500 | 10.500 | 10.500 | 10.500 | 10.500 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.250 | 5.250 | 5.250 | 5.250 | 5.500 | 5.000 |
| RELATED FOOT WIDTH | EE | EE | EE | EE | EEE | EEE | EEE | |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

TABLE 10 of 17-continued

| | Z | AA | AB | AC |
|---|---|---|---|---|
| HEIGHT IN INCHES | 72.5" to 73" | | | |
| HEIGHT IN FEET AND AND INCHES | 6' .5" to 6' 1" | | | |
| CHEST SIZES | 58 | 59 | 60 | TOLERENCE + OR − |
| WEIGHT-MINIMUM | 347 | 362 | 377 | |
| WEIGHT-MAXIMUM | 361 | 376 | 391 | +3 LBS −3 LBS |
| SHIRT SLEEVE LENGTH | 37.296875 | 37.453125 | 37.609375 | +½" −½" |
| PANT OUTSEAM LENGTH | 43.125 | 43.125 | 43.125 | +½" −½" |
| PANT INSEAM LENGTH | 28.3750 | 28.1875 | 28.0000 | +½" −½" |
| FOOT LENGTH | 11.5 | 11.5 | 11.5 | +5⁄16" −5⁄16" |
| RELATED FOOT SIZE-MINIMUM | 11½ | 11½ | 11½ | MINIMUM |
| RELATED FOOT SIZE-MIDDLE | 12 | 12 | 12 | MIDDLE |
| RELATED FOOT SIZE-MAXIMUM | 12½ | 12½ | 12½ | MAXIMUM |
| HAND LENGTH | 8.015625 | 8.015625 | 8.015625 | +¼" −¼" |
| HEAD AND NECK LENGTH | 10.500 | 10.500 | 10.500 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 11 of 17

| A | B | C | D | E | F | G | H | I |
|---|---|---|---|---|---|---|---|---|
| HEIGHT IN INCHES | 73.5" to 74" | | | | | | | |
| HEIGHT IN FEET AND INCHES | 6' 1.5" to 6' 2" | | | | | | | |
| CHEST SIZES | 34 | 35 | 36 | 37 | 38 | 39 | 40 | 41 |
| WEIGHT-MINIMUM | 127 | 135 | 143 | 151 | 159 | 167 | 175 | 183 |
| WEIGHT-MAXIMUM | 134 | 142 | 150 | 158 | 166 | 174 | 182 | 190 |
| SHIRT SLEEVE LENGTH | 33.875000 | 34.031250 | 34.187500 | 34.343750 | 34.500000 | 34.656250 | 34.812500 | 34.968750 |
| PANT OUTSEAM LENGTH | 43.750 | 43.750 | 43.750 | 43.750 | 43.750 | 43.750 | 43.750 | 43.750 |
| PANT INSEAM LENGTH | 33.6250 | 33.4375 | 33.2500 | 33.0625 | 32.8750 | 32.6875 | 32.5000 | 32.3750 |
| FOOT LENGTH | 11.625 | 11.625 | 11.625 | 11.625 | 11.625 | 11.625 | 11.625 | 11.625 |
| RELATED FOOT SIZE-MINIMUM | 12 | 12 | 12 | 12 | 12 | 12 | 12 | 12 |
| RELATED FOOT SIZE-MIDDLE | 12½ | 12½ | 12½ | 12½ | 12½ | 12½ | 12½ | 12½ |
| RELATED FOOT SIZE-MAXIMUM | 13 | 13 | 13 | 13 | 13 | 13 | 13 | 13 |
| HAND LENGTH | 8.1875 | 8.1875 | 8.1875 | 8.1875 | 8.1875 | 8.1875 | 8.1875 | 8.1875 |
| HEAD AND NECK LENGTH | 10.750 | 10.750 | 10.750 | 10.750 | 10.750 | 10.750 | 10.750 | 10.750 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| | J | K | L | M | N | O | P | Q |
|---|---|---|---|---|---|---|---|---|
| HEIGHT IN INCHES | 73.5" to 74" | | | | | | | |
| HEIGHT IN FEET AND INCHES | 6' 1.5" to 6' 2" | | | | | | | |
| CHEST SIZES | 42 | 43 | 44 | 45 | 46 | 47 | 48 | 49 |
| WEIGHT-MINIMUM | 191 | 199 | 207 | 215 | 223 | 231 | 239 | 247 |
| WEIGHT-MAXIMUM | 198 | 206 | 214 | 222 | 230 | 238 | 246 | 256 |
| SHIRT SLEEVE LENGTH | 35.125000 | 35.281250 | 35.437500 | 35.593750 | 35.750000 | 35.906250 | 36.062500 | 36.218750 |

TABLE 11 of 17-continued

| | | | | | | | | |
|---|---|---|---|---|---|---|---|---|
| PANT OUTSEAM LENGTH | 43.750 | 43.750 | 43.750 | 43.750 | 43.750 | 43.750 | 43.750 | 43.750 |
| PANT INSEAM LENGTH | 32.2500 | 32.1250 | 32.0000 | 31.8750 | 31.7500 | 31.6250 | 31.5000 | 31.3125 |
| FOOT LENGTH | 11.625 | 11.625 | 11.625 | 11.625 | 11.625 | 11.625 | 11.625 | 11.625 |
| RELATED FOOT SIZE-MINIMUM | 12 | 12 | 12 | 12 | 12 | 12 | 12 | 12 |
| RELATED FOOT SIZE-MIDDLE | 12½ | 12½ | 12½ | 12½ | 12½ | 12½ | 12½ | 12½ |
| RELATED FOOT SIZE-MAXIMUM | 13 | 13 | 13 | 13 | 13 | 13 | 13 | 13 |
| HAND LENGTH | 8.1875 | 8.1875 | 8.1875 | 8.1875 | 8.1875 | 8.1875 | 8.1875 | 8.1875 |
| HEAD AND NECK LENGTH | 10.750 | 10.750 | 10.750 | 10.750 | 10.750 | 10.750 | 10.750 | 10.750 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 73.5" to 74" | | | | | | | | |
| HEIGHT IN FEET AND INCHES 6' 1.5" to 6' 2" | | | | | | | | |
| CHEST SIZES | 50 | 51 | 52 | 53 | 54 | 55 | 56 | 57 |
| WEIGHT-MINIMUM | 257 | 267 | 277 | 287 | 299 | 312 | 324 | 334 |
| WEIGHT-MAXIMUM | 266 | 276 | 286 | 298 | 311 | 323 | 333 | 348 |
| SHIRT SLEEVE LENGTH | 36.375000 | 36.531250 | 36.687500 | 36.843750 | 37.000000 | 37.156250 | 37.312500 | 37.468750 |
| PANT OUTSEAM LENGTH | 43.750 | 43.750 | 43.750 | 43.750 | 43.750 | 43.750 | 43.750 | 43.750 |
| PANT INSEAM LENGTH | 31.1250 | 30.9375 | 30.7500 | 30.5625 | 30.3750 | 30.1875 | 30.0000 | 29.8125 |
| FOOT LENGTH | 11.625 | 11.625 | 11.625 | 11.625 | 11.625 | 11.625 | 11.625 | 11.625 |
| RELATED FOOT SIZE-MINIMUM | 12 | 12 | 12 | 12 | 12 | 12 | 12 | 12 |
| RELATED FOOT SIZE-MIDDLE | 12½ | 12½ | 12½ | 12½ | 12½ | 12½ | 12½ | 12½ |
| RELATED FOOT SIZE-MAXIMUM | 13 | 13 | 13 | 13 | 13 | 13 | 13 | 13 |
| HAND LENGTH | 8.1875 | 8.1875 | 8.1875 | 8.1875 | 8.1875 | 8.1875 | 8.1875 | 8.1875 |
| HEAD AND NECK LENGTH | 10.750 | 10.750 | 10.750 | 10.750 | 10.750 | 10.750 | 10.750 | 10.750 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 73.5" to 74" | | | | |
| HEIGHT IN FEET AND AND INCHES 6' 1.5" to 6' 2" | | | | |
| CHEST SIZES | 58 | 59 | 60 | TOLERENCE + OR − |
| WEIGHT-MINIMUM | 349 | 364 | 379 | |
| WEIGHT-MAXIMUM | 363 | 378 | 393 | +3 LBS −3 LBS |
| SHIRT SLEEVE LENGTH | 37.625000 | 37.781250 | 37.937500 | +½" −½" |
| PANT OUTSEAM LENGTH | 43.750 | 43.750 | 43.750 | +½" −½" |
| PANT INSEAM LENGTH | 29.6250 | 29.4375 | 29.2500 | +½" −½" |
| FOOT LENGTH | 11.625 | 11.625 | 11.625 | +5⁄16" −5⁄16" |
| RELATED FOOT SIZE-MINIMUM | 12 | 12 | 12 | MINIMUM |
| RELATED FOOT SIZE-MIDDLE | 12½ | 12½ | 12½ | MIDDLE |
| RELATED FOOT SIZE-MAXIMUM | 13 | 13 | 13 | MAXIMUM |
| HAND LENGTH | 8.1875 | 8.1875 | 8.1875 | +¼" −¼" |
| HEAD AND NECK LENGTH | 10.750 | 10.750 | 10.750 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |

TABLE 11 of 17-continued

| | | | | |
|---|---|---|---|---|
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 12 of 17

| A | B | C | D | E | F | G | H | I |
|---|---|---|---|---|---|---|---|---|
| HEIGHT IN INCHES 74.5" to 75" | | | | | | | | |
| HEIGHT IN FEET AND INCHES 6' 2.5" to 6' 3" | | | | | | | | |
| CHEST SIZES | 34 | 35 | 36 | 37 | 38 | 39 | 40 | 41 |
| WEIGHT-MINIMUM | 129 | 137 | 145 | 153 | 161 | 169 | 177 | 185 |
| WEIGHT-MAXIMUM | 136 | 144 | 152 | 160 | 168 | 176 | 184 | 192 |
| SHIRT SLEEVE LENGTH | 34.203125 | 34.359375 | 34.515625 | 34.671875 | 34.828125 | 34.984375 | 35.140625 | 35.296875 |
| PANT OUTSEAM LENGTH | 44.375 | 44.375 | 44.375 | 44.375 | 44.375 | 44.375 | 44.375 | 44.375 |
| PANT INSEAM LENGTH | 33.8750 | 33.8875 | 33.5000 | 33.3125 | 33.1250 | 32.9375 | 32.7500 | 32.6250 |
| FOOT LENGTH | 11.875 | 11.875 | 11.875 | 11.875 | 11.875 | 11.875 | 11.875 | 11.875 |
| RELATED FOOT SIZE-MINIMUM | 12½ | 12½ | 12½ | 12½ | 12½ | 12½ | 12½ | 12½ |
| RELATED FOOT SIZE-MIDDLE | 13 | 13 | 13 | 13 | 13 | 13 | 13 | 13 |
| RELATED FOOT SIZE-MAXIMUM | 13½ | 13½ | 13½ | 13½ | 13½ | 13½ | 13½ | 13½ |
| HAND LENGTH | 8.359375 | 8.359375 | 8.359375 | 8.359375 | 8.359375 | 8.359375 | 8.359375 | 8.359375 |
| HEAD AND NECK LENGTH | 11.000 | 11.000 | 11.000 | 11.000 | 11.000 | 11.000 | 11.000 | 11.000 |
| HEAD CIRCUMFERENCE | 21.5000 | 21.6875 | 21.8750 | 22.0625 | 22.2500 | 22.4375 | 22.6250 | 22.8125 |
| RELATED HAT SIZE | 6¾ | 6⅞ | 7 | 7⅛ | 7⅛ | 7¼ | 7¼ | 7⅜ |
| HAND WIDTH□FOOT WIDTH-SAME | 3.750 | 3.750 | 3.750 | 3.750 | 4.250 | 4.250 | 4.250 | 4.250 |
| RELATED FOOT WIDTH | | | | A | A | C | C | C |
| | A | A | A | B | B | D | D | D |
| | 14.000 | 14.250 | 14.500 | 14.750 | 15.000 | 15.250 | 15.500 | 15.750 |
| NECK | 14.500 | 14.500 | 15.000 | 15.000 | 15.500 | 15.500 | 16.000 | 16.000 |
| WAIST-ATHLETIC | 25 | 26 | 27 | 29 | 30 | 31 | 32 | 33 |
| WAIST-TRIM | 26 | 27 | 28 | 30 | 31 | 32 | 33 | 34 |
| WAIST-AVERAGE | 27 | 28 | 29 | 31 | 32 | 33 | 34 | 35 |
| RING FINGER CIRCUMFERENCE | 1.500 | 1.500 | 1.500 | 1.500 | 2.000 | 2.000 | 2.250 | 2.250 |
| | 1.750 | 1.750 | 1.750 | 1.750 | 2.375 | 2.375 | 2.750 | 2.750 |
| RELATED RING SIZE | 1 | 1 | | | 5 | | 8 | 8 |
| | 2 | 2 | 3 | 3 | 6 | 9 | 10 | 10 |
| | 3 | 3 | 4 | 4 | 7 | 10 | 12 | 12 |

| A | J | K | L | M | N | O | P | Q |
|---|---|---|---|---|---|---|---|---|
| HEIGHT IN INCHES 74.5" to 75" | | | | | | | | |
| HEIGHT IN FEET AND INCHES 6' 2.5" to 6' 3" | | | | | | | | |
| CHEST SIZES | 42 | 43 | 44 | 45 | 46 | 47 | 48 | 49 |
| WEIGHT-MINIMUM | 193 | 201 | 209 | 217 | 225 | 233 | 241 | 249 |
| WEIGHT-MAXIMUM | 200 | 208 | 216 | 224 | 232 | 240 | 248 | 258 |
| SHIRT SLEEVE LENGTH | 35.453125 | 35.609375 | 35.76525 | 35.921875 | 36.078125 | 36.234375 | 36.390625 | 36.546875 |
| PANT OUTSEAM LENGTH | 44.375 | 44.375 | 44.375 | 44.375 | 44.375 | 44.375 | 44.375 | 44.375 |
| PANT INSEAM LENGTH | 32.5000 | 32.3750 | 32.2500 | 32.1250 | 32.0000 | 31.8750 | 31.7500 | 31.5625 |
| FOOT LENGTH | 11.875 | 11.875 | 11.875 | 11.875 | 11.875 | 11.875 | 11.875 | 11.875 |
| RELATED FOOT SIZE-MINIMUM | 12½ | 12½ | 12½ | 12½ | 12½ | 12½ | 12½ | 12½ |
| RELATED FOOT SIZE-MIDDLE | 13 | 13 | 13 | 13 | 13 | 13 | 13 | 13 |
| RELATED FOOT SIZE-MAXIMUM | 13½ | 13½ | 13½ | 13½ | 13½ | 13½ | 13½ | 13½ |
| HAND LENGTH | 8.359375 | 8.359375 | 8.359375 | 8.359375 | 8.359375 | 8.359375 | 8.359375 | 8.359375 |
| HEAD AND NECK LENGTH | 11.000 | 11.000 | 11.000 | 11.000 | 11.000 | 11.000 | 11.000 | 11.000 |
| HEAD CIRCUMFERENCE | 23.0000 | 23.1875 | 23.3750 | 23.5625 | 23.7500 | 23.9375 | 24.1250 | 24.3125 |
| RELATED HAT SIZE | 7⅜ | 7½ | 7½ | 7⅝ | 7⅝ | 7¾ | 7¾ | 7⅞ |
| HAND WIDTH□FOOT WIDTH-SAME | 4.500 | 4.500 | 4.500 | 4.750 | 4.750 | 4.750 | 4.750 | 5.000 |
| RELATED FOOT WIDTH | C | C | C | | | | | |
| | D | D | D | E | E | E | E | EE |
| | 16.000 | 16.250 | 16.500 | 16.750 | 17.000 | 17.250 | 17.500 | 17.750 |
| NECK | 16.500 | 16.500 | 17.000 | 17.000 | 17.500 | 17.500 | 18.000 | 18.000 |
| WAIST-ATHLETIC | 34 | 35 | 37 | 39 | 40 | 41 | 42 | 43 |
| WAIST-TRIM | 35 | 36 | 38 | 40 | 41 | 42 | 43 | 44 |
| WAIST-AVERAGE | 36 | 37 | 39 | 41 | 42 | 43 | 44 | 45 |
| RING FINGER CIRCUMFERENCE | 2.250 | 2.250 | 2.375 | 2.375 | 2.375 | 2.375 | 2.500 | 2.500 |
| | 2.750 | 2.750 | 2.875 | 2.875 | 2.875 | 2.875 | 3.000 | 3.000 |

TABLE 12 of 17-continued

| | | | | | | | | |
|---|---|---|---|---|---|---|---|---|
| RELATED RING SIZE | 8 | 8 | 12 | 12 | 12 | 12 | 13 | 13 |
| | 10 | 10 | 13 | 13 | 13 | 13 | 14 | 14 |
| | 12 | 12 | 14 | 14 | 14 | 14 | 15 | 15 |

| | R | S | T | U | V | W | X | Y |
|---|---|---|---|---|---|---|---|---|
| HEIGHT IN INCHES 74.5" to 75" | | | | | | | | |
| HEIGHT IN FEET AND INCHES 6' 2.5" to 6' 3" | | | | | | | | |
| CHEST SIZES | 50 | 51 | 52 | 53 | 54 | 55 | 56 | 57 |
| WEIGHT-MINIMUM | 259 | 269 | 279 | 289 | 301 | 314 | 326 | 336 |
| WEIGHT-MAXIMUM | 268 | 278 | 288 | 300 | 313 | 325 | 335 | 350 |
| SHIRT SLEEVE LENGTH | 36.703125 | 36.859375 | 37.015625 | 37.171875 | 37.328125 | 37.484375 | 37.640625 | 37.796875 |
| PANT OUTSEAM LENGTH | 44.375 | 44.375 | 44.375 | 44.375 | 44.375 | 44.375 | 44.375 | 44.375 |
| PANT INSEAM LENGTH | 31.3750 | 31.1875 | 31.0000 | 30.8125 | 30.6250 | 30.4375 | 30.2500 | 30.0625 |
| FOOT LENGTH | 11.875 | 11.875 | 11.875 | 11.875 | 11.875 | 11.875 | 11.875 | 11.875 |
| RELATED FOOT SIZE-MINIMUM | 12½ | 12½ | 12½ | 12½ | 12½ | 12½ | 12½ | 12½ |
| RELATED FOOT SIZE-MIDDLE | 13 | 13 | 13 | 13 | 13 | 13 | 13 | 13 |
| RELATED FOOT SIZE-MAXIMUM | 13½ | 13½ | 13½ | 13½ | 13½ | 13½ | 13½ | 13½ |
| HAND LENGTH | 8.359375 | 8.359375 | 8.359375 | 8.359375 | 8.359375 | 8.359375 | 8.359375 | 8.359375 |
| HEAD AND NECK LENGTH | 11.000 | 11.000 | 11.000 | 11.000 | 11.000 | 11.000 | 11.000 | 11.000 |
| HEAD CIRCUMFERENCE | 24.5000 | 24.7500 | 25.0000 | 25.5000 | 25.5000 | 26.0000 | 26.0000 | 26.5000 |
| RELATED HAT SIZE | 7⅞ | 8 | 8 | 8¼ | 8¼ | 8½ | 8½ | 8¾ |
| HAND WIDTH□FOOT WIDTH-SAME | 5.000 | 5.000 | 5.000 | 5.250 | 5.250 | 5.250 | 5.250 | 5.500 |
| RELATED FOOT WIDTH | EE | EE | EE | EE | EE | EEE | EEE | EEE |
| | 18.000 | 18.250 | 18.500 | 18.750 | 19.000 | 19.250 | 19.500 | 19.750 |
| NECK | 18.500 | 18.500 | 19.000 | 19.000 | 19.500 | 19.500 | 20.000 | 20.000 |
| WAIST-ATHLETIC | 44 | 45 | 46 | 47 | 48 | 47 | 50 | 57 |
| WAIST-TRIM | 45 | 46 | 47 | 48 | 49 | 49 | 52 | 56 |
| WAIST-AVERAGE | 46 | 47 | 48 | 49 | 50 | 51 | 54 | 57 |
| RING FINGER CIRCUMFERENCE | 2.500 | 2.500 | 2.750 | 2.750 | 2.750 | 2.750 | 3.000 | 3.000 |
| | 3.000 | 3.000 | 3.125 | 3.125 | 3.125 | 3.125 | 3.250 | 3.250 |
| RELATED RING SIZE | 13 | 13 | 14 | 14 | 14 | 14 | 17 | 17 |
| | 14 | 14 | 15 | 15 | 15 | 15 | 18 | 18 |
| | 15 | 15 | 16 | 16 | 16 | 16 | 19 | 19 |

| | Z | AA | AB | AC |
|---|---|---|---|---|
| HEIGHT IN INCHES 74.5" to 75" | | | | |
| HEIGHT IN FEET AND AND INCHES 6' 2.5" to 6' 3" | | | | |
| CHEST SIZES | 58 | 59 | 60 | TOLERENCE + OR − |
| WEIGHT-MINIMUM | 351 | 366 | 381 | |
| WEIGHT-MAXIMUM | 365 | 380 | 395 | +3 LBS −3 LBS |
| SHIRT SLEEVE LENGTH | 37.953125 | 38.109375 | 38.265625 | +½" −½" |
| PANT OUTSEAM LENGTH | 44.375 | 44.375 | 44.375 | +½" −½" |
| PANT INSEAM LENGTH | 29.8750 | 29.6875 | 29.5000 | +½" −½" |
| FOOT LENGTH | 11.875 | 11.875 | 11.875 | +5/16" −5/16" |
| RELATED FOOT SIZE-MINIMUM | 12½ | 12½ | 12½ | MINIMUM |
| RELATED FOOT SIZE-MIDDLE | 13 | 13 | 13 | MIDDLE |
| RELATED FOOT SIZE-MAXIMUM | 13½ | 13½ | 13½ | MAXIMUM |
| HAND LENGTH | 8.359375 | 8.359375 | 8.359375 | +¼" −¼" |
| HEAD AND NECK LENGTH | 11.000 | 11.000 | 11.000 | +⅜" −⅜" |
| HEAD CIRCUMFERENCE | 26.5000 | 27.0000 | 27.0000 | +⅜" −⅜" |
| RELATED HAT SIZE | 8¾ | 9 | 9 | +⅛" −⅛" |
| HAND WIDTH□FOOT WIDTH-SAME | 5.500 | 5.500 | 5.500 | +½" −½" |
| RELATED FOOT WIDTH | EEE | EEE | EEE | |
| | 20.000 | 20.250 | 20.5 | AVERAGE |
| NECK | 20.500 | 20.500 | 21 | FULL |
| WAIST-ATHLETIC | 56 | 57 | 58 | ATHLETIC |
| WAIST-TRIM | 57 | 58 | 59 | TRIM |
| WAIST-AVERAGE | 58 | 59 | 60 | AVERAGE |
| RING FINGER CIRCUMFERENCE | 3.000 | 3.000 | 3.500 | +½" −½" |
| | 3.250 | 3.250 | 4.000 | |
| RELATED RING SIZE | 17 | 17 | 20 | MINIMUM |
| | 18 | 18 | 21 | MIDDLE |
| | 19 | 19 | 22 | MAXIMUM |

TABLE 13

| A | B | C | D | E | F | G | H |
|---|---|---|---|---|---|---|---|
| HEIGHT IN INCHES | 75.5" to 76" | | | | | | |
| HEIGHT IN FEET AND INCHES | 6' 3.5" to 6' 4" | | | | | | |
| CHEST SIZES | 34 | 35 | 36 | 37 | 38 | 39 | 40 |
| WEIGHT-MINIMUM | 131 | 139 | 147 | 155 | 163 | 171 | 179 |

TABLE 13-continued

| | | | | | | | |
|---|---|---|---|---|---|---|---|
| WEIGHT-MAXIMUM | 138 | 146 | 154 | 162 | 170 | 178 | 186 |
| SHIRT SLEEVE LENGTH | 34.531250 | 34.687500 | 34.843750 | 35.000000 | 35.156250 | 35.312500 | 35.468750 |
| PANT OUTSEAM LENGTH | 45.000 | 45.000 | 45.000 | 45.000 | 45.000 | 45.000 | 45.000 |
| PANT INSEAM LENGTH | 34.1250 | 33.9375 | 33.7500 | 33.5625 | 33.3750 | 33.1875 | 33.0000 |
| FOOT LENGTH | 12 | 12 | 12 | 12 | 12 | 12 | 12 |
| RELATED FOOT SIZE-MINIMUM | 12½ | 12½ | 12½ | 12½ | 12½ | 12½ | 12½ |
| RELATED FOOT SIZE-MIDDLE | 13 | 13 | 13 | 13 | 13 | 13 | 13 |
| RELATED FOOT SIZE-MAXIMUM | 13½ | 13½ | 13½ | 13½ | 13½ | 13½ | 13½ |
| HAND LENGTH | 8.53125 | 8.53125 | 8.53125 | 8.53125 | 8.53125 | 8.53125 | 8.53125 |
| HEAD AND NECK LENGTH | 11.250 | 11.250 | 11.250 | 11.250 | 11.250 | 11.250 | 11.250 |
| HEAD CIRCUMFERENCE | 21.5000 | 21.6875 | 21.8750 | 22.0625 | 22.2500 | 22.4375 | 22.6250 |
| RELATED HAT SIZE | 6¾ | 6⅞ | 7 | 7⅛ | 7⅛ | 7¼ | 7¼ |
| HAND WIDTH□FOOT WIDTH-SAME | 3.750 | 3.750 | 3.750 | 3.750 | 4.250 | 4.250 | 4.250 |
| RELATED FOOT WIDTH | | | | A | A | C | C |
| | A | A | A | B | B | D | D |
| | 14.000 | 14.250 | 14.500 | 14.750 | 15.000 | 15.250 | 15.500 |
| NECK | 14.500 | 14.500 | 15.000 | 15.000 | 15.500 | 15.500 | 16.000 |
| WAIST-ATHLETIC | 25 | 26 | 27 | 29 | 30 | 31 | 32 |
| WAIST-TRIM | 26 | 27 | 28 | 30 | 31 | 32 | 33 |
| WAIST-AVERAGE | 27 | 28 | 29 | 31 | 32 | 33 | 34 |
| RING FINGER CIRCUMFERENCE | 1.500 | 1.500 | 1.500 | 1.500 | 2.000 | 2.000 | 2.250 |
| | 1.750 | 1.750 | 1.750 | 1.750 | 2.375 | 2.375 | 2.750 |
| RELATED RING SIZE | 1 | 1 | | | 5 | | 8 |
| | 2 | 2 | 3 | 3 | 6 | 9 | 10 |
| | 3 | 3 | 4 | 4 | 7 | 10 | 12 |

| A | I | J | K | L | M | N | O |
|---|---|---|---|---|---|---|---|
| HEIGHT IN INCHES | 75.5" to 76" | | | | | | |
| HEIGHT IN FEET AND INCHES | 6' 3.5" to 6' 4" | | | | | | |
| CHEST SIZES | 41 | 42 | 43 | 44 | 45 | 46 | 47 |
| WEIGHT-MINIMUM | 187 | 195 | 203 | 211 | 219 | 227 | 235 |
| WEIGHT-MAXIMUM | 194 | 202 | 210 | 218 | 226 | 234 | 242 |
| SHIRT SLEEVE LENGTH | 35.625000 | 35.781250 | 35.937500 | 36.093750 | 36.250000 | 36.406250 | 36.562500 |
| PANT OUTSEAM LENGTH | 45.000 | 45.000 | 45.000 | 45.000 | 45.000 | 45.000 | 45.000 |
| PANT INSEAM LENGTH | 32.8750 | 32.7500 | 32.6250 | 32.5000 | 32.3750 | 32.2500 | 32.1250 |
| FOOT LENGTH | 12 | 12 | 12 | 12 | 12 | 12 | 12 |
| RELATED FOOT SIZE-MINIMUM | 12½ | 12½ | 12½ | 12½ | 12½ | 12½ | 12½ |
| RELATED FOOT SIZE-MIDDLE | 13 | 13 | 13 | 13 | 13 | 13 | 13 |
| RELATED FOOT SIZE-MAXIMUM | 13½ | 13½ | 13½ | 13½ | 13½ | 13½ | 13½ |
| HAND LENGTH | 8.53125 | 8.53125 | 8.53125 | 8.53125 | 8.53125 | 8.53125 | 8.53125 |
| HEAD AND NECK LENGTH | 11.250 | 11.250 | 11.250 | 11.250 | 11.250 | 11.250 | 11.250 |
| HEAD CIRCUMFERENCE | 22.8125 | 23.0000 | 23.1875 | 23.3750 | 23.5625 | 23.7500 | 23.9375 |
| RELATED HAT SIZE | 7⅜ | 7⅜ | 7½ | 7½ | 7⅝ | 7⅝ | 7¾ |
| HAND WIDTH□FOOT WIDTH-SAME | 4.250 | 4.500 | 4.500 | 4.500 | 4.750 | 4.750 | 4.750 |
| RELATED FOOT WIDTH | C | C | C | C | | | |
| | D | D | D | D | E | E | E |
| | 15.750 | 16.000 | 16.250 | 16.500 | 16.750 | 17.000 | 17.250 |
| NECK | 16.000 | 16.500 | 16.500 | 17.000 | 17.000 | 17.500 | 17.500 |
| WAIST-ATHLETIC | 33 | 34 | 35 | 37 | 39 | 40 | 41 |
| WAIST-TRIM | 34 | 35 | 36 | 38 | 40 | 41 | 42 |
| WAIST-AVERAGE | 35 | 36 | 37 | 39 | 41 | 42 | 43 |
| RING FINGER CIRCUMFERENCE | 2.250 | 2.250 | 2.250 | 2.375 | 2.375 | 2.375 | 2.375 |
| | 2.750 | 2.750 | 2.750 | 2.875 | 2.875 | 2.875 | 2.875 |
| RELATED RING SIZE | 8 | 8 | 8 | 12 | 12 | 12 | 12 |
| | 10 | 10 | 10 | 13 | 13 | 13 | 13 |
| | 12 | 12 | 12 | 14 | 14 | 14 | 14 |

| A | P | Q | R | S | T | U | V |
|---|---|---|---|---|---|---|---|
| HEIGHT IN INCHES | 75.5" to 76" | | | | | | |
| HEIGHT IN FEET AND INCHES | 6' 3.5" to 6' 4" | | | | | | |
| CHEST SIZES | 48 | 49 | 50 | 51 | 52 | 53 | 54 |
| WEIGHT-MINIMUM | 243 | 251 | 261 | 271 | 281 | 291 | 303 |
| WEIGHT-MAXIMUM | 250 | 260 | 270 | 280 | 290 | 302 | 315 |
| SHIRT SLEEVE LENGTH | 36.718750 | 36.875000 | 37.031250 | 37.187500 | 37.343750 | 37.500000 | 37.656250 |
| PANT OUTSEAM LENGTH | 45.000 | 45.000 | 45.000 | 45.000 | 45.000 | 45.000 | 45.000 |
| PANT INSEAM LENGTH | 32.0000 | 31.8125 | 31.6250 | 31.4375 | 31.2500 | 31.0625 | 30.8750 |
| FOOT LENGTH | 12 | 12 | 12 | 12 | 12 | 12 | 12 |
| RELATED FOOT SIZE-MINIMUM | 12½ | 12½ | 12½ | 12½ | 12½ | 12½ | 12½ |
| RELATED FOOT SIZE-MIDDLE | 13 | 13 | 13 | 13 | 13 | 13 | 13 |
| RELATED FOOT SIZE-MAXIMUM | 13½ | 13½ | 13½ | 13½ | 13½ | 13½ | 13½ |
| HAND LENGTH | 8.53125 | 8.53125 | 8.53125 | 8.53125 | 8.53125 | 8.53125 | 8.53125 |
| HEAD AND NECK LENGTH | 11.250 | 11.250 | 11.250 | 11.250 | 11.250 | 11.250 | 11.250 |
| HEAD CIRCUMFERENCE | 24.1250 | 24.3125 | 24.5000 | 24.7500 | 25.0000 | 25.5000 | 25.5000 |
| RELATED HAT SIZE | 7¾ | 7⅞ | 7⅞ | 8 | 8 | 8¼ | 8¼ |
| HAND WIDTH□FOOT WIDTH-SAME | 4.750 | 5.000 | 5.000 | 5.000 | 5.000 | 5.250 | 5.250 |

TABLE 13-continued

| | | | | | | | |
|---|---|---|---|---|---|---|---|
| RELATED FOOT WIDTH | | | | | | | |
| | E | EE | EE | EE | EE | EE | EE |
| | 17.500 | 17.750 | 18.000 | 18.250 | 18.500 | 18.750 | 19.000 |
| NECK | 18.000 | 18.000 | 18.500 | 18.500 | 19.000 | 19.000 | 19.500 |
| WAIST-ATHLETIC | 42 | 43 | 44 | 45 | 46 | 47 | 48 |
| WAIST-TRIM | 43 | 44 | 45 | 48 | 47 | 48 | 49 |
| WAIST-AVERAGE | 44 | 45 | 46 | 47 | 48 | 49 | 50 |
| RING FINGER CIRCUMFERENCE | 2.500 | 2.500 | 2.500 | 2.500 | 2.750 | 2.750 | 2.750 |
| | 3.000 | 3.000 | 3.000 | 3.000 | 3.125 | 3.125 | 3.125 |
| RELATED RING SIZE | 13 | 13 | 13 | 13 | 14 | 14 | 14 |
| | 14 | 14 | 14 | 14 | 15 | 15 | 15 |
| | 15 | 15 | 15 | 15 | 16 | 16 | 16 |

| A | W | X | Y | Z | AA | AB | AC |
|---|---|---|---|---|---|---|---|
| HEIGHT IN INCHES | | | | | | | |
| CHEST SIZES | 55 | 56 | 57 | 58 | 59 | 60 | TOLERENCE + OR − |
| WEIGHT-MINIMUM | 316 | 328 | 338 | 353 | 368 | 383 | |
| WEIGHT-MAXIMUM | 327 | 337 | 352 | 367 | 382 | 397 | +3 LBS −3 LBS |
| SHIRT SLEEVE LENGTH | 37.812500 | 37.968750 | 38.125000 | 38.281250 | 38.437500 | 38.593750 | +½" −½" |
| PANT OUTSEAM LENGTH | 45.000 | 45.000 | 45.000 | 45.000 | 45.000 | 45.000 | +½" −½" |
| PANT INSEAM LENGTH | 30.6875 | 30.5000 | 30.3125 | 30.1250 | 29.9375 | 29.7500 | +½" −½" |
| FOOT LENGTH | 12 | 12 | 12 | 12 | 12 | 12 | +5/16" −5/16" |
| RELATED FOOT SIZE-MINIMUM | 12½ | 12½ | 12½ | 12½ | 12½ | 12½ | MINIMUM |
| RELATED FOOT SIZE-MIDDLE | 13 | 13 | 13 | 13 | 13 | 13 | MIDDLE |
| RELATED FOOT SIZE-MAXIMUM | 13½ | 13½ | 13½ | 13½ | 13½ | 13½ | MAXIMUM |
| HAND LENGTH | 8.53125 | 8.53125 | 8.53125 | 8.53125 | 8.53125 | 8.53125 | +¼" −¼" |
| HEAD AND NECK LENGTH | 11.250 | 11.250 | 11.250 | 11.250 | 11.250 | 11.250 | +⅜" −⅜" |
| HEAD CIRCUMFERENCE | 26.0000 | 26.0000 | 26.5000 | 26.5000 | 27.0000 | 27.0000 | +⅜" −⅜" |
| RELATED HAT SIZE | 8½ | 8½ | 8¾ | 8¾ | 9 | 9 | +⅛" −⅛" |
| HAND WIDTH□FOOT WIDTH-SAME | 5.250 | 5.250 | 5.500 | 5.500 | 5.500 | 5.500 | +½" −½" |
| RELATED FOOT WIDTH | | | | | | | |
| | EEE | EEE | EEE | EEE | EEE | EEE | |
| | 19.250 | 19.500 | 19.750 | 20.000 | 20.250 | 20.5 | AVERAGE |
| NECK | 19.500 | 20.000 | 20.000 | 20.500 | 20.500 | 21 | FULL |
| WAIST-ATHLETIC | 47 | 50 | 57 | 56 | 57 | 58 | ATHLETIC |
| WAIST-TRIM | 49 | 52 | 56 | 57 | 58 | 59 | TRIM |
| WAIST-AVERAGE | 51 | 54 | 57 | 58 | 59 | 60 | AVERAGE |
| RING FINGER CIRCUMFERENCE | 2.750 | 3.000 | 3.000 | 3.000 | 3.000 | 3.500 | |
| | 3.125 | 3.250 | 3.250 | 3.250 | 3.250 | 4.000 | +½" −½" |
| RELATED RING SIZE | 14 | 17 | 17 | 17 | 17 | 20 | MINIMUM |
| | 15 | 18 | 18 | 18 | 18 | 21 | MIDDLE |
| | 16 | 19 | 19 | 19 | 19 | 22 | MAXIMUM |

TABLE 14

| A | B | C | D | E | F | G | H |
|---|---|---|---|---|---|---|---|
| HEIGHT IN INCHES | 76.5" to 77" | | | | | | |
| HEIGHT IN FEET AND INCHES | 6' 4.5" to 6' 5" | | | | | | |
| CHEST SIZES | 34 | 35 | 36 | 37 | 38 | 39 | 40 |
| WEIGHT-MINIMUM | 133 | 141 | 149 | 157 | 165 | 173 | 181 |
| WEIGHT-MAXIMUM | 140 | 148 | 156 | 164 | 172 | 180 | 188 |
| SHIRT SLEEVE LENGTH | 34.859375 | 35.015625 | 35.171875 | 35.328125 | 35.484375 | 35.640625 | 35.796875 |
| PANT OUTSEAM LENGTH | 45.625 | 45.625 | 45.625 | 45.625 | 45.625 | 45.625 | 45.625 |
| PANT INSEAM LENGTH | 34.3750 | 34.1875 | 34.0000 | 33.8125 | 33.6250 | 33.4375 | 33.2500 |
| FOOT LENGTH | 12.25 | 12.25 | 12.25 | 12.25 | 12.25 | 12.25 | 12.25 |
| RELATED FOOT SIZE-MINIMUM | 13 | 13 | 13 | 13 | 13 | 13 | 13 |
| RELATED FOOT SIZE-MIDDLE | 13½ | 13½ | 13½ | 13½ | 13½ | 13½ | 13½ |
| RELATED FOOT SIZE-MAXIMUM | 14 | 14 | 14 | 14 | 14 | 14 | 14 |
| HAND LENGTH | 8.703125 | 8.703125 | 8.703125 | 8.703125 | 8.703125 | 8.703125 | 8.703125 |
| HEAD AND NECK LENGTH | 11.500 | 11.500 | 11.500 | 11.500 | 11.500 | 11.500 | 11.500 |
| HEAD CIRCUMFERENCE | 21.5000 | 21.6875 | 21.8750 | 22.0625 | 22.2500 | 22.4375 | 22.6250 |
| RELATED HAT SIZE | 6¾ | 6⅞ | 7 | 7⅛ | 7⅛ | 7¼ | 7¼ |
| HAND WIDTH□FOOT WIDTH-SAME | 3.750 | 3.750 | 3.750 | 3.750 | 4.250 | 4.250 | 4.250 |
| RELATED FOOT WIDTH | | | | A | A | C | C |
| | A | A | A | B | B | D | D |
| | 14.000 | 14.250 | 14.500 | 14.750 | 15.000 | 15.250 | 15.500 |
| NECK | 14.500 | 14.500 | 15.000 | 15.000 | 15.550 | 15.500 | 16.000 |
| WAIST-ATHLETIC | 25 | 26 | 27 | 29 | 30 | 31 | 32 |
| WAIST-TRIM | 26 | 27 | 28 | 30 | 31 | 32 | 33 |
| WAIST-AVERAGE | 27 | 28 | 29 | 31 | 32 | 33 | 34 |
| RING FINGER CIRCUMFERENCE | 1.500 | 1.500 | 1.500 | 1.500 | 2.000 | 2.000 | 2.250 |
| | 1.750 | 1.750 | 1.750 | 1.750 | 2.375 | 2.375 | 2.750 |

TABLE 14-continued

| | | | | | | | |
|---|---|---|---|---|---|---|---|
| RELATED RING SIZE | 1 | 1 | | | 5 | | 8 |
| | 2 | 2 | 3 | 3 | 6 | 9 | 10 |
| | 3 | 3 | 4 | 4 | 7 | 10 | 12 |

| A | I | J | K | L | M | N | O |
|---|---|---|---|---|---|---|---|
| HEIGHT IN INCHES | 76.5" to 77" | | | | | | |
| HEIGHT IN FEET AND INCHES | 6' 4.5" to 6' 5" | | | | | | |
| CHEST SIZES | 41 | 42 | 43 | 44 | 45 | 46 | 47 |
| WEIGHT-MINIMUM | 189 | 197 | 205 | 213 | 221 | 229 | 237 |
| WEIGHT-MAXIMUM | 196 | 204 | 212 | 220 | 228 | 236 | 244 |
| SHIRT SLEEVE LENGTH | 35.953125 | 36.109375 | 36.265625 | 36.421875 | 36.578125 | 36.734375 | 36.890625 |
| PANT OUTSEAM LENGTH | 45.625 | 45.625 | 45.625 | 45.625 | 45.625 | 45.625 | 45.625 |
| PANT INSEAM LENGTH | 33.1250 | 33.0000 | 32.8750 | 32.7500 | 32.6250 | 32.5000 | 32.3750 |
| FOOT LENGTH | 12.25 | 12.25 | 12.25 | 12.25 | 12.25 | 12.25 | 12.25 |
| RELATED FOOT SIZE-MINIMUM | 13 | 13 | 13 | 13 | 13 | 13 | 13 |
| RELATED FOOT SIZE-MIDDLE | 13½ | 13½ | 13½ | 13½ | 13½ | 13½ | 13½ |
| RELATED FOOT SIZE-MAXIMUM | 14 | 14 | 14 | 14 | 14 | 14 | 14 |
| HAND LENGTH | 8.703125 | 8.703125 | 8.703125 | 8.703125 | 8.703125 | 8.703125 | 8.703125 |
| HEAD AND NECK LENGTH | 11.500 | 11.500 | 11.500 | 11.500 | 11.500 | 11.500 | 11.500 |
| HEAD CIRCUMFERENCE | 22.8125 | 23.0000 | 23.1875 | 23.3750 | 23.5625 | 23.7500 | 23.9375 |
| RELATED HAT SIZE | 7⅜ | 7⅜ | 7½ | 7½ | 7⅝ | 7⅝ | 7¾ |
| HAND WIDTH□FOOT WIDTH-SAME | 4.250 | 4.500 | 4.500 | 4.500 | 4.750 | 4.750 | 4.750 |
| RELATED FOOT WIDTH | C | C | C | C | | | |
| | D | D | D | D | E | E | E |
| | 15.750 | 16.000 | 16.250 | 16.500 | 16.750 | 17.000 | 17.250 |
| NECK | 16.000 | 16.500 | 16.500 | 17.000 | 17.000 | 17.500 | 17.500 |
| WAIST-ATHLETIC | 33 | 34 | 35 | 37 | 39 | 40 | 41 |
| WAIST-TRIM | 34 | 35 | 36 | 38 | 40 | 41 | 42 |
| WAIST-AVERAGE | 35 | 36 | 37 | 39 | 41 | 42 | 43 |
| RING FINGER CIRCUMFERENCE | 2.250 | 2.250 | 2.250 | 2.375 | 2.375 | 2.375 | 2.375 |
| | 2.750 | 2.750 | 2.750 | 2.875 | 2.875 | 2.875 | 2.875 |
| RELATED RING SIZE | 8 | 8 | 8 | 12 | 12 | 12 | 12 |
| | 10 | 10 | 10 | 13 | 13 | 13 | 13 |
| | 12 | 12 | 12 | 14 | 14 | 14 | 14 |

| A | P | Q | R | S | T | U | V |
|---|---|---|---|---|---|---|---|
| HEIGHT IN INCHES | 76.5" to 77" | | | | | | |
| HEIGHT IN FEET AND INCHES | 6' 4.5" to 6' 5" | | | | | | |
| CHEST SIZES | 48 | 49 | 50 | 51 | 52 | 53 | 54 |
| WEIGHT-MINIMUM | 245 | 253 | 263 | 273 | 283 | 293 | 305 |
| WEIGHT-MAXIMUM | 252 | 262 | 272 | 282 | 292 | 304 | 317 |
| SHIRT SLEEVE LENGTH | 37.046875 | 37.203125 | 37.359375 | 37.515625 | 37.671875 | 37.828125 | 37.984375 |
| PANT OUTSEAM LENGTH | 45.625 | 45.625 | 45.625 | 45.625 | 45.625 | 45.625 | 45.625 |
| PANT INSEAM LENGTH | 32.2500 | 32.0625 | 31.8750 | 31.6875 | 31.5000 | 31.3125 | 31.1250 |
| FOOT LENGTH | 12.25 | 12.25 | 12.25 | 12.25 | 12.25 | 12.25 | 12.25 |
| RELATED FOOT SIZE-MINIMUM | 13 | 13 | 13 | 13 | 13 | 13 | 13 |
| RELATED FOOT SIZE-MIDDLE | 13½ | 13½ | 13½ | 13½ | 13½ | 13½ | 13½ |
| RELATED FOOT SIZE-MAXIMUM | 14 | 14 | 14 | 14 | 14 | 14 | 14 |
| HAND LENGTH | 8.703125 | 8.703125 | 8.703125 | 8.703125 | 8.703125 | 8.703125 | 8.703125 |
| HEAD AND NECK LENGTH | 11.500 | 11.500 | 11.500 | 11.500 | 11.500 | 11.500 | 11.500 |
| HEAD CIRCUMFERENCE | 24.1250 | 24.3125 | 24.5000 | 24.7500 | 25.0000 | 25.5000 | 25.5000 |
| RELATED HAT SIZE | 7¾ | 7⅞ | 7⅞ | 8 | 8 | 8¼ | 8¼ |
| HAND WIDTH□FOOT WIDTH-SAME | 4.750 | 5.000 | 5.000 | 5.000 | 5.000 | 5.250 | 5.250 |
| RELATED FOOT WIDTH | | | | | | | |
| | E | EE | EE | EE | EE | EE | EE |
| | 17.500 | 17.750 | 18.000 | 18.250 | 18.500 | 18.750 | 19.000 |
| NECK | 18.000 | 18.000 | 18.500 | 18.500 | 19.000 | 19.000 | 19.500 |
| WAIST-ATHLETIC | 42 | 43 | 44 | 45 | 46 | 47 | 48 |
| WAIST-TRIM | 43 | 44 | 45 | 46 | 47 | 48 | 49 |
| WAIST-AVERAGE | 44 | 45 | 46 | 47 | 48 | 49 | 50 |
| RING FINGER CIRCUMFERENCE | 2.500 | 2.500 | 2.500 | 2.500 | 2.750 | 2.750 | 2.750 |
| | 3.000 | 3.000 | 3.000 | 3.000 | 3.125 | 3.125 | 3.125 |
| RELATED RING SIZE | 13 | 13 | 13 | 13 | 14 | 14 | 14 |
| | 14 | 14 | 14 | 14 | 15 | 15 | 15 |
| | 15 | 15 | 15 | 15 | 16 | 16 | 16 |

| A | W | X | Y | Z | AA | AB | AC |
|---|---|---|---|---|---|---|---|
| HEIGHT IN INCHES | 76.5" to 77" | | | | | | |
| HEIGHT IN FEET AND INCHES | 6' 4.5" to 6' 5" | | | | | | |
| CHEST SIZES | 55 | 56 | 57 | 58 | 59 | 60 | TOLERENCE + OR − |
| WEIGHT-MINIMUM | 318 | 330 | 340 | 355 | 370 | 385 | |
| WEIGHT-MAXIMUM | 329 | 339 | 354 | 369 | 384 | 399 | +3 LBS −3 LBS |
| SHIRT SLEEVE LENGTH | 38.140625 | 38.296875 | 38.453125 | 38.609375 | 38.765625 | 38.921875 | +½" −½" |
| PANT OUTSEAM LENGTH | 45.625 | 45.625 | 45.625 | 45.625 | 45.625 | 45.625 | +½" −½" |
| PANT INSEAM LENGTH | 30.9375 | 30.7500 | 30.5625 | 30.3750 | 30.1875 | 30.0000 | +½" −½" |

TABLE 14-continued

| | | | | | | | |
|---|---|---|---|---|---|---|---|
| FOOT LENGTH | 12.25 | 12.25 | 12.25 | 12.25 | 12.25 | 12.25 | +5/16" −5/16" |
| RELATED FOOT SIZE-MINIMUM | 13 | 13 | 13 | 13 | 13 | 13 | MINIMUM |
| RELATED FOOT SIZE-MIDDLE | 13½ | 13½ | 13½ | 13½ | 13½ | 13½ | MIDDLE |
| RELATED FOOT SIZE-MAXIMUM | 14 | 14 | 14 | 14 | 14 | 14 | MAXIMUM |
| HAND LENGTH | 8.703125 | 8.703125 | 8.703125 | 8.703125 | 8.703125 | 8.703125 | +¼" −¼" |
| HEAD AND NECK LENGTH | 11.500 | 11.500 | 11.500 | 11.500 | 11.500 | 11.500 | +⅜" −⅜" |
| HEAD CIRCUMFERENCE | 26.0000 | 26.0000 | 26.5000 | 26.5000 | 27.0000 | 27.0000 | +⅜" −⅜" |
| RELATED HAT SIZE | 8½ | 8½ | 8¾ | 8¾ | 9 | 9 | +⅛" −⅛" |
| HAND WIDTH□FOOT WIDTH-SAME | 5.250 | 5.250 | 5.500 | 5.500 | 5.500 | 5.500 | +½" −½" |
| RELATED FOOT WIDTH | | | | | | | |
| | EEE | EEE | EEE | EEE | EEE | EEE | |
| | 19.250 | 19.500 | 19.750 | 20.000 | 20.250 | 20.5 | AVERAGE |
| NECK | 19.500 | 20.000 | 20.000 | 20.500 | 20.500 | 21 | FULL |
| WAIST-ATHLETIC | 47 | 50 | 57 | 56 | 57 | 58 | ATHLETIC |
| WAIST-TRIM | 49 | 52 | 56 | 57 | 58 | 59 | TRIM |
| WAIST-AVERAGE | 51 | 54 | 57 | 58 | 59 | 60 | AVERAGE |
| RING FINGER CIRCUMFERENCE | 2.750 | 3.000 | 3.000 | 3.000 | 3.000 | 3.500 | |
| | 3.125 | 3.250 | 3.250 | 3.250 | 3.250 | 4.000 | +½" −½" |
| RELATED RING SIZE | 14 | 17 | 17 | 17 | 17 | 20 | MINIMUM |
| | 15 | 18 | 18 | 18 | 18 | 21 | MIDDLE |
| | 16 | 19 | 19 | 19 | 19 | 22 | MAXIMUM |

TABLE 15

| A | B | C | D | E | F | G | H |
|---|---|---|---|---|---|---|---|
| HEIGHT IN INCHES | 77.5" to 78" | | | | | | |
| HEIGHT IN FEET AND INCHES | 6' 5.5" to 6' 6" | | | | | | |
| CHEST SIZES | 34 | 35 | 36 | 37 | 38 | 39 | 40 |
| WEIGHT-MINIMUM | 135 | 143 | 151 | 159 | 167 | 175 | 183 |
| WEIGHT-MAXIMUM | 142 | 150 | 158 | 166 | 174 | 182 | 190 |
| SHIRT SLEEVE LENGTH | 35.187500 | 35.343750 | 35.500000 | 35.656250 | 35.812500 | 35.968750 | 36.125000 |
| PANT OUTSEAM LENGTH | 46.250 | 46.250 | 46.250 | 46.250 | 46.250 | 46.250 | 46.250 |
| PANT INSEAM LENGTH | 35.6250 | 35.4375 | 35.2500 | 35.0625 | 34.8750 | 34.6875 | 34.5000 |
| FOOT LENGTH | 12.375 | 12.375 | 12.375 | 12.375 | 12.375 | 12.375 | 12.375 |
| RELATED FOOT SIZE-MINIMUM | 13½ | 13½ | 13½ | 13½ | 13½ | 13½ | 13½ |
| RELATED FOOT SIZE-MIDDLE | 14 | 14 | 14 | 14 | 14 | 14 | 14 |
| RELATED FOOT SIZE-MAXIMUM | 14½ | 14½ | 14½ | 14½ | 14½ | 14½ | 14½ |
| HAND LENGTH | 8.875 | 8.875 | 8.875 | 8.875 | 8.875 | 8.875 | 8.875 |
| HEAD AND NECK LENGTH | 11.750 | 11.750 | 11.750 | 11.750 | 11.750 | 11.750 | 11.750 |
| HEAD CIRCUMFERENCE | 21.5000 | 21.6875 | 21.8750 | 22.0625 | 22.2500 | 22.4375 | 22.6250 |
| RELATED HAT SIZE | 6¾ | 6⅞ | 7 | 7⅛ | 7⅛ | 7¼ | 7¼ |
| HAND WIDTH□FOOT WIDTH-SAME | 3.750 | 3.750 | 3.750 | 3.750 | 4.250 | 4.250 | 4.250 |
| RELATED FOOT WIDTH | | | | A | A | C | C |
| | A | A | A | B | B | D | D |
| | 14.000 | 14.250 | 14.500 | 14.750 | 15.000 | 15.250 | 15.500 |
| NECK | 14.500 | 14.500 | 15.000 | 15.000 | 15.500 | 15.500 | 16.000 |
| WAIST-ATHLETIC | 25 | 26 | 27 | 29 | 30 | 31 | 32 |
| WAIST-TRIM | 26 | 27 | 28 | 30 | 31 | 32 | 33 |
| WAIST-AVERAGE | 27 | 26 | 29 | 31 | 32 | 33 | 34 |
| RING FINGER CIRCUMFERENCE | 1.500 | 1.500 | 1.500 | 1.500 | 2.000 | 2.000 | 2.250 |
| | 1.750 | 1.750 | 1.750 | 1.750 | 2.375 | 2.375 | 2.750 |
| RELATED RING SIZE | 1 | 1 | | | 5 | | 8 |
| | 2 | 2 | 3 | 3 | 6 | 9 | 10 |
| | 3 | 3 | 4 | 4 | 7 | 10 | 12 |

| A | I | J | K | L | M | N | O |
|---|---|---|---|---|---|---|---|
| HEIGHT IN INCHES | 77.5" to 78" | | | | | | |
| HEIGHT IN FEET AND INCHES | 6' 5.5" to 6' 6" | | | | | | |
| CHEST SIZES | 41 | 42 | 43 | 44 | 45 | 46 | 47 |
| WEIGHT-MINIMUM | 191 | 199 | 207 | 215 | 223 | 231 | 239 |
| WEIGHT-MAXIMUM | 198 | 206 | 214 | 222 | 230 | 238 | 246 |
| SHIRT SLEEVE LENGTH | 36.281250 | 36.437500 | 36.593750 | 36.750000 | 36.906250 | 37.062500 | 37.218750 |
| PANT OUTSEAM LENGTH | 46.250 | 46.250 | 46.250 | 46.250 | 46.250 | 46.250 | 46.250 |
| PANT INSEAM LENGTH | 34.3750 | 34.2500 | 34.1250 | 34.0000 | 33.8750 | 33.7500 | 33.6250 |
| FOOT LENGTH | 12.375 | 12.375 | 12.375 | 12.375 | 12.375 | 12.375 | 12.375 |
| RELATED FOOT SIZE-MINIMUM | 13½ | 13½ | 13½ | 13½ | 13½ | 13½ | 13½ |
| RELATED FOOT SIZE-MIDDLE | 14 | 14 | 14 | 14 | 14 | 14 | 14 |
| RELATED FOOT SIZE-MAXIMUM | 14½ | 14½ | 14½ | 14½ | 14½ | 14½ | 14½ |
| HAND LENGTH | 8.875 | 8.875 | 8.875 | 8.875 | 8.875 | 8.875 | 8.875 |
| HEAD AND NECK LENGTH | 11.750 | 11.750 | 11.750 | 11.750 | 11.750 | 11.750 | 11.750 |
| HEAD CIRCUMFERENCE | 22.8125 | 23.0000 | 23.1875 | 23.3750 | 23.5625 | 23.7500 | 23.9375 |
| RELATED HAT SIZE | 7⅜ | 7⅜ | 7½ | 7½ | 7⅝ | 7⅝ | 7¾ |
| HAND WIDTH□FOOT WIDTH-SAME | 4.250 | 4.500 | 4.500 | 4.500 | 4.750 | 4.750 | 4.750 |

TABLE 15-continued

| | | | | | | | |
|---|---|---|---|---|---|---|---|
| RELATED FOOT WIDTH | C | C | C | C | | | |
| | D | D | D | D | E | E | E |
| | 15.750 | 16.000 | 16.250 | 16.500 | 16.750 | 17.000 | 17.250 |
| NECK | 16.000 | 16.500 | 16.500 | 17.000 | 17.000 | 17.500 | 17.500 |
| WAIST-ATHLETIC | 33 | 34 | 35 | 37 | 39 | 40 | 41 |
| WAIST-TRIM | 34 | 35 | 36 | 38 | 40 | 41 | 42 |
| WAIST-AVERAGE | 35 | 36 | 37 | 39 | 41 | 42 | 43 |
| RING FINGER CIRCUMFERENCE | 2.250 | 2.250 | 2.250 | 2.375 | 2.375 | 2.375 | 2.375 |
| | 2.750 | 2.750 | 2.750 | 2.875 | 2.875 | 2.875 | 2.875 |
| RELATED RING SIZE | 8 | 8 | 8 | 12 | 12 | 12 | 12 |
| | 10 | 10 | 10 | 13 | 13 | 13 | 13 |
| | 12 | 12 | 12 | 14 | 14 | 14 | 14 |

| A | P | Q | R | S | T | U | V |
|---|---|---|---|---|---|---|---|
| HEIGHT IN INCHES | 77.5" to 78" | | | | | | |
| HEIGHT IN FEET AND INCHES | 6' 5.5" to 6' 6" | | | | | | |
| CHEST SIZES | 48 | 49 | 50 | 51 | 52 | 53 | 54 |
| WEIGHT-MINIMUM | 247 | 255 | 265 | 275 | 285 | 295 | 307 |
| WEIGHT-MAXIMUM | 254 | 264 | 274 | 284 | 294 | 306 | 319 |
| SHIRT SLEEVE LENGTH | 37.375000 | 37.531250 | 37.687500 | 37.843750 | 38.000000 | 38.156250 | 38.312500 |
| PANT OUTSEAM LENGTH | 46.250 | 46.250 | 46.250 | 46.250 | 46.250 | 46.250 | 46.250 |
| PANT INSEAM LENGTH | 33.5000 | 33.3125 | 33.1250 | 32.9375 | 32.7500 | 32.5625 | 32.3750 |
| FOOT LENGTH | 12.375 | 12.375 | 12.375 | 12.375 | 12.375 | 12.375 | 12.375 |
| RELATED FOOT SIZE-MINIMUM | 13½ | 13½ | 13½ | 13½ | 13½ | 13½ | 13½ |
| RELATED FOOT SIZE-MIDDLE | 14 | 14 | 14 | 14 | 14 | 14 | 14 |
| RELATED FOOT SIZE-MAXIMUM | 14½ | 14½ | 14½ | 14½ | 14½ | 14½ | 14½ |
| HAND LENGTH | 8.875 | 8.875 | 8.875 | 8.875 | 8.875 | 8.875 | 8.875 |
| HEAD AND NECK LENGTH | 11.750 | 11.750 | 11.750 | 11.750 | 11.750 | 11.750 | 11.750 |
| HEAD CIRCUMFERENCE | 24.1250 | 24.3125 | 24.5000 | 24.7500 | 25.0000 | 25.5000 | 25.5000 |
| RELATED HAT SIZE | 7¾ | 7⅞ | 7⅞ | 8 | 8 | 8¼ | 8¼ |
| HAND WIDTH□FOOT WIDTH-SAME | 4.750 | 5.000 | 5.000 | 5.000 | 5.000 | 5.250 | 5.250 |
| RELATED FOOT WIDTH | | | | | | | |
| | E | EE | EE | EE | EE | EE | EE |
| | 17.500 | 17.750 | 18.000 | 18.250 | 18.500 | 18.750 | 19.000 |
| NECK | 18.000 | 18.000 | 18.500 | 18.500 | 19.000 | 19.000 | 19.500 |
| WAIST-ATHLETIC | 42 | 43 | 44 | 45 | 46 | 47 | 48 |
| WAIST-TRIM | 43 | 44 | 45 | 46 | 47 | 48 | 49 |
| WAIST-AVERAGE | 44 | 45 | 46 | 47 | 48 | 49 | 50 |
| RING FINGER CIRCUMFERENCE | 2.500 | 2.500 | 2.500 | 2.500 | 2.750 | 2.750 | 2.750 |
| | 3.000 | 3.000 | 3.000 | 3.000 | 3.125 | 3.125 | 3.125 |
| RELATED RING SIZE | 13 | 13 | 13 | 13 | 14 | 14 | 14 |
| | 14 | 14 | 14 | 14 | 15 | 15 | 15 |
| | 15 | 15 | 15 | 15 | 16 | 16 | 16 |

| A | W | X | Y | Z | AA | AB | AC |
|---|---|---|---|---|---|---|---|
| HEIGHT IN INCHES | 77.5" to 78" | | | | | | |
| HEIGHT IN FEET AND INCHES | 6' 5.5" to 6' 6" | | | | | | |
| CHEST SIZES | 55 | 56 | 57 | 58 | 59 | 60 | TOLERENCE + OR − |
| WEIGHT-MINIMUM | 320 | 332 | 342 | 357 | 372 | 387 | |
| WEIGHT-MAXIMUM | 331 | 341 | 356 | 371 | 386 | 401 | +3 LBS −3 LBS |
| SHIRT SLEEVE LENGTH | 38.468750 | 38.625000 | 38.781250 | 38.937500 | 39.093750 | 39.250000 | +½" −½" |
| PANT OUTSEAM LENGTH | 46.250 | 46.250 | 46.250 | 46.250 | 46.250 | 46.250 | +½" −½" |
| PANT INSEAM LENGTH | 32.1875 | 32.0000 | 31.8125 | 31.6250 | 31.4375 | 31.2500 | +½" −½" |
| FOOT LENGTH | 12.375 | 12.375 | 12.375 | 12.375 | 12.375 | 12.375 | +5/16" −5/16" |
| RELATED FOOT SIZE-MINIMUM | 13½ | 13½ | 13½ | 13½ | 13½ | 13½ | MINIMUM |
| RELATED FOOT SIZE-MIDDLE | 14 | 14 | 14 | 14 | 14 | 14 | MIDDLE |
| RELATED FOOT SIZE-MAXIMUM | 14½ | 14½ | 14½ | 14½ | 14½ | 14½ | MAXIMUM |
| HAND LENGTH | 8.875 | 8.875 | 8.875 | 8.875 | 8.875 | 8.875 | +¼" −¼" |
| HEAD AND NECK LENGTH | 11.750 | 11.750 | 11.750 | 11.750 | 11.750 | 11.750 | +⅜" −⅜" |
| HEAD CIRCUMFERENCE | 26.0000 | 26.0000 | 26.5000 | 26.5000 | 27.0000 | 27.0000 | +⅜" −⅜" |
| RELATED HAT SIZE | 8½ | 8½ | 8¾ | 8¾ | 9 | 9 | +⅛" −⅛" |
| HAND WIDTH□FOOT WIDTH-SAME | 5.250 | 5.250 | 5.500 | 5.500 | 5.500 | 5.500 | +½" −½" |
| RELATED FOOT WIDTH | | | | | | | |
| | EEE | EEE | EEE | EEE | EEE | EEE | |
| | 19.250 | 19.500 | 19.750 | 20.000 | 20.250 | 20.5 | AVERAGE |
| NECK | 19.500 | 20.000 | 20.000 | 20.500 | 20.500 | 21 | FULL |
| WAIST-ATHLETIC | 47 | 50 | 57 | 56 | 57 | 58 | ATHLETIC |
| WAIST-TRIM | 49 | 52 | 56 | 57 | 58 | 59 | TRIM |
| WAIST-AVERAGE | 51 | 54 | 57 | 58 | 59 | 60 | AVERAGE |
| RING FINGER CIRCUMFERENCE | 2.750 | 3.000 | 3.000 | 3.000 | 3.000 | 3.500 | |
| | 3.125 | 3.250 | 3.250 | 3.250 | 3.250 | 4.000 | +½" −½" |
| RELATED RING SIZE | 14 | 17 | 17 | 17 | 17 | 20 | MINIMUM |
| | 15 | 18 | 18 | 18 | 18 | 21 | MIDDLE |
| | 16 | 19 | 19 | 19 | 19 | 22 | MAXIMUM |

TABLE 16

| A | B | C | D | E | F | G | H |
|---|---|---|---|---|---|---|---|
| HEIGHT IN INCHES | 78.5" to 79" | | | | | | |
| HEIGHT IN FEET AND INCHES | 6' 6.5" to 6' 7" | | | | | | |
| CHEST SIZES | 34 | 35 | 36 | 37 | 38 | 39 | 40 |
| WEIGHT-MINIMUM | 137 | 145 | 153 | 161 | 169 | 177 | 185 |
| WEIGHT-MAXIMUM | 144 | 152 | 160 | 168 | 176 | 184 | 192 |
| SHIRT SLEEVE LENGTH | 35.515625 | 35.671875 | 35.828125 | 35.984375 | 36.140625 | 36.296875 | 36.453125 |
| PANT OUTSEAM LENGTH | 46.875 | 46.875 | 46.875 | 46.875 | 46.875 | 46.875 | 46.875 |
| PANT INSEAM LENGTH | 35.8750 | 35.8675 | 35.5000 | 35.3125 | 35.1250 | 34.9375 | 34.7500 |
| FOOT LENGTH | 12.625 | 12.625 | 12.625 | 12.625 | 12.625 | 12.625 | 12.625 |
| RELATED FOOT SIZE-MINIMUM | 14½ | 14½ | 14½ | 14½ | 14½ | 14½ | 14½ |
| RELATED FOOT SIZE-MIDDLE | 15 | 15 | 15 | 15 | 15 | 15 | 15 |
| RELATED FOOT SIZE-MAXIMUM | 15½ | 15½ | 15½ | 15½ | 15½ | 15½ | 15½ |
| HAND LENGTH | 9.046875 | 9.046875 | 9.046875 | 9.046875 | 9.046875 | 9.046875 | 9.046875 |
| HEAD AND NECK LENGTH | 12.000 | 12.000 | 12.000 | 12.000 | 12.000 | 12.000 | 12.000 |
| HEAD CIRCUMFERENCE | 21.5000 | 21.6875 | 21.8750 | 22.0825 | 22.2500 | 22.4375 | 22.6250 |
| RELATED HAT SIZE | 6¾ | 6⅞ | 7 | 7⅛ | 7⅛ | 7¼ | 7¼ |
| HAND WIDTH□FOOT WIDTH-SAME | 3.750 | 3.750 | 3.750 | 3.750 | 4.250 | 4.250 | 4.250 |
| RELATED FOOT WIDTH | | | | A | A | C | C |
| | A | A | A | B | B | D | D |
| | 14.000 | 14.250 | 14.500 | 14.750 | 15.000 | 15.250 | 15.500 |
| NECK | 14.500 | 14.500 | 15.000 | 15.000 | 15.500 | 15.500 | 16.000 |
| WAIST-ATHLETIC | 25 | 26 | 27 | 29 | 30 | 31 | 32 |
| WAIST-TRIM | 26 | 27 | 28 | 30 | 31 | 32 | 33 |
| WAIST-AVERAGE | 27 | 28 | 29 | 31 | 32 | 33 | 34 |
| RING FINGER CIRCUMFERENCE | 1.500 | 1.500 | 1.500 | 1.500 | 2.000 | 2.000 | 2.250 |
| | 1.750 | 1.750 | 1.750 | 1.750 | 2.375 | 2.375 | 2.750 |
| RELATED RING SIZE | 1 | 1 | | | 5 | | 8 |
| | 2 | 2 | 3 | 3 | 6 | 9 | 10 |
| | 3 | 3 | 4 | 4 | 7 | 10 | 12 |

| A | I | J | K | L | M | N | O |
|---|---|---|---|---|---|---|---|
| HEIGHT IN INCHES | 78.5" to 79" | | | | | | |
| HEIGHT IN FEET AND INCHES | 6' 6.5" to 6' 7" | | | | | | |
| CHEST SIZES | 41 | 42 | 43 | 44 | 45 | 46 | 47 |
| WEIGHT-MINIMUM | 193 | 201 | 209 | 217 | 225 | 233 | 241 |
| WEIGHT-MAXIMUM | 200 | 208 | 216 | 224 | 232 | 240 | 248 |
| SHIRT SLEEVE LENGTH | 36.609375 | 36.765625 | 36.921875 | 37.078125 | 37.234375 | 37.390625 | 37.546875 |
| PANT OUTSEAM LENGTH | 46.875 | 46.875 | 46.875 | 46.875 | 46.875 | 46.875 | 46.875 |
| PANT INSEAM LENGTH | 34.6250 | 34.5000 | 34.3750 | 34.2500 | 34.1250 | 34.0000 | 33.8750 |
| FOOT LENGTH | 12.625 | 12.625 | 12.625 | 12.625 | 12.625 | 12.625 | 12.625 |
| RELATED FOOT SIZE-MINIMUM | 14½ | 14½ | 14½ | 14½ | 14½ | 14½ | 14½ |
| RELATED FOOT SIZE-MIDDLE | 15 | 15 | 15 | 15 | 15 | 15 | 15 |
| RELATED FOOT SIZE-MAXIMUM | 15½ | 15½ | 15½ | 15½ | 15½ | 15½ | 15½ |
| HAND LENGTH | 9.046875 | 9.046875 | 9.046875 | 9.046875 | 9.046875 | 9.046875 | 9.046875 |
| HEAD AND NECK LENGTH | 12.000 | 12.000 | 12.000 | 12.000 | 12.000 | 12.000 | 12.000 |
| HEAD CIRCUMFERENCE | 22.8125 | 23.0000 | 23.1875 | 23.3750 | 23.5625 | 23.7500 | 23.9375 |
| RELATED HAT SIZE | 7⅜ | 7⅜ | 7½ | 7½ | 7⅝ | 7⅝ | 7¾ |
| HAND WIDTH□FOOT WIDTH-SAME | 4.250 | 4.500 | 4.500 | 4.500 | 4.750 | 4.750 | 4.750 |
| RELATED FOOT WIDTH | C | C | C | C | | | |
| | D | D | D | D | E | E | E |
| | 15.750 | 16.000 | 16.250 | 16.500 | 16.750 | 17.000 | 17.250 |
| NECK | 16.000 | 16.500 | 16.500 | 17.000 | 17.000 | 17.500 | 17.500 |
| WAIST-ATHLETIC | 33 | 34 | 35 | 37 | 39 | 40 | 41 |
| WAIST-TRIM | 34 | 35 | 36 | 38 | 40 | 41 | 42 |
| WAIST-AVERAGE | 35 | 36 | 37 | 39 | 41 | 42 | 43 |
| RING FINGER CIRCUMFERENCE | 2.250 | 2.250 | 2.250 | 2.375 | 2.375 | 2.375 | 2.375 |
| | 2.750 | 2.750 | 2.750 | 2.875 | 2.875 | 2.875 | 2.875 |
| RELATED RING SIZE | 8 | 8 | 8 | 12 | 12 | 12 | 12 |
| | 10 | 10 | 10 | 13 | 13 | 13 | 13 |
| | 12 | 12 | 12 | 14 | 14 | 14 | 14 |

| A | P | Q | R | S | T | U | V |
|---|---|---|---|---|---|---|---|
| HEIGHT IN INCHES | 78.5" to 79" | | | | | | |
| HEIGHT IN FEET AND INCHES | 6' 6.5" to 6' 7" | | | | | | |
| CHEST SIZES | 48 | 49 | 50 | 51 | 52 | 53 | 54 |
| WEIGHT-MINIMUM | 249 | 257 | 267 | 277 | 287 | 297 | 309 |
| WEIGHT-MAXIMUM | 256 | 266 | 276 | 286 | 296 | 308 | 321 |
| SHIRT SLEEVE LENGTH | 37.703125 | 37.859375 | 38.015825 | 38.171875 | 38.328125 | 38.484375 | 38.640625 |
| PANT OUTSEAM LENGTH | 46.875 | 46.875 | 46.875 | 46.875 | 46.875 | 46.875 | 46.875 |
| PANT INSEAM LENGTH | 33.7500 | 33.5825 | 33.3750 | 33.1875 | 33.0000 | 32.8125 | 32.6250 |
| FOOT LENGTH | 12.625 | 12.625 | 12.625 | 12.625 | 12.625 | 12.625 | 12.625 |
| RELATED FOOT SIZE-MINIMUM | 14½ | 14½ | 14½ | 14½ | 14½ | 14½ | 14½ |
| RELATED FOOT SIZE-MIDDLE | 15 | 15 | 15 | 15 | 15 | 15 | 15 |
| RELATED FOOT SIZE-MAXIMUM | 15½ | 15½ | 15½ | 15½ | 15½ | 15½ | 15½ |
| HAND LENGTH | 9.046875 | 9.046875 | 9.046875 | 9.046875 | 9.046875 | 9.046875 | 9.046875 |

TABLE 16-continued

| | | | | | | | |
|---|---|---|---|---|---|---|---|
| HEAD AND NECK LENGTH | 12.000 | 12.000 | 12.000 | 12.000 | 12.000 | 12.000 | 12.000 |
| HEAD CIRCUMFERENCE | 24.1250 | 24.3125 | 24.5000 | 24.7500 | 25.0000 | 25.5000 | 25.5000 |
| RELATED HAT SIZE | 7¾ | 7⅞ | 7⅞ | 8 | 8 | 8¼ | 8¼ |
| HAND WIDTH□FOOT WIDTH-SAME | 4.750 | 5.000 | 5.000 | 5.000 | 5.000 | 5.250 | 5.250 |
| RELATED FOOT WIDTH | | | | | | | |
| | E | EE | EE | EE | EE | EE | EE |
| | 17.500 | 17.750 | 18.000 | 18.250 | 18.500 | 18.750 | 19.000 |
| NECK | 18.000 | 18.000 | 18.500 | 18.500 | 19.000 | 19.000 | 19.500 |
| WAIST-ATHLETIC | 42 | 43 | 44 | 45 | 46 | 47 | 48 |
| WAIST-TRIM | 43 | 44 | 45 | 46 | 47 | 48 | 49 |
| WAIST-AVERAGE | 44 | 45 | 46 | 47 | 48 | 49 | 50 |
| RING FINGER CIRCUMFERENCE | 2.500 | 2.500 | 2.500 | 2.500 | 2.750 | 2.750 | 2.750 |
| | 3.000 | 3.000 | 3.000 | 3.000 | 3.125 | 3.125 | 3.125 |
| RELATED RING SIZE | 13 | 13 | 13 | 13 | 14 | 14 | 14 |
| | 14 | 14 | 14 | 14 | 15 | 15 | 15 |
| | 15 | 15 | 15 | 15 | 16 | 16 | 16 |

| A | W | X | Y | Z | AA | AB | AC |
|---|---|---|---|---|---|---|---|
| HEIGHT IN INCHES | 78.5" to 79" | | | | | | |
| HEIGHT IN FEET AND INCHES | 6' 6.5" to 6' 7" | | | | | | |
| CHEST SIZES | 55 | 56 | 57 | 58 | 59 | 60 | TOLERENCE + OR − |
| WEIGHT-MINIMUM | 322 | 334 | 344 | 359 | 374 | 389 | |
| WEIGHT-MAXIMUM | 333 | 343 | 358 | 373 | 388 | 403 | +3 LBS −3 LBS |
| SHIRT SLEEVE LENGTH | 38.796875 | 38.953125 | 39.109375 | 39.265625 | 39.421875 | 39.578125 | +½" −½" |
| PANT OUTSEAM LENGTH | 46.875 | 46.875 | 46.875 | 46.875 | 46.875 | 46.875 | +½" −½" |
| PANT INSEAM LENGTH | 32.4375 | 32.2500 | 32.0625 | 31.8750 | 31.6875 | 31.5000 | +½" −½" |
| FOOT LENGTH | 12.625 | 12.625 | 12.625 | 12.625 | 12.625 | 12.625 | +5/16" −5/16" |
| RELATED FOOT SIZE-MINIMUM | 14½ | 14½ | 14½ | 14½ | 14½ | 14½ | MINIMUM |
| RELATED FOOT SIZE-MIDDLE | 15 | 15 | 15 | 15 | 15 | 15 | MIDDLE |
| RELATED FOOT SIZE-MAXIMUM | 15½ | 15½ | 15½ | 15½ | 15½ | 15½ | MAXIMUM |
| HAND LENGTH | 9.046875 | 9.046875 | 9.046875 | 9.046875 | 9.046875 | 9.046875 | +¼" −¼" |
| HEAD AND NECK LENGTH | 12.000 | 12.000 | 12.000 | 12.000 | 12.000 | 12.000 | +⅜" −⅜" |
| HEAD CIRCUMFERENCE | 26.0000 | 26.0000 | 26.5000 | 26.5000 | 27.0000 | 27.0000 | +⅜" −⅜" |
| RELATED HAT SIZE | 8½ | 8½ | 8¾ | 8¾ | 9 | 9 | +⅛" −⅛" |
| HAND WIDTH□FOOT WIDTH-SAME | 5.250 | 5.250 | 5.500 | 5.500 | 5.500 | 5.500 | +½" −½" |
| RELATED FOOT WIDTH | | | | | | | |
| | EEE | EEE | EEE | EEE | EEE | EEE | |
| | 19.250 | 19.500 | 19.750 | 20.000 | 20.250 | 20.5 | AVERAGE |
| NECK | 19.500 | 20.000 | 20.000 | 20.500 | 20.500 | 21 | FULL |
| WAIST-ATHLETIC | 47 | 50 | 57 | 56 | 57 | 58 | ATHLETIC |
| WAIST-TRIM | 49 | 52 | 56 | 57 | 58 | 59 | TRIM |
| WAIST-AVERAGE | 51 | 54 | 57 | 58 | 59 | 60 | AVERAGE |
| RING FINGER CIRCUMFERENCE | 2.750 | 3.000 | 3.000 | 3.000 | 3.000 | 3.500 | |
| | 3.125 | 3.250 | 3.250 | 3.250 | 3.250 | 4.000 | +½" −½" |
| RELATED RING SIZE | 14 | 17 | 17 | 17 | 17 | 20 | MINIMUM |
| | 15 | 18 | 18 | 18 | 18 | 21 | MIDDLE |
| | 16 | 19 | 19 | 19 | 19 | 22 | MAXIMUM |

TABLE 17

| A | B | C | D | E | F | G | H |
|---|---|---|---|---|---|---|---|
| HEIGHT IN INCHES | 79.5" to 80" | | | | | | |
| HEIGHT IN FEET AND INCHES | 6' 6.5" to 6' 8" | | | | | | |
| CHEST SIZES | 34 | 35 | 36 | 37 | 38 | 39 | 40 |
| WEIGHT-MINIMUM | 139 | 147 | 155 | 163 | 171 | 179 | 187 |
| WEIGHT-MAXIMUM | 146 | 154 | 162 | 170 | 178 | 186 | 194 |
| SHIRT SLEEVE LENGTH | 35.843750 | 38.000000 | 36.156250 | 36.312500 | 36.468750 | 36.625000 | 36.781250 |
| PANT OUTSEAM LENGTH | 47.500 | 47.500 | 47.500 | 47.500 | 47.500 | 47.500 | 47.500 |
| PANT INSEAM LENGTH | 36.1250 | 35.9375 | 35.7500 | 35.5625 | 35.3750 | 35.1875 | 35.0000 |
| FOOT LENGTH | 12.75 | 12.75 | 12.75 | 12.75 | 12.75 | 12.75 | 12.75 |
| RELATED FOOT SIZE-MINIMUM | 15½ | 15½ | 15½ | 15½ | 15½ | 15½ | 15½ |
| RELATED FOOT SIZE-MIDDLE | 16 | 16 | 16 | 16 | 16 | 16 | 16 |
| RELATED FOOT SIZE-MAXIMUM | 16½ | 16½ | 16½ | 16½ | 16½ | 16½ | 16½ |
| HAND LENGTH | 9.21875 | 9.21875 | 9.21875 | 9.21875 | 9.21875 | 9.21875 | 9.21875 |
| HEAD AND NECK LENGTH | 12.250 | 12.250 | 12.250 | 12.250 | 12.250 | 12.250 | 12.250 |
| HEAD CIRCUMFERENCE | 21.5000 | 21.6875 | 21.8750 | 22.0625 | 22.2500 | 22.4375 | 22.6250 |
| RELATED HAT SIZE | 6¾ | 6⅞ | 7 | 7⅛ | 7⅛ | 7¼ | 7¼ |
| HAND WIDTH□FOOT WIDTH-SAME | 3.750 | 3.750 | 3.750 | 3.750 | 4.250 | 4.250 | 4.250 |
| RELATED FOOT WIDTH | | | | A | A | C | C |
| | A | A | A | B | B | D | D |
| | 14.000 | 14.250 | 14.500 | 14.750 | 15.000 | 15.250 | 15.500 |
| NECK | 14.500 | 14.500 | 15.000 | 15.000 | 15.500 | 15.500 | 16.000 |
| WAIST-ATHLETIC | 25 | 26 | 27 | 29 | 30 | 31 | 32 |

TABLE 17-continued

| | | | | | | | |
|---|---|---|---|---|---|---|---|
| WAIST-TRIM | 26 | 27 | 28 | 30 | 31 | 32 | 33 |
| WAIST-AVERAGE | 27 | 28 | 29 | 31 | 32 | 33 | 34 |
| RING FINGER CIRCUMFERENCE | 1.500 | 1.500 | 1.500 | 1.500 | 2.000 | 2.000 | 2.250 |
| | 1.750 | 1.750 | 1.750 | 1.750 | 2.375 | 2.375 | 2.750 |
| RELATED RING SIZE | 1 | 1 | | | 5 | | 8 |
| | 2 | 2 | 3 | 3 | 6 | 9 | 10 |
| | 3 | 3 | 4 | 4 | 7 | 10 | 12 |

| A | I | J | K | L | M | N | O |
|---|---|---|---|---|---|---|---|
| HEIGHT IN INCHES | 79.5" to 80" | | | | | | |
| HEIGHT IN FEET AND INCHES | 6' 6.5" to 6' 8" | | | | | | |
| CHEST SIZES | 41 | 42 | 43 | 44 | 45 | 46 | 47 |
| WEIGHT-MINIMUM | 195 | 203 | 211 | 219 | 227 | 235 | 243 |
| WEIGHT-MAXIMUM | 202 | 210 | 218 | 226 | 234 | 242 | 250 |
| SHIRT SLEEVE LENGTH | 36.937500 | 37.093750 | 37.250000 | 37.406250 | 37.562500 | 37.718750 | 37.875000 |
| PANT OUTSEAM LENGTH | 47.500 | 47.500 | 47.500 | 47.500 | 47.500 | 47.500 | 47.500 |
| PANT INSEAM LENGTH | 34.8750 | 34.7500 | 34.6250 | 34.5000 | 34.3750 | 34.2500 | 34.1250 |
| FOOT LENGTH | 12.75 | 12.75 | 12.75 | 12.75 | 12.75 | 12.75 | 12.75 |
| RELATED FOOT SIZE-MINIMUM | 15½ | 15½ | 15½ | 15½ | 15½ | 15½ | 15½ |
| RELATED FOOT SIZE-MIDDLE | 16 | 16 | 16 | 16 | 16 | 16 | 16 |
| RELATED FOOT SIZE-MAXIMUM | 16½ | 16½ | 16½ | 16½ | 16½ | 16½ | 16½ |
| HAND LENGTH | 9.21875 | 9.21875 | 9.21875 | 9.21875 | 9.21875 | 9.21875 | 9.21875 |
| HEAD AND NECK LENGTH | 12.250 | 12.250 | 12.250 | 12.250 | 12.250 | 12.250 | 12.250 |
| HEAD CIRCUMFERENCE | 22.8125 | 23.0000 | 23.1875 | 23.3750 | 23.5625 | 23.7500 | 23.9375 |
| RELATED HAT SIZE | 7⅜ | 7⅜ | 7½ | 7½ | 7⅝ | 7⅝ | 7¾ |
| HAND WIDTH□FOOT WIDTH-SAME | 4.250 | 4.500 | 4.500 | 4.500 | 4.750 | 4.750 | 4.750 |
| RELATED FOOT WIDTH | C | C | C | C | | | |
| | D | D | D | D | E | E | E |
| | 15.750 | 16.000 | 16.250 | 16.500 | 16.750 | 17.000 | 17.250 |
| NECK | 16.000 | 16.500 | 16.500 | 17.000 | 17.000 | 17.500 | 17.500 |
| WAIST-ATHLETIC | 33 | 34 | 35 | 37 | 39 | 40 | 41 |
| WAIST-TRIM | 34 | 35 | 36 | 38 | 40 | 41 | 42 |
| WAIST-AVERAGE | 35 | 36 | 37 | 39 | 41 | 42 | 43 |
| RING FINGER CIRCUMFERENCE | 2.250 | 2.250 | 2.250 | 2.375 | 2.375 | 2.375 | 2.375 |
| | 2.750 | 2.750 | 2.750 | 2.875 | 2.875 | 2.875 | 2.875 |
| RELATED RING SIZE | 8 | 8 | 8 | 12 | 12 | 12 | 12 |
| | 10 | 10 | 10 | 13 | 13 | 13 | 13 |
| | 12 | 12 | 12 | 14 | 14 | 14 | 14 |

| A | P | Q | R | S | T | U | V |
|---|---|---|---|---|---|---|---|
| HEIGHT IN INCHES | 79.5" to 80" | | | | | | |
| HEIGHT IN FEET AND INCHES | 6' 6.5" to 6' 8" | | | | | | |
| CHEST SIZES | 48 | 49 | 50 | 51 | 52 | 53 | 54 |
| WEIGHT-MINIMUM | 251 | 259 | 269 | 279 | 289 | 299 | 311 |
| WEIGHT-MAXIMUM | 258 | 268 | 278 | 288 | 298 | 310 | 323 |
| SHIRT SLEEVE LENGTH | 38.031250 | 38.187500 | 38.343750 | 38.500000 | 38.656250 | 38.812500 | 38.968750 |
| PANT OUTSEAM LENGTH | 47.500 | 47.500 | 47.500 | 47.500 | 47.500 | 47.500 | 47.500 |
| PANT INSEAM LENGTH | 34.0000 | 33.8125 | 33.6250 | 33.4375 | 33.2500 | 33.0625 | 32.8750 |
| FOOT LENGTH | 12.75 | 12.75 | 12.75 | 12.75 | 12.75 | 12.75 | 12.75 |
| RELATED FOOT SIZE-MINIMUM | 15½ | 15½ | 15½ | 15½ | 15½ | 15½ | 15½ |
| RELATED FOOT SIZE-MIDDLE | 16 | 16 | 16 | 16 | 16 | 16 | 16 |
| RELATED FOOT SIZE-MAXIMUM | 16½ | 16½ | 16½ | 16½ | 16½ | 16½ | 16½ |
| HAND LENGTH | 9.21875 | 9.21875 | 9.21875 | 9.21875 | 9.21875 | 9.21875 | 9.21875 |
| HEAD AND NECK LENGTH | 12.250 | 12.250 | 12.250 | 12.250 | 12.250 | 12.250 | 12.250 |
| HEAD CIRCUMFERENCE | 24.1250 | 24.3125 | 24.5000 | 24.7500 | 25.0000 | 25.5000 | 25.5000 |
| RELATED HAT SIZE | 7¾ | 7⅞ | 7⅞ | 8 | 8 | 8¼ | 8¼ |
| HAND WIDTH□FOOT WIDTH-SAME | 4.750 | 5.000 | 5.000 | 5.000 | 5.000 | 5.250 | 5.250 |
| RELATED FOOT WIDTH | | | | | | | |
| | E | EE | EE | EE | EE | EE | EE |
| | 17.500 | 17.750 | 18.000 | 18.250 | 18.500 | 18.750 | 19.000 |
| NECK | 18.000 | 18.000 | 18.500 | 18.500 | 19.000 | 19.000 | 19.500 |
| WAIST-ATHLETIC | 42 | 43 | 44 | 45 | 46 | 47 | 48 |
| WAIST-TRIM | 43 | 44 | 45 | 46 | 47 | 48 | 49 |
| WAIST-AVERAGE | 44 | 45 | 46 | 47 | 48 | 49 | 50 |
| RING FINGER CIRCUMFERENCE | 2.500 | 2.500 | 2.500 | 2.500 | 2.750 | 2.750 | 2.750 |
| | 3.000 | 3.000 | 3.000 | 3.000 | 3.125 | 3.125 | 3.125 |
| RELATED RING SIZE | 13 | 13 | 13 | 13 | 14 | 14 | 14 |
| | 14 | 14 | 14 | 14 | 15 | 15 | 15 |
| | 15 | 15 | 15 | 15 | 16 | 16 | 16 |

| A | W | X | Y | Z | AA | AB | AC |
|---|---|---|---|---|---|---|---|
| HEIGHT IN INCHES | 79.5" to 80" | | | | | | |
| HEIGHT IN FEET AND INCHES | 6' 6.5" to 6' 8" | | | | | | |
| CHEST SIZES | 55 | 56 | 57 | 58 | 59 | 60 | TOLERENCE + OR − |
| WEIGHT-MINIMUM | 324 | 336 | 346 | 361 | 376 | 391 | |

TABLE 17-continued

| | | | | | | | |
|---|---|---|---|---|---|---|---|
| WEIGHT-MAXIMUM | 335 | 345 | 360 | 375 | 390 | 405 | +3 LBS −3 LBS |
| SHIRT SLEEVE LENGTH | 39.125000 | 39.281250 | 39.437500 | 39.593750 | 39.750000 | 39.906250 | +½" −½" |
| PANT OUTSEAM LENGTH | 47.500 | 47.500 | 47.500 | 47.500 | 47.500 | 47.500 | +½" −½" |
| PANT INSEAM LENGTH | 32.6875 | 32.5000 | 32.3125 | 32.1250 | 31.9375 | 31.7500 | +½" −½" |
| FOOT LENGTH | 12.75 | 12.75 | 12.75 | 12.75 | 12.75 | 12.75 | +5/16" −5/16" |
| RELATED FOOT SIZE-MINIMUM | 15½ | 15½ | 15½ | 15½ | 15½ | 15½ | MINIMUM |
| RELATED FOOT SIZE-MIDDLE | 16 | 16 | 16 | 16 | 16 | 16 | MIDDLE |
| RELATED FOOT SIZE-MAXIMUM | 16½ | 16½ | 16½ | 16½ | 16½ | 16½ | MAXIMUM |
| HAND LENGTH | 9.21875 | 9.21875 | 9.21875 | 9.21875 | 9.21875 | 9.21875 | +¼" −¼" |
| HEAD AND NECK LENGTH | 12.250 | 12.250 | 12.250 | 12.250 | 12.250 | 12.250 | +⅜" −⅜" |
| HEAD CIRCUMFERENCE | 26.0000 | 26.0000 | 26.5000 | 26.5000 | 27.0000 | 27.0000 | +⅜" −⅜" |
| RELATED HAT SIZE | 8½ | 8½ | 8¾ | 8¾ | 9 | 9 | +⅛" −⅛" |
| HAND WIDTH□FOOT WIDTH-SAME | 5.250 | 5.250 | 5.500 | 5.500 | 5.500 | 5.500 | +½" −½" |
| RELATED FOOT WIDTH | | | | | | | |
| | EEE | EEE | EEE | EEE | EEE | EEE | |
| | 19.250 | 19.500 | 19.750 | 20.000 | 20.250 | 20.5 | AVERAGE |
| NECK | 19.500 | 20.000 | 20.000 | 20.500 | 20.500 | 21 | FULL |
| WAIST-ATHLETIC | 47 | 50 | 57 | 56 | 57 | 58 | ATHLETIC |
| WAIST-TRIM | 49 | 52 | 56 | 57 | 58 | 59 | TRIM |
| WAIST-AVERAGE | 51 | 54 | 57 | 58 | 59 | 60 | AVERAGE |
| RING FINGER CIRCUMFERENCE | 2.750 | 3.000 | 3.000 | 3.000 | 3.000 | 3.500 | |
| | 3.125 | 3.250 | 3.250 | 3.250 | 3.250 | 4.000 | +½" −½" |
| RELATED RING SIZE | 14 | 17 | 17 | 17 | 17 | 20 | MINIMUM |
| | 15 | 18 | 18 | 18 | 18 | 21 | MIDDLE |
| | 16 | 19 | 19 | 19 | 19 | 22 | MAXIMUM |

TABLE 18

Weights

| | | CHEST SIZES | | | | | | |
|---|---|---|---|---|---|---|---|---|
| | | 36 | 37 | 38 | 39 | 40 | 41 | 42 |
| S | 5' 4" to 5" 5" | 122 | 133 | 141 | 149 | 156 | 166 | 173 |
| | | 132 | 140 | 148 | 155 | 165 | 172 | 182 |
| SHORT | 5' 6" to 5' 7" | 126 | 137 | 145 | 153 | 160 | 170 | 177 |
| | | 136 | 144 | 152 | 159 | 169 | 176 | 186 |
| R | 5' 7½" to 5' 8" | 128 | 139 | 147 | 155 | 162 | 172 | 179 |
| | | 138 | 146 | 154 | 161 | 171 | 178 | 188 |
| REGULAR | 5' 8½" to 5' 9" | 130 | 141 | 149 | 157 | 164 | 174 | 181 |
| | | 140 | 148 | 156 | 163 | 173 | 180 | 190 |
| | 5' 9½" to 5' 10" | 132 | 143 | 151 | 159 | 166 | 176 | 183 |
| | | 142 | 150 | 158 | 165 | 175 | 182 | 192 |
| | 5' 10½" to 5' 11" | 134 | 145 | 153 | 161 | 168 | 178 | 185 |
| | | 144 | 152 | 160 | 167 | 177 | 184 | 194 |
| T | 5' 11½" to 6' | | | 155 | 163 | 170 | 180 | 187 |
| | | | | 162 | 169 | 179 | 186 | 196 |
| TALL | 6' ½" to 6' 1" | | | 157 | 165 | 172 | 182 | 189 |
| | | | | 164 | 171 | 181 | 188 | 198 |
| | 6' 1½" to 6' 2" | | | | 167 | 174 | 184 | 191 |
| | | | | | 173 | 183 | 190 | 200 |
| | 6' 2½" to 6' 3" | | | | 169 | 176 | 186 | 193 |
| | | | | | 175 | 185 | 192 | 202 |
| XT | 6' 3½" to 6' 4" | | | | | | | 195 |
| | | | | | | | | 204 |
| EXTRA TALL | 6' 4½" to 6' 5" | | | | | | | 197 |
| | | | | | | | | 206 |
| | 6' 5½" to 6' 6" | | | | | | | 199 |
| | | | | | | | | 208 |
| | 6' 7" to 6' 8" | | | | | | | |

| | | CHEST SIZES | | | | | |
|---|---|---|---|---|---|---|---|
| | | 43 | 44 | 46 | 48 | 50 | 52 |
| S | 5' 4" to 5" 5" | 183 | 191 | | | | |
| | | 190 | 204 | | | | |
| SHORT | 5' 6" to 5' 7" | 187 | 195 | | | | |
| | | 194 | 208 | | | | |
| R | 5' 7½" to 5' 8" | 189 | 197 | 211 | | | |
| | | 196 | 210 | 226 | | | |
| REGULAR | 5' 8½" to 5' 9" | 191 | 199 | 213 | 229 | 247 | 264 |
| | | 198 | 212 | 228 | 246 | 263 | 278 |
| | 5' 9½" to 5' 10" | 193 | 201 | 215 | 231 | 249 | 266 |
| | | 200 | 214 | 230 | 248 | 265 | 280 |

TABLE 18-continued

| | | Weights | | | | | |
|---|---|---|---|---|---|---|---|
| | 5' 10½" to 5' 11" | 195 | 203 | 217 | 233 | 251 | 268 |
| | | 202 | 216 | 232 | 250 | 267 | 282 |
| T | 5' 11½" to 6' | 197 | 205 | 219 | 235 | 253 | 270 |
| | | 204 | 218 | 234 | 252 | 269 | 284 |
| TALL | 6' ½" to 6' 1" | 199 | 207 | 221 | 237 | 255 | 272 |
| | | 206 | 220 | 236 | 254 | 271 | 286 |
| | 6' 1½" to 6' 2" | 201 | 209 | 223 | 239 | 257 | 274 |
| | | 208 | 222 | 238 | 256 | 273 | 288 |
| | 6' 2½" to 6' 3" | 203 | 211 | 225 | 241 | 259 | 276 |
| | | 210 | 224 | 240 | 258 | 275 | 290 |
| XT | 6' 3½" to 6' 4" | 205 | 213 | 227 | 243 | 261 | 278 |
| | | 212 | 226 | 242 | 260 | 277 | 292 |
| EXTRA TALL | 6' 4½" to 6' 5" | 207 | 215 | 229 | 245 | 263 | 280 |
| | | 214 | 228 | 244 | 262 | 279 | 294 |
| | 6' 5½" to 6' 6" | 209 | 217 | 231 | 247 | 265 | 282 |
| | | 216 | 230 | 246 | 264 | 281 | 296 |
| | 6' 7" to 6' 8" | | | 235 | 251 | 269 | 286 |
| | | | | 250 | 268 | 285 | 300 |

TABLE 19

| | | Sportswear Size | | | | | | |
|---|---|---|---|---|---|---|---|---|
| | | CHEST SIZES | | | | | | |
| | | 36 | 37 | 38 | 39 | 40 | 41 | 42 |
| S | 5' 4" to 5" 5" | S-S | S-S | M-S | M-S | M-S | M-S | L-S |
| SHORT | 5' 6" to 5' 7" | S-S | S-S | M-S | M-S | M-S | M-S | L-S |
| R | 5' 7½" to 5' 8" | S-R | S-R | M-R | M-R | M-R | M-R | L-R |
| REGULAR | 5' 8½" to 5' 9" | S-R | S-R | M-R | M-R | M-R | M-R | L-R |
| | 5' 9½" to 5' 10" | S-R | S-R | M-R | M-R | M-R | M-R | L-R |
| | 5' 10½" to 5' 11" | S-R | S-R | M-R | M-R | M-R | M-R | L-R |
| T | 5' 11½" to 6' | | | M-T | M-T | M-T | M-T | L-T |
| TALL | 6' ½" to 6' 1" | | | M-T | M-T | M-T | M-T | L-T |
| | 6' 1½" to 6' 2" | | | | M-T | M-T | M-T | L-T |
| | 6' 2½" to 6' 3" | | | | M-T | M-T | M-T | L-T |
| XT | 6' 3½" to 6' 4" | | | | | | | L-XT |
| EXTRA TALL | 6' 4½" to 6' 5" | | | | | | | L-XT |
| | 6' 5½" to 6' 6" | | | | | | | L-XT |
| | 6' 7" to 6' 8" | | | | | | | |

| | | CHEST SIZES | | | | | |
|---|---|---|---|---|---|---|---|
| | | 43 | 44 | 46 | 48 | 50 | 52 |
| S | 5' 4" to 5" 5" | L-S | L-S | | | | |
| SHORT | 5' 6" to 5' 7" | L-S | L-S | | | | |
| R | 5' 7½" to 5' 8" | L-R | L-R | XL-R | XL-R | XXL-R | 2X-R |
| REGULAR | 5' 8½" to 5' 9" | L-R | L-R | XL-R | XL-R | XXL-R | 2X-R |
| | 5' 9½" to 5' 10" | L-R | L-R | XL-R | XL-R | XXL-R | 2X-R |
| | 5' 10½" to 5' 11" | L-R | L-R | XL-R | XL-R | XXL-R | 2X-R |
| T | 5' 11½" to 6' | L-T | L-T | XL-T | XL-T | XXL-T | 2X-T |
| TALL | 6' ½" to 6' 1" | L-T | L-T | XL-T | XL-T | XXL-T | 2X-T |
| | 6' 1½" to 6' 2" | L-T | L-T | XL-T | XL-T | XXL-T | 2X-T |
| | 6' 2½" to 6' 3" | L-T | L-T | XL-T | XL-T | XXL-T | 2X-T |
| XT | 6' 3½" to 6' 4" | L-XT | L-XT | XL-XT | XL-XT | XXL-XT | 2X-XT |
| EXTRA TALL | 6' 4½" to 6' 5" | L-XT | L-XT | XL-XT | XL-XT | XXL-XT | 2X-XT |
| | 6' 5½" to 6' 6" | L-XT | L-XT | XL-XT | XL-XT | XXL-XT | 2X-XT |
| | 6' 7" to 6' 8" | | | XL-XT | XL-XT | XXL-XT | 2X-XT |

LEGEND
S—SMALL
M—MEDIUM
L—LARGE
XL—EXTRA LARGE
2X—BIG MEN
S—SHORT
R—REGULAR
T—TALL
XT—EXTRA TALL

TABLE 20

Sleeve Length

| | | CHEST SIZES | | | | | | |
|---|---|---|---|---|---|---|---|---|
| | | 36 | 37 | 38 | 39 | 40 | 41 | 42 |
| S | 5' 4" to 5" 5" | 31 | 31 | 31 | 31 | 31 | 31 | 32 |
| | | 32 | 32 | 32 | 32 | 32 | 32 | 33 |
| SHORT | 5' 6" to 5' 7" | 32 | 32 | 32 | 32 | 32 | 32 | 32 |
| | | 33 | 33 | 33 | 33 | 33 | 33 | 33 |
| R | 5' 7½" to 5' 8" | 32 | 32 | 32 | 32 | 32 | 32 | 32 |
| | | 33 | 33 | 33 | 33 | 33 | 33 | 33 |
| REGULAR | 5' 8½" to 5' 9" | 32 | 33 | 33 | 33 | 33 | 33 | 33 |
| | | 33 | 34 | 34 | 34 | 34 | 34 | 34 |
| | 5' 9½" to 5' 10" | 33 | 33 | 33 | 33 | 33 | 33 | 33 |
| | | 34 | 34 | 34 | 34 | 34 | 34 | 34 |
| | 5' 10½" to 5' 11" | 33 | 33 | 33 | 33 | 33 | 33 | 34 |
| | | 34 | 34 | 34 | 34 | 34 | 34 | 35 |
| T | 5' 11½" to 6' | 33 | 33 | 33 | 33 | 34 | 34 | 34 |
| | | 34 | 34 | 34 | 34 | 35 | 35 | 35 |
| | 6' ½" to 6' 1" | | | 34 | 34 | 34 | 34 | 34 |
| | | | | 35 | 35 | 35 | 35 | 35 |
| TALL | 6' 1½" to 6' 2" | | | | 34 | 34 | 34 | 34 |
| | | | | | 35 | 35 | 35 | 35 |
| | 6' 2½" to 6' 3" | | | | 35 | 35 | 35 | 35 |
| | | | | | 36 | 36 | 36 | 36 |
| XT | 6' 3½" to 6' 4" | | | | | | | 35 |
| | | | | | | | | 36 |
| | 6' 4½" to 6' 5" | | | | | | | 35 |
| | | | | | | | | 36 |
| EXTRA TALL | 6' 5½" to 6' 6" | | | | | | | 36 |
| | | | | | | | | 37 |
| | 6' 7" to 6' 8" | | | | | | | |

| | | CHEST SIZES | | | | | |
|---|---|---|---|---|---|---|---|
| | | 43 | 44 | 46 | 48 | 50 | 52 |
| S | 5' 4" to 5" 5" | 32 | 32 | | | | |
| | | 33 | 33 | | | | |

TABLE 20-continued

Sleeve Length

| | | | | | | | |
|---|---|---|---|---|---|---|---|
| SHORT | 5' 6" to 5' 7" | 32 | 32 | | | | |
| | | 33 | 33 | | | | |
| R | 5' 7½" to 5' 8" | 33 | 33 | 33 | | | |
| | | 34 | 34 | 34 | | | |
| REGULAR | 5' 8½" to 5' 9" | 33 | 33 | 33 | 34 | 34 | 34 |
| | | 34 | 34 | 34 | 35 | 35 | 35 |
| | 5' 9½" to 5' 10" | 34 | 34 | 34 | 34 | 34 | 35 |
| | | 35 | 35 | 35 | 35 | 35 | 36 |
| | 5' 10½" to 5' 11" | 34 | 34 | 34 | 34 | 35 | 35 |
| | | 35 | 35 | 35 | 35 | 36 | 36 |
| T | 5' 11½" to 6' | 34 | 34 | 34 | 35 | 35 | 35 |
| | | 35 | 35 | 35 | 36 | 36 | 36 |
| | 6' ½" to 6' 1" | 34 | 34 | 35 | 35 | 35 | 35 |
| | | 35 | 35 | 36 | 36 | 36 | 36 |
| TALL | 6' 1½" to 6' 2" | 35 | 35 | 35 | 35 | 35 | 36 |
| | | 36 | 36 | 36 | 36 | 36 | 37 |
| | 6' 2½" to 6' 3" | 35 | 35 | 35 | 36 | 36 | 36 |
| | | 36 | 36 | 36 | 37 | 37 | 37 |
| XT | 6' 3½" to 6' 4" | 35 | 35 | 36 | 36 | 36 | 37 |
| | | 36 | 36 | 37 | 37 | 37 | 38 |
| | 6' 4½" to 6' 5" | 36 | 36 | 36 | 36 | 36 | 37 |
| | | 37 | 37 | 37 | 37 | 37 | 38 |
| EXTRA TALL | 6' 5½" to 6' 6" | 36 | 36 | 36 | 37 | 37 | 37 |
| | | 37 | 37 | 37 | 38 | 38 | 38 |
| | 6' 7" to 6' 8" | | | 37 | 37 | 37 | 38 |
| | | | | 38 | 38 | 38 | 39 |

TABLE 21

Neck Sizes

| | | CHEST SIZES | | | | | | |
|---|---|---|---|---|---|---|---|---|
| | | 36 | 37 | 38 | 39 | 40 | 41 | 42 |
| S | 5' 4" to 5" 5" | 14½ | 14½ | 15 | 15 | 15½ | 15½ | 16 |
| | | 15 | 15 | 15½ | 15½ | 16 | 16 | 16½ |
| SHORT | 5' 6" to 5' 7" | 14½ | 14½ | 15 | 15 | 15½ | 15½ | 16 |
| | | 15 | 15 | 15½ | 15½ | 16 | 16 | 16½ |
| R | 5' 7½" to 5' 8" | 14½ | 14½ | 15 | 15 | 15½ | 15½ | 16 |
| | | 15 | 15 | 15½ | 15½ | 16 | 16 | 16½ |
| REGULAR | 5' 8½" to 5' 9" | 14½ | 14½ | 15 | 15 | 15½ | 15½ | 16 |
| | | 15 | 15 | 15½ | 15½ | 16 | 16 | 16½ |
| | 5' 9½" to 5' 10" | 14½ | 14½ | 15 | 15 | 15½ | 15½ | 16 |
| | | 15 | 15 | 15½ | 15½ | 16 | 16 | 16½ |
| | 5' 10½" to 5' 11" | 14½ | 14½ | 15 | 15 | 15½ | 15½ | 16 |
| | | 15 | 15 | 15½ | 15½ | 16 | 16 | 16½ |
| T | 5' 11½" to 6' | | | 15 | 15 | 15½ | 15½ | 16 |
| | | | | 15½ | 15½ | 16 | 16 | 16½ |
| TALL | 6' ½" to 6' 1" | | | 15 | 15 | 15½ | 15½ | 16 |
| | | | | 15½ | 15½ | 16 | 16 | 16½ |
| | 6' 1½" to 6' 2" | | | | 15 | 15½ | 15½ | 16 |
| | | | | | 15½ | 16 | 16 | 16½ |
| | 6' 2½" to 6' 3" | | | | 15 | 15½ | 15½ | 16 |
| | | | | | 15½ | 16 | 16 | 16½ |
| XT | 6' 3½" to 6' 4" | | | | | | | 16 |
| | | | | | | | | 16½ |
| EXTRA TALL | 6' 4½" to 6' 5" | | | | | | | 16 |
| | | | | | | | | 16½ |

TABLE 21-continued

| Neck Sizes | | |
|---|---|---|
| | 6' 5½" to 6' 6" | 16<br>16½ |
| | 6' 7" to 6' 8" | |

| | | CHEST SIZES | | | | | |
|---|---|---|---|---|---|---|---|
| | | 43 | 44 | 46 | 48 | 50 | 52 |
| S | 5' 4" to 5" 5" | 16<br>16½ | 16½<br>17 | | | | |
| SHORT | 5' 6" to 5' 7" | 16<br>16½ | 16½<br>17 | | | | |
| R | 5' 7½" to 5' 8" | 16<br>16½ | 16½<br>17 | 17<br>17½ | 17½<br>18 | 18<br>18½ | 18½<br>19 |
| REGULAR | 5' 8½" to 5' 9" | 16<br>16½ | 16½<br>17 | 17<br>17½ | 17½<br>18 | 18<br>18½ | 18½<br>19 |
| | 5' 9½" to 5' 10" | 16<br>16½ | 16½<br>17 | 17<br>17½ | 17½<br>18 | 18<br>18½ | 18½<br>19 |
| | 5' 10½" to 5' 11" | 16<br>16½ | 16½<br>17 | 17<br>17½ | 17½<br>18 | 18<br>18½ | 18½<br>19 |
| T | 5' 11½" to 6' | 16<br>16½ | 16½<br>17 | 17<br>17½ | 17½<br>18 | 18<br>18½ | 18½<br>19 |
| | 6' ½" to 6' 1" | 16<br>16½ | 16½<br>17 | 17<br>17½ | 17½<br>18 | 18<br>18½ | 18½<br>19 |
| TALL | 6' 1½" to 6' 2" | 16<br>16½ | 16½<br>17 | 17<br>17½ | 17½<br>18 | 18<br>18½ | 18½<br>19 |
| | 6' 2½" to 6' 3" | 16<br>16½ | 16½<br>17 | 17<br>17½ | 17½<br>18 | 18<br>18½ | 18½<br>19 |
| XT | 6' 3½" to 6' 4" | 16<br>16½ | 16½<br>17 | 17<br>17½ | 17½<br>18 | 18<br>18½ | 18½<br>19 |
| | 6' 4½" to 6' 5" | 16<br>16½ | 16½<br>17 | 17<br>17½ | 17½<br>18 | 18<br>18½ | 18½<br>19 |
| EXTRA TALL | 6' 5½" to 6' 6" | 16<br>16½ | 16½<br>17 | 17<br>17½ | 17½<br>18 | 18<br>18½ | 18½<br>19 |
| | 6' 7" to 6' 8" | | | 17<br>17½ | 17½<br>18 | 18<br>18½ | 18½<br>19 |

TABLE 22

| Waist Sizes | | CHEST SIZES | | | | | | |
|---|---|---|---|---|---|---|---|---|
| | | 36 | 37 | 38 | 39 | 40 | 41 | 42 |
| S | 5' 4" to 5" 5" | 28<br>30 | 28<br>30 | 30<br>32 | 30<br>32 | 32<br>34 | 32<br>34 | 34<br>36 |
| SHORT | 5' 6" to 5' 7" | 28<br>30 | 28<br>30 | 30<br>32 | 30<br>32 | 32<br>34 | 32<br>34 | 34<br>36 |
| R | 5' 7½" to 5' 8" | 28<br>30 | 28<br>30 | 30<br>32 | 30<br>32 | 32<br>34 | 32<br>34 | 34<br>36 |
| REGULAR | 5' 8½" to 5' 9" | 28<br>30 | 28<br>30 | 30<br>32 | 30<br>32 | 32<br>34 | 32<br>34 | 34<br>36 |
| | 5' 9½" to 5' 10" | 28<br>30 | 28<br>30 | 30<br>32 | 30<br>32 | 32<br>34 | 32<br>34 | 34<br>36 |
| | 5' 10½" to 5' 11" | 28<br>30 | 28<br>30 | 30<br>32 | 30<br>32 | 32<br>34 | 32<br>34 | 34<br>36 |
| T | 5' 11½" to 6' | | | 30<br>32 | 30<br>32 | 32<br>34 | 32<br>34 | 34<br>36 |
| | 6' ½" to 6' 1" | | | 30<br>32 | 30<br>32 | 32<br>34 | 32<br>34 | 34<br>36 |
| TALL | 6' 1½" to 6' 2" | | | | 30<br>32 | 32<br>34 | 32<br>34 | 34<br>36 |
| | 6' 2½" to 6' 3" | | | | 30<br>32 | 32<br>34 | 32<br>34 | 34<br>36 |
| XT | 6' 3½" to 6' 4" | | | | | | | 34<br>36 |
| | 6' 4½" to 6' 5" | | | | | | | 34<br>36 |
| EXTRA TALL | 6' 5½" to 6' 6" | | | | | | | 34<br>36 |
| | 6' 7" to 6' 8" | | | | | | | |

TABLE 22-continued

| Waist Sizes | | CHEST SIZES | | | | | |
|---|---|---|---|---|---|---|---|
| | | 43 | 44 | 46 | 48 | 50 | 52 |
| S | 5' 4" to 5" 5" | 34<br>36 | 36<br>38 | | | | |
| SHORT | 5' 6" to 5' 7" | 34<br>36 | 36<br>38 | | | | |
| R | 5' 7½" to 5' 8" | 34<br>36 | 36<br>38 | 40<br>42 | 42<br>44 | 44<br>46 | 46<br>48 |
| REGULAR | 5' 8½" to 5' 9" | 34<br>36 | 36<br>38 | 40<br>42 | 42<br>44 | 44<br>48 | 46<br>48 |
| | 5' 9½" to 5' 10" | 34<br>36 | 36<br>38 | 40<br>42 | 42<br>44 | 44<br>46 | 46<br>48 |
| | 5' 10½" to 5' 11" | 34<br>36 | 36<br>38 | 40<br>42 | 42<br>44 | 44<br>46 | 48<br>48 |
| T | 5' 11½" to 6' | 34<br>36 | 36<br>38 | 40<br>42 | 42<br>44 | 44<br>46 | 46<br>48 |
| | 6' ½" to 6' 1" | 34<br>36 | 36<br>38 | 40<br>42 | 42<br>44 | 44<br>46 | 48<br>48 |
| TALL | 6' 1½" to 6' 2" | 34<br>36 | 36<br>38 | 40<br>42 | 42<br>44 | 44<br>46 | 48<br>48 |
| | 6' 2½" to 6' 3" | 34<br>36 | 36<br>38 | 40<br>42 | 42<br>44 | 44<br>46 | 46<br>48 |
| XT | 6' 3½" to 6' 4" | 34<br>36 | 36<br>38 | 40<br>42 | 42<br>44 | 44<br>46 | 48<br>48 |
| | 6' 4½" to 6' 5" | 34<br>36 | 36<br>38 | 40<br>42 | 42<br>44 | 44<br>46 | 46<br>48 |
| EXTRA TALL | 6' 5½" to 6' 6" | 34<br>36 | 36<br>38 | 40<br>42 | 42<br>44 | 44<br>46 | 46<br>48 |

TABLE 22-continued

| Waist Sizes | | | | | |
|---|---|---|---|---|---|
| | 6' 7" to 6' 8" | 40 | 42 | 44 | 46 |
| | | 42 | 44 | 46 | 48 |

TABLE 23

| Pant Inseam | | CHEST SIZES | | | | | | |
|---|---|---|---|---|---|---|---|---|
| | | 36 | 37 | 38 | 39 | 40 | 41 | 42 |
| S | 5' 4" to 5" 5" | 28 | 28 | 28 | 27 | 27 | 27 | 27 |
| | | 29 | 29 | 29 | 28 | 28 | 28 | 28 |
| SHORT | 5' 6" to 5' 7" | 29 | 29 | 29 | 28 | 28 | 28 | 28 |
| | | 30 | 30 | 30 | 29 | 29 | 29 | 29 |
| R | 5' 7½" to 5' 8" | 29 | 29 | 30 | 29 | 29 | 29 | 29 |
| | | 30 | 30 | 31 | 30 | 30 | 30 | 30 |
| REGULAR | 5' 8½" to 5' 9" | 30 | 30 | 30 | 29 | 29 | 29 | 29 |
| | | 31 | 31 | 31 | 30 | 30 | 30 | 30 |
| | 5' 9½" to 5' 10" | 31 | 31 | 30 | 30 | 30 | 30 | 30 |
| | | 32 | 32 | 31 | 31 | 31 | 31 | 31 |
| | 5' 10½" to 5' 11" | 31 | 31 | 31 | 30 | 30 | 30 | 30 |
| | | 32 | 32 | 32 | 31 | 31 | 31 | 31 |
| T | 5' 11½" to 6' | | | 32 | 31 | 31 | 31 | 31 |
| | | | | 33 | 32 | 32 | 32 | 32 |
| TALL | 6' ½" to 6' 1" | | | 32 | 31 | 31 | 31 | 31 |
| | | | | 33 | 32 | 32 | 32 | 32 |
| | 6' 1½" to 6' 2" | | | | 32 | 32 | 32 | 32 |
| | | | | | 33 | 33 | 33 | 33 |
| | 6' 2½" to 6' 3" | | | | 32 | 32 | 32 | 32 |
| | | | | | 33 | 33 | 33 | 33 |
| XT | 6' 3½" to 6' 4" | | | | | | | 33 |
| | | | | | | | | 34 |
| EXTRA TALL | 6' 4½" to 6' 5" | | | | | | | 33 |
| | | | | | | | | 34 |

TABLE 23-continued

| Pant Inseam | | |
|---|---|---|
| | 6' 5½" to 6' 6" | 33 |
| | | 34 |
| | 6' 7" to 6' 8" | |

| | | CHEST SIZES | | | | | |
|---|---|---|---|---|---|---|---|
| | | 43 | 44 | 46 | 48 | 50 | 52 |
| S | 5' 4" to 5" 5" | 27 | 27 | | | | |
| | | 28 | 28 | | | | |
| SHORT | 5' 6" to 5' 7" | 28 | 28 | | | | |
| | | 29 | 29 | | | | |
| R | 5' 7½" to 5' 8" | 29 | 28 | 28 | | | |
| | | 30 | 29 | 29 | | | |
| REGULAR | 5' 8½" to 5' 9" | 29 | 29 | 29 | 28 | 28 | 28 |
| | | 30 | 30 | 30 | 29 | 29 | 29 |
| | 5' 9½" to 5' 10" | 30 | 30 | 29 | 29 | 29 | 29 |
| | | 31 | 31 | 30 | 30 | 30 | 30 |
| | 5' 10½" to 5' 11" | 30 | 30 | 30 | 29 | 29 | 29 |
| | | 31 | 31 | 31 | 30 | 30 | 30 |
| T | 5' 11½" to 6' | 31 | 31 | 30 | 30 | 30 | 29 |
| | | 32 | 32 | 31 | 31 | 31 | 30 |
| | 6' ½" to 6' 1" | 31 | 31 | 30 | 30 | 30 | 30 |
| | | 32 | 32 | 31 | 31 | 31 | 31 |
| TALL | 6' 1½" to 6' 2" | 32 | 32 | 31 | 31 | 31 | 31 |
| | | 33 | 33 | 32 | 32 | 32 | 32 |
| | 6' 2½" to 6' 3" | 32 | 32 | 32 | 31 | 31 | 31 |
| | | 33 | 33 | 33 | 32 | 32 | 32 |
| XT | 6' 3½" to 6' 4" | 33 | 33 | 32 | 32 | 32 | 32 |
| | | 34 | 34 | 33 | 33 | 33 | 33 |
| | 6' 4½" to 6' 5" | 33 | 33 | 32 | 32 | 32 | 32 |
| | | 34 | 34 | 33 | 33 | 33 | 33 |
| EXTRA TALL | 6' 5½" to 6' 6" | 33 | 33 | 33 | 33 | 32 | 32 |
| | | 34 | 34 | 34 | 34 | 33 | 33 |
| | 6' 7" to 6' 8" | | | 34 | 34 | 33 | 33 |
| | | | | 35 | 35 | 34 | 34 |

TABLE 24

| Hat Size | | CHEST SIZES | | | | | | |
|---|---|---|---|---|---|---|---|---|
| | | 36 | 37 | 38 | 39 | 40 | 41 | 42 |
| S | 5' 4" to 5" 5" | 6⅞ | 7 | 7⅛ | 7¼ | 7¼ | 7⅜ | 7⅜ |
| SHORT | 5' 6" to 5' 7" | 6⅞ | 7 | 7⅛ | 7¼ | 7¼ | 7⅜ | 7⅜ |
| R | 5' 7½" to 5' 8" | 6⅞ | 7 | 7⅛ | 7¼ | 7¼ | 7⅜ | 7⅜ |
| REGULAR | 5' 8½" to 5' 9" | 6⅞ | 7 | 7⅛ | 7¼ | 7¼ | 7⅜ | 7⅜ |
| | 5' 9½" to 5' 10" | 6⅞ | 7 | 7⅛ | 7¼ | 7¼ | 7⅜ | 7⅜ |
| | 5' 10½" to 5' 11" | 6⅞ | 7 | 7⅛ | 7¼ | 7¼ | 7⅜ | 7⅜ |
| T | 5' 11½" to 6' | | | 7⅛ | 7¼ | 7¼ | 7⅜ | 7⅜ |
| TALL | 6' ½" to 6' 1" | | | 7⅛ | 7¼ | 7¼ | 7⅜ | 7⅜ |
| | 6' 1½" to 6' 2" | | | | 7¼ | 7¼ | 7⅜ | 7⅜ |
| | 6' 2½" to 6' 3" | | | | 7¼ | 7¼ | 7⅜ | 7⅜ |
| XT | 6' 3½" to 6' 4" | | | | | | | 7⅜ |
| EXTRA TALL | 6' 4½" to 6' 5" | | | | | | | 7⅜ |
| | 6' 5½" to 6' 6" | | | | | | | 7⅜ |
| | 6' 7" to 6' 8" | | | | | | | |

| | | CHEST SIZES | | | | | |
|---|---|---|---|---|---|---|---|
| | | 43 | 44 | 46 | 48 | 50 | 52 |
| S | 5' 4" to 5" 5" | 7/1/02 | 7½ | 7¾ | 8 | 8¼ | 8¼ |
| SHORT | 5' 6" to 5' 7" | 7/1/02 | 7½ | 7¾ | 8 | 8¼ | 8¼ |
| R | 5' 7½" to 5' 8" | 7/1/02 | 7½ | 7¾ | 8 | 8¼ | 8¼ |
| REGULAR | 5' 8½" to 5' 9" | 7/1/02 | 7½ | 7¾ | 8 | 8¼ | 8¼ |
| | 5' 9½" to 5' 10" | 7/1/02 | 7½ | 7¾ | 8 | 8¼ | 8¼ |
| | 5' 10½" to 5' 11" | 7/1/02 | 7½ | 7¾ | 8 | 8¼ | 8¼ |
| T | 5' 11½" to 6' | 7/1/02 | 7½ | 7¾ | 8 | 8¼ | 8¼ |
| | 6' ½" to 6' 1" | 7/1/02 | 7½ | 7¾ | 8 | 8¼ | 8¼ |

TABLE 24-continued

| | | Hat Size | | | | | |
|---|---|---|---|---|---|---|---|
| TALL | 6' 1½" to 6' 2" | 7/1/02 | 7½ | 7¾ | 8 | 8¼ | 8¼ |
| | 6' 2½" to 6' 3" | 7/1/02 | 7½ | 7¾ | 8 | 8¼ | 8¼ |
| XT | 6' 3½" to 6' 4" | 7/1/02 | 7½ | 7¾ | 8 | 8¼ | 8¼ |
| | 6' 4½" to 6' 5" | 7/1/02 | 7½ | 7¾ | 8 | 8¼ | 8¼ |
| EXTRA TALL | 6' 5½" to 6' 6" | 7/1/02 | 7½ | 7¾ | 8 | 8¼ | 8¼ |
| | 6' 7" to 6' 8" | | | 7¾ | 8 | 8¼ | 8¼ |

What is claimed is:

1. A calculating device for determining an apparel size of an adult male based on a given weight and height comprising:

means for entering into the device a height and a weight, means for determining an apparel size from the entered height and weight based on the data in Tables 1–17 wherein the data is generated on a proportional basis from the data in Tables 1–17 with the following constrains on the data;

the weight increments are no greater than about 10 pounds per about one inch of height for a chest size less than 53;

the weight increments are not greater than 14 pounds per one inch of height for a chest size 53 or greater;

means for displaying the apparel size.

2. A calculating device according to claim 1 wherein the data used to determine the apparel size is the data in Table 1–17.

3. A calculating device according to claim 1 wherein the data used to determine the apparel size is more finely divided on a proportioned basis than the data in Table 1–17.

4. A calculating device according to claim 1 wherein the apparel size that can be calculated is a chest size ranging from greater than 52 inches to about 60 inches.

5. A calculating device according to claim 4 wherein the first recording material is a first disc and the second recording material is a second disc wherein the discs are coupled together to rotate about a common center.

6. A calculating device according to claim 1 wherein the data used to determine the apparel size is based on a weight range of about 280 to about 405 pounds.

7. A calculating device according to claim 1 wherein the weight increments are about 6–10 pounds per one inch of height.

8. A calculating device according to claim 1 wherein the height range is about five feet three inches to about 6 feet 8 inches; the weight range is from about 107 pounds to about 405 pounds.

9. A calculating device according to claim 8 wherein the height and weight is presented on the periphery of the first disk as shown in FIG. 1 and the second disc has a cutout for displaying the height and weight and an indicator for aligning the discs for a selected height and weight and the means to enter the height and weight is by rotating the disc until the indicator registers with the selected height and weight on the first disc.

10. A calculating device according to claim 9 wherein the apparel size is selected from the group consisting of ring size and related ring size, foot width, related foot width, foot length, and related foot size.

11. A calculating device according to claim 1 wherein the means for determining the data and displaying the apparel size is by presenting the data on a first recording material in a scalar relationship so that the apparel size can be displayed through a cutout in a second recording material that overlays and is aligned with the first recording material and where the recording materials are movable with respect to each other to allow entering the weight and height of the adult male.

12. A calculating device according to claim 1 wherein the means for determining an apparel size is a programmable computer.

13. A calculating device according to claim 1 wherein the apparel size is selected from the group consisting of chest, sleeve length, hat size, pants inseam and outseam length, foot length, shoe size (related foot size), hand length, head and neck length, head circumference, hat size, hand width, foot width, related foot width, neck, waist athletic, waist trim, waist average, ring finger circumference, ring size and related ring size.

14. A calculating device according to claim 1 wherein the apparel size is selected from the group consisting of ring size and related ring size, foot width, related foot width, foot length, and related foot size.

15. A sizing wheel calculator for determining an apparel size for an adult male based on a given weight and height comprising:

a first disc having thereon scalar presentations of data in wherein the data is generated on a proportional basis from the data in Table 18–24 with the following constrains:

for chest sizes less than 46 and for heights greater then 5 feet and 6 inches, the weight increments are no greater than about 10 pounds per 1.5 inch of height;

for a chest size 46 or greater, the weight increments are no greater than 18 pounds per 1.5 inch of height;

the height intervals are no greater than about 1.5 inch the height range is about five feet four inches to about 6 feet 8 inches;

the weight ranges is from about 127 pounds to about 300 pounds;

wherein the height and weight is presented on the periphery of the first disk as shown in FIG. 1;

a second disc the second has a cutout for displaying the height and weight on the first disc as shown in FIG. 1 and a cutout for displaying an apparel size presented on the first disc;

an indicator for aligning the discs for a selected height is presented on disc 2;

the first disc and the second disc are coupled together to rotate about a common center;

and the means for computing an apparel size is to enter the height and weight into the calculator by rotating the disc until the indicator registers with the selected height and weight on the first disc resulting in an apparel size displayed by the cut out in second disc.

16. A calculator according to claim 15 wherein the apparel size is selected from the group consisting of chest, sleeve length, hat size, pants inseam and out seam length, foot length, shoe size (related foot size), hand length, head and neck length, head circumference, hat size, hand width, foot width, related foot width, neck, waist athletic, waist trim, waist average, ring finger circumference, ring size, related ring size and sportswear size.

17. A calculator according to claim 15 wherein the apparel size that can be calculated is a chest size ranging from greater than about 46 inches to about 60 inches.

18. A calculator according to claim 15 wherein the data used to determine the apparel size is based on a weight range of about 280 to about 405 pounds.

19. A calculator according to claim 15 wherein the data used to determine the apparel size is based is based on Tables 18–24.

20. A calculator according to claim 15 wherein the back side of the discs are use to calculate the apparel size.

* * * * *